US007441856B2

(12) United States Patent
Usui

(10) Patent No.: US 7,441,856 B2
(45) Date of Patent: Oct. 28, 2008

(54) PRINTING METHOD AND PRINTING APPARATUS

(75) Inventor: Toshiki Usui, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 127 days.

(21) Appl. No.: 11/640,283

(22) Filed: Dec. 18, 2006

(65) Prior Publication Data

US 2007/0139457 A1 Jun. 21, 2007

(30) Foreign Application Priority Data

Dec. 16, 2005 (JP) ..... 2005-362620

(51) Int. Cl.
*B41J 2/205* (2006.01)

(52) U.S. Cl. ..... 347/15; 358/1.9

(58) Field of Classification Search ..... 347/15, 347/43, 41, 9–11; 358/1.2, 1.9, 3.23
See application file for complete search history.

(56) References Cited

U.S. PATENT DOCUMENTS 7,131,713 B2 * 11/2006 Otsuka et al. ..... 347/15
7,152,948 B2 * 12/2006 Kawatoko et al. ..... 347/41

FOREIGN PATENT DOCUMENTS

JP 09-011457 A 1/1997

* cited by examiner

*Primary Examiner*—Lamson D. Nguyen
(74) *Attorney, Agent, or Firm*—Sughrue Mion, PLLC

(57) ABSTRACT

A printing method includes: at a certain timing, controlling a first drive element so that a dot can be formed for each pixel with a first number of gradations, and controlling a second drive element so that a dot can be formed for each pixel with a second number of gradations that is lower than the first number of gradations, the first drive element being driven to form a dot by ejecting an ink of a first color from a nozzle, and the second drive element being driven to form a dot by ejecting an ink of a second color that is different from the first color from a different nozzle; and at a different timing, controlling the first drive element so that a dot can be formed for each pixel with the second number of gradations.

17 Claims, 34 Drawing Sheets

(Blue Image Printing)

| Color | Gradation | Control Data | Input Signal | |
|---|---|---|---|---|
| | | | First Input Section | Second Input Section |
| Black | 4 | 00 | TR1 | GND |
| Yellow | 4 | 00 | TR2 | GND |
| Cyan | 8 | 01 | TR3 | TR5 |
| Magenta | 8 | 10 | TR4 | TR6 |

FIG. 19A (Red Image Printing)

| Color | Gradation | Control Data | Input Signal | |
|---|---|---|---|---|
| | | | First Input Section | Second Input Section |
| Black | 4 | 00 | TR1 | GND |
| Yellow | 8 | 01 | TR2 | TR5 |
| Cyan | 4 | 00 | TR3 | GND |
| Magenta | 8 | 10 | TR4 | TR6 |

FIG. 19B (Monochrome Printing)

| Color | Gradation | Control Data | Input Signal | |
|---|---|---|---|---|
| | | | First Input Section | Second Input Section |
| Black | 8 | 01 | TR1 | TR5 |
| Yellow | 4 | 00 | TR2 | GND |
| Cyan | 4 | 00 | TR3 | GND |
| Magenta | 4 | 00 | TR4 | GND |

FIG. 19C

| pixel data | applied pulse | size of ink droplet |
|---|---|---|
| 00 | PS11 | 0(fine vibration) |
| 01 | PS13 | 3pl |
| 10 | PS12 | 7pl |
| 11 | PS12+PS14 | 14pl |

FIG. 21A

| pixel data | applied pulse | size of ink droplet |
|---|---|---|
| 000 | PS11 | 0(fine vibration) |
| 001 | PS15 | 1. 5pl |
| 010 | PS13 | 3 |
| 011 | PS13+PS15 | 4. 5 |
| 100 | PS12 | 7 |
| 101 | PS14+PS15 | 8. 5 |
| 110 | PS12+PS13 | 10 |
| 111 | PS12+PS14 | 14 |

FIG. 21B

| before decoding | | after decoding | |
|---|---|---|---|
| 000 | → | 000 | (fine vibration) |
| 001 | → | 100 | |
| 010 | → | 001 | (3pl) |
| 011 | → | 101 | |
| 100 | → | 010 | (7pl) |
| 101 | → | 110 | |
| 110 | → | 111 | |
| 111 | → | 011 | (14pl) |

FIG. 22

| before decoding | | after decoding | |
|---|---|---|---|
| 000 | → | 000 | (fine vibration) |
| 001 | → | 100 | |
| 010 | → | 001 | (3pl) |
| 011 | → | 010 | (7pl) |
| 100 | → | 101 | |
| 101 | → | 011 | (14pl) |

FIG. 26

| before decoding | | after decoding | |
|---|---|---|---|
| 000 | → | 000 | (fine vibration) |
| 001 | → | 100 | |
| 010 | → | 001 | (3pl) |
| 011 | → | 010 | (7pl) |
| 100 | → | 011 | (14pl) |
| 101 | → | 101 | |

FIG. 30

| pixel data | first switch signal SW_A | second switch signal SW_B |
|---|---|---|
| 000 | q0 | q6 |
| 001 | q1 | q7 |
| 010 | q2 | q8 |
| 011 | q3 | q9 |
| 100 | q4 | q10 |
| 101 | q5 | q11 |

FIG. 33

PRINTING METHOD AND PRINTING APPARATUS

CROSS-REFERENCE TO RELATED APPLICATIONS

The present application claims priority upon Japanese Patent Application No. 2005-362620 filed on Dec. 16, 2005, which is herein incorporated by reference.

BACKGROUND

1. Technical Field

The present invention relates to printing methods and printing apparatuses.

2. Related Art

Inkjet printers are known as one example of printing apparatuses that eject droplets of liquid. Inkjet printers form dots on paper by ejecting ink droplets from nozzles, thereby printing print images that are made of many dots on the paper.

In the head unit for ejecting ink droplets, a drive element such as a piezo element or a heater is provided for each nozzle in order to effect the ejection of an ink droplet from the nozzle. The head unit is also provided with a head controller for controlling the driving of the drive elements (see JP-A-9-11457).

When printing a blue image (an image with blue as a main color) with high image quality, in order to smoothly change the middles tones of blue, it is preferable to print cyan and magenta that are associated with blue with a high number of gradations. On the other hand, in order to print a red image (an image with red as a main color) with high image quality, in order to smoothly change the middles tones of red, it is preferable to print yellow and magenta that are associated with red with a high number of gradations. However, if all the colors are printed with a high number of gradations, data amount necessary for printing becomes large.

SUMMARY

It is an object of the invention to provide a printing method that can make the number of gradations for each color variable.

A main aspect of the invention for achieving the foregoing object is a printing method including:

at a certain timing, controlling a first drive element so that a dot can be formed for each pixel with a first number of gradations, and controlling a second drive element so that a dot can be formed for each pixel with a second number of gradations that is lower than the first number of gradations, the first drive element being driven to form a dot by ejecting an ink of a first color from a nozzle, and the second drive element being driven to form a dot by ejecting an ink of a second color that is different from the first color from a different nozzle; and at a different timing, controlling the first drive element so that a dot can be formed for each pixel with the second number of gradations.

Features and objects of the present invention other than the above will become clear by reading the description of the present specification with reference to the accompanying drawings.

BRIEF DESCRIPTION OF THE DRAWINGS

For a more complete understanding of the present invention and the advantages thereof, reference is now made to the following description taken in conjunction with the accompanying drawings.

FIG. 19A to 19C are explanatory diagrams of relationships between control data stored in the control data storage section 482 and signals input in head controllers. FIG. 19A is an explanatory diagram of when blue is decided as a primary color in color printing. FIG. 19B is an explanatory diagram of when red is decided as a primary color in color printing. FIG. 19C is an explanatory diagram in monochrome printing.

FIG. 21A is a table for explaining the relationship between the pixel data and the ink droplet size at the time of four gradation printing, and FIG. 21B is a table for explaining the relationship between the pixel data and the ink droplet size at the time of eight gradation printing.

FIG. 22 is an explanatory diagram of the decoding of the pixel data in eight gradation printing.

FIG. 26 is an explanatory diagram of the decoding of the pixel data in six gradation printing.

FIG. 30 is an explanatory diagram of the decoding of the pixel data in six gradation printing.

FIG. 33 is a table of the relationship between the 3-bit pixel data and the selection signal that should be selected by the signal selection section.

DESCRIPTION OF EXEMPLARY EMBODIMENTS

Figure 1:
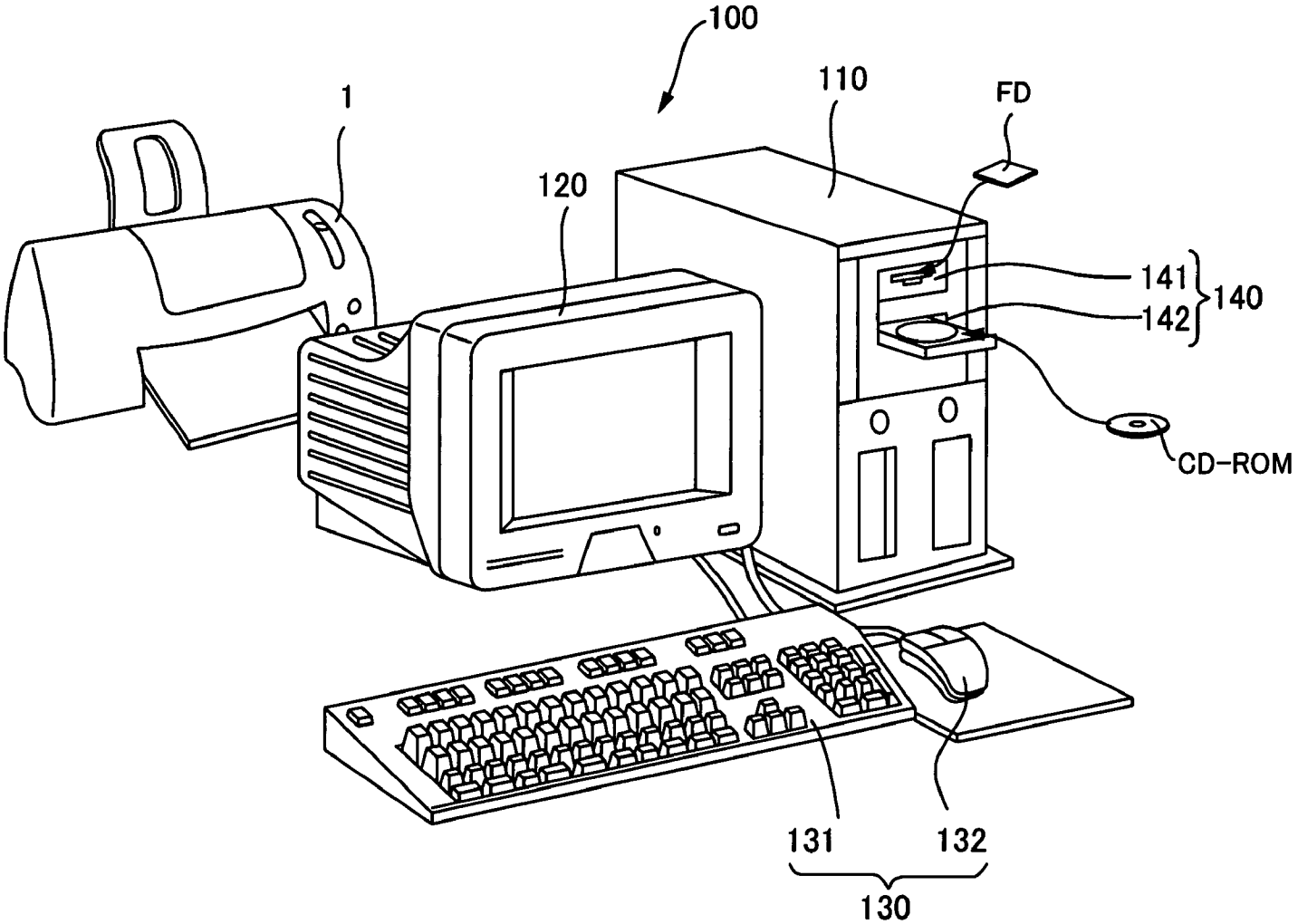
FIG. 1 is a diagram explaining the configuration of the printing system 100.

At least the following matters will become clear through the description of the present specification and the accompanying drawings.

A printing method including:

at a certain timing, controlling a first drive element so that a dot can be formed for each pixel with a first number of gradations, and controlling a second drive element so that a dot can be formed for each pixel with a second number of gradations that is lower than the first number of gradations, the first drive element being driven to form a dot by ejecting an ink of a first color from a nozzle, and the second drive element being driven to form a dot by ejecting an ink of a second color that is different from the first color from a different nozzle; and at a different timing, controlling the first drive element so that a dot can be formed for each pixel with the second number of gradations.

According to such a printing method, the number of gradations of the first color can be made variable.

A printing method is desirable, wherein a number of gradations when controlling the driving of the first drive element can be switched, according to a printing condition.

A printing method is preferable, wherein a number of gradations when controlling the driving of the first drive element can be switched, based on an image to be printed.

Thus, high image quality printing can be performed.

A printing method is preferable, wherein drive elements driven to eject an ink of a color of any two colors of CMY based on any color of RGB specified by an analysis of image data of RGB color space, are controlled with the first number of gradations, and wherein a drive element driven to eject ink of a color of the other one color of CMY is controlled with the second number of gradations.

Thus, it becomes easy to specify a color to be controlled with the first number of gradations.

A printing method is preferable, wherein a number of gradations when controlling the driving of the first drive element can be switched, based on information auxiliary to image data to be printed.

A printing method is desirable, wherein a first controller provided to a main body, and a second controller that is movable with the nozzle are provided, and wherein, in between the first controller and the second controller, a plurality of signal lines for transmitting a signal for driving the first drive element and the second drive element are provided.

Thus, the number of signal lines can be decreased.

A printing method is desirable, wherein the second controller has a switching section for switching a signal to be transmitted to at least one shared signal line of a plurality of the signal lines, to a signal for driving the first drive element or a signal for driving the second drive element.

A printing method is preferable, wherein the second controller has a first controller for controlling the driving of the first drive element, and a second controller for controlling the driving of the second drive element, wherein the first controller and the second controller have a first input section and a second input section respectively, wherein a signal for driving the first drive element is input to the first input section of the first controller, wherein a signal for driving the second drive element is input to the first input section of the second controller, and wherein a signal to be transmitted to the shared signal line is input to the second input section of the first controller and the second input section of the second controller, via the switching section.

A printing method is desirable, wherein the switching section has a storage section for storing data for determining input of a signal to the second input section.

A printing method is preferable, wherein, when storing data for determining input of a signal to the second input section of the first controller to the storage section, a signal line for inputting a signal to the first input section of the first controller is used, and wherein when storing data for determining input of a signal to the second input section of the second controller to the storage section, a signal line for inputting a signal to the first input section of the second controller is used.

Thus, the number of signal lines can be decreased.

A printing method is desirable, wherein the first controller and the second controller control a drive element based on the first number of gradations, when a signal for driving the drive element is input to the first input section and the second input section, and control the drive element based on the second number of gradations, when a signal for driving the drive element is input to the first input section and a signal of a constant potential is input to the second input section.

Thus, with such structure, the structure of the first controller and the second controller can be made common.

A printing method is desirable, wherein the first controller and the second controller control the drive element based on the first number of gradations according to i+j bit of data, when a signal including i bit of data is input to the first input section, and a signal including j bit of data is input to the second input section, and control the drive element based on the second number of gradations according to i bit of data, when i bit of data is input to the first input section and a signal including data is not input to the second input section.

Thus, it becomes unnecessary to input data to the second input section of the controller that controls the drive element based on the second number of gradations, so that data amount to be transmitted can be decreased.

A printing method is desirable, wherein a first pixel data is included in a signal to be input to the first input section of the first controller and the first input section of the second controller, wherein a second pixel data is included in a signal to be transmitted to the shared signal line, wherein the first controller and the second controller control the drive element based on the first pixel data and the second pixel data, when a signal to be transmitted to the shared signal line is input to the second input section, and control the drive element based on the first pixel data, when a signal to be transmitted to the shared signal line is not input to the second input section.

Thus, it becomes unnecessary to input pixel data to the second input section of the controller that controls the drive element based on the second number of gradations, and the data amount to be transmitted can be decreased.

A printing method is preferable, wherein the first controller and the second controller have a first pixel data storage section for storing the first pixel data, and a second pixel data storage section for storing the second pixel data respectively, wherein, data of a specific value is stored in the second pixel data storage section, when a signal to be transmitted to the shared signal line is not input to the second input section, and wherein the first controller and the second controller control the drive element based on data that has been stored in the first pixel data storage section and the second pixel data storage section.

Thus, even if the first controller and the second controller perform the same operation regardless of the number of gradations, the number of gradations output by each controller can be switched.

A printing method is desirable, wherein the first controller and the second controller have a switch that controls whether or not to apply a drive signal to a drive element, wherein signals to be input to the first input section of the first controller and the first input section of the second controller, include a first setting data for setting the control of the switch, wherein a signal to be transmitted to the shared signal line includes a second setting data for setting the control of the switch, and wherein the first controller and the second controller control the switch based on the first setting data and the second setting data, when a signal to be transmitted to the shared signal line is input to the second input section, and control the switch based on the first setting data, when a signal to be transmitted to the shared signal line is not input to the second input section.

Thus, it becomes unnecessary to input setting data to the second input section of the controller that controls the switch based on the second number of gradations, and data amount to be transmitted can be decreased.

A printing method is preferable, wherein the first controller and the second controller have a first setting data storage section for storing the first setting data, and a second setting data storage section for storing the second setting data, wherein, when a signal to be transmitted to the shared signal line is not input to the second input section, data of a specific value is stored in the second setting data storage section, and wherein the first controller and the second controller control the switch based on data stored in the first setting data storage section and the second setting data storage section.

Thus, even if the first controller and the second controller perform the same operation regardless of the number of gradations, the number of gradations output by each controller can be switched.

A printing apparatus including:

a first drive element that is driven to form a dot by ejecting an ink of a first color from a nozzle;

a second drive element that is driven to form a dot by ejecting an ink of a second color different from the first color from a different nozzle; and a controller that controls the first drive element so that a dot can be formed for each pixel with a first number of gradations, and controls the second drive element so that a dot can be formed for each pixel with a second number of gradations that is lower than the first number of gradations, at a certain timing, the controller controlling the first drive element so that a dot can be formed for each pixel with the second number of gradations, at a different timing.

According to such a printing apparatus, the number of gradations of the first color can be made variable.

A printing system including:

a first drive element that is driven to form a dot by ejecting an ink of a first color from a nozzle;

a second drive element that is driven to form a dot by ejecting an ink of a second color different from the first color from a different nozzle; and a controller that controls the first drive element so that a dot can be formed for each pixel with a first number of gradations, and controls the second drive element so that a dot can be formed for each pixel with a second number of gradations that is lower than the first number of gradations, at a certain timing, the controller controlling the first drive element so that a dot can be formed for each pixel with the second number of gradations, at a different timing.

According to such a printing system, the number of gradations of the first color can be made variable.

A program that makes a printing apparatus, including a first drive element that is driven to form a dot by ejecting an ink of a first color from a nozzle, and a second drive element that is driven to form a dot by ejecting an ink of a second color that is different from the first color from a different nozzle, at a certain timing, control the first drive element so that a dot can be formed for each pixel with a first number of gradations, and control the second drive element so that a dot can be formed for each pixel with a second number of gradations that is lower than the first number of gradations, and at a different timing, control the first drive element so that a dot can be formed for each pixel with the second number of gradations.

According to such a program, the printing apparatus can be controlled so that number of gradations of the first color can be made variable.

Configuration of the Printing System

Regarding the Overall Configuration

FIG. 1 is a diagram that explains the configuration of a printing system 100. The printing system 100 of this example includes a printer 1 as a printing apparatus and a computer 110 as a print control apparatus. Specifically, the printing system 100 has the printer 1, the computer 110, a display device 120, an input device 130, and a recording and reproducing device 140.

The printer 1 prints images on media such as paper, cloth, and film. The computer 110 is communicably connected to the printer 1. To print images with the printer 1, the computer 110 outputs print data that correspond to the image to the printer 1. Computer programs such as an application program and a printer driver are installed on the computer 110. The display device 120 has a display. The display device 120 is a device for displaying a user interface of the computer programs, for example. The input device 130 is, for example, a keyboard 131 and a mouse 132. The recording and reproducing device 140 is, for example, a flexible disk drive device 141 and a CD-ROM drive device 142.

Computer

Figure 2:
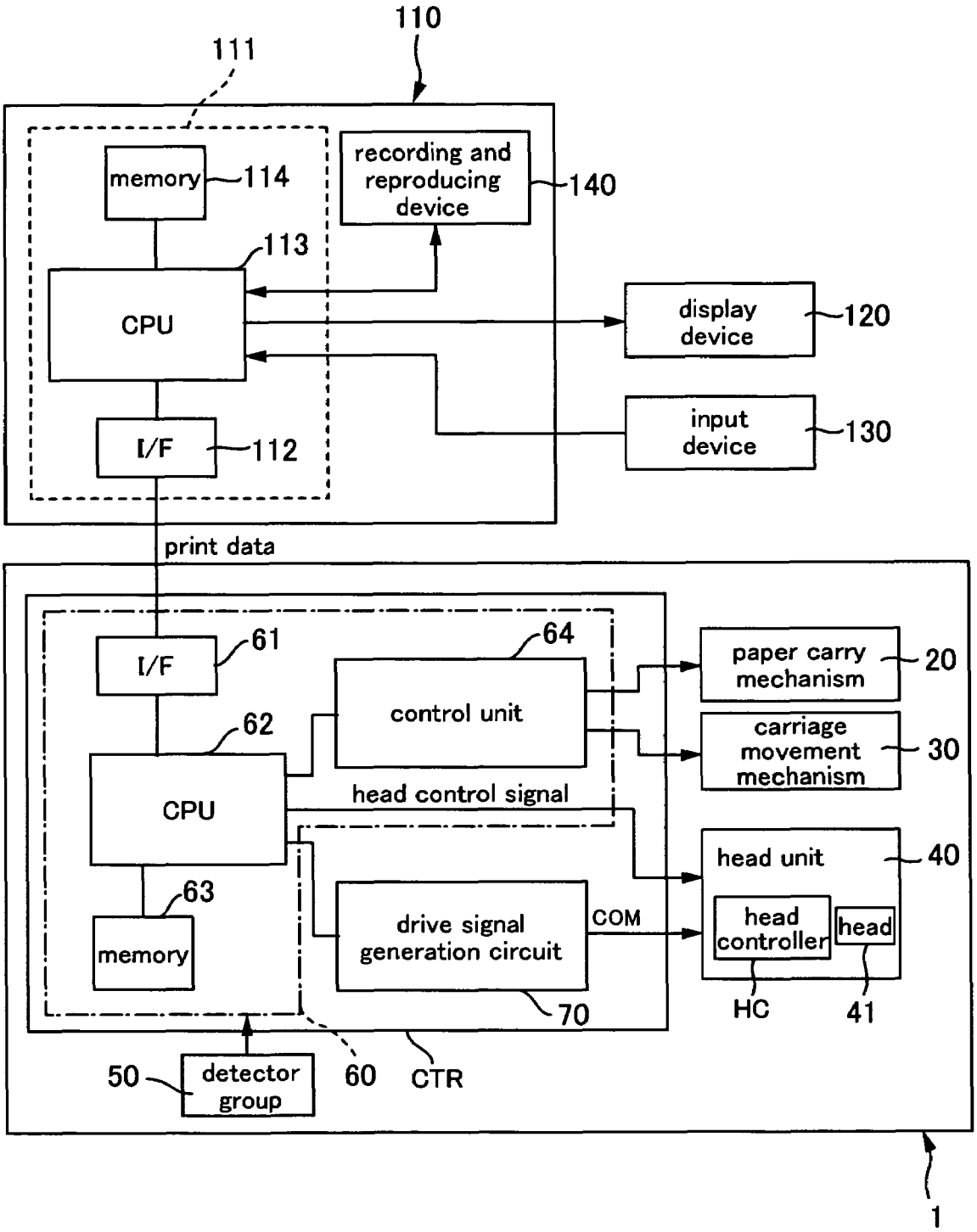
FIG. 2 is a block diagram explaining the configuration of the computer 110 and the printer 1.

FIG. 2 is a block diagram for explaining the configuration of the computer 110 and the printer 1. First, the configuration of the computer 110 is described in brief. The computer 110 has the recording and reproducing device 140 described above and a host-side controller 111. The recording and reproducing device 140 is communicably connected to the host-side controller 111, and for example is attached to the housing of the computer 110. The host-side controller 111 performs various controls in the computer 110, and is also communicably connected to the display device 120 and the input device 130 mentioned above. The host-side controller 111 has an interface section 112, a CPU 113, and a memory 114. The interface section 112 is interposed between the computer 110 and the printer 1, and sends and receives data between the two. The CPU 113 is a computation processing device for performing overall control of the computer 110. The memory 114 is for securing a working region and a region for storing computer programs used by the CPU 113, and is constituted by a RAM, EEPROM, ROM, or magnetic disk device, for example. Examples of computer programs that are stored on the memory 114 include the application program and the printer driver mentioned above. The CPU 113 performs various controls in accordance with the computer programs stored on the memory 114.

The printer driver causes the computer 110 to convert the image data into print data and sends these print data to the printer 1. The print data are data in a form that can be understood by the printer 1, and include various command data and pixel data. Command data are data for ordering the printer 1 to execute a specific operation. Examples of the command data include command data for directing the feeding of paper, command data for indicating the carry amount, and command data for directing the discharge of paper. The pixel data are data relating to the pixels of the image to be printed.

Here, a pixel refers to a unit pixel that is part of an image, and images are formed by arranging pixels in rows in two dimensions. The pixel data of the print data are data relating to the dots that are formed on the paper S (for example, they are gradation values).

In this embodiment, the pixel data are two bits or three bits of data per pixel. 2-bit pixel data can express a single pixel in four gradations. 3-bit pixel data can express a single pixel in eight gradations.

Printer

Regarding the Configuration of the Printer 1

Figure 3:
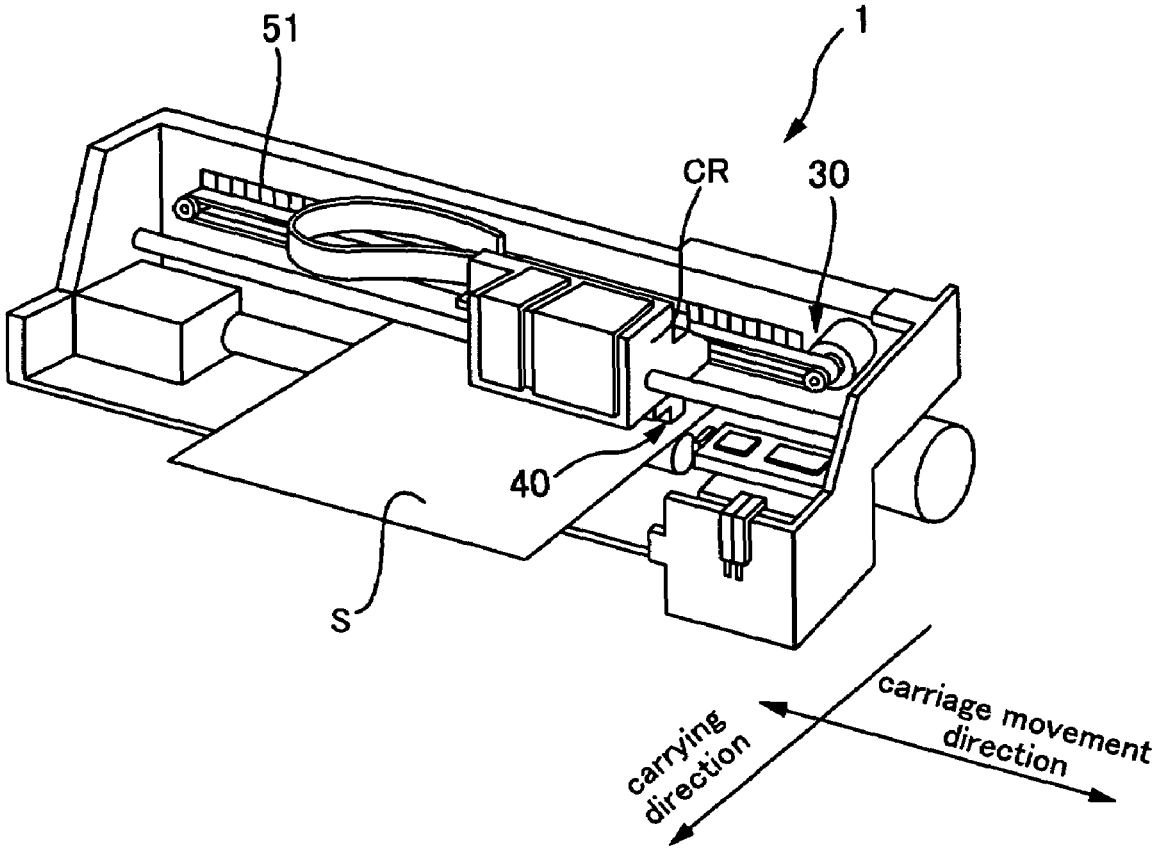
FIG. 3 is a diagram showing the configuration of the printer 1 of the embodiments.

FIG. 3 is a diagram showing the configuration of the printer 1 of the present embodiment. It should be noted that in the following description, reference is also made to FIG. 2.

The printer 1 has a paper carry mechanism 20, a carriage movement mechanism 30, a head unit 40, a detector group 50, a printer-side controller 60, and a drive signal generation circuit 70. In the present embodiment, the printer-side controller 60 and the drive signal generation circuit 70 are provided on a common controller board CTR. Moreover, the head unit 40 has a head controller HC and a head 41.

In the printer 1, the printer-side controller 60 controls the sections to be controlled, i.e., the paper carry mechanism 20, the carriage movement mechanism 30, the head unit 40 (head controller HC, head 41), and the drive signal generation circuit 70. Thus, based on the print data received from the computer 110, the printer-side controller 60 causes the image to be printed on the paper S. Moreover, the detectors in the detector group 50 monitor the conditions in the printer 1. The detectors output the detection results to the printer-side controller 60. The printer-side controller 60 receives the detection results from the detectors, and controls the sections to be controlled based on the detection results.

The paper carry mechanism 20 is for carrying media in the carrying direction. The paper carry mechanism 20 feeds the paper S up to a printable position, and also carries the paper S in a carrying direction by a predetermined carry amount. The carrying direction is a direction that intersects the carriage movement direction.

The carriage movement mechanism 30 is for moving a carriage CR to which the head unit 40 is attached in the carriage movement direction. The carriage movement direction includes a movement direction from one side to the other side and a movement direction from the other side to the one side. It should be noted that since the head unit 40 has the head 41, the carriage movement direction corresponds to the movement direction of the head 41, and the carriage movement mechanism 30 moves the head 41 in the movement direction.

The head unit 40 is for ejecting ink toward the paper S. The head unit 40 is attached to the carriage CR. The head 41 of the head unit 40 is provided on the lower surface of a head case.

Moreover, the head controller HC of the head unit 40 is provided inside the head case. The head controller HC is described in greater detail later.

The detector group 50 is for monitoring the conditions in the printer 1. The detector group 50 includes, among others, a linear encoder 51 for detecting the position of the carriage CR in the movement direction. Additionally, the detector group 50 also includes a sensor for detecting the carry amount of the paper (such as an encoder that detects the amount of rotation of the carry roller for carrying the paper).

The printer-side controller 60 performs control of the printer 1. The printer-side controller 60 has an interface section 61, a CPU 62, a memory 63, and a control unit 64. The interface section 61 exchanges data with the computer 110, which is an external apparatus. The CPU 62 is a computer processing unit for performing overall control of the printer 1. The memory 63 is for reserving an area for storing programs for the CPU 62 and a working area, for example, and is constituted by a storage element such as a RAM, an EEPROM, or a ROM. The CPU 62 controls the sections to be controlled according to the computer programs stored on the memory 63. For example, the CPU 62 controls the paper carry mechanism 20 and the carriage movement mechanism 30 via the control unit 64. Moreover, the CPU 62 outputs head control signals for controlling the operation of the head 41 to the head controller HC and outputs a generation signal for generating a drive signal COM to the drive signal generation circuit 70. When printing, the printer-side controller 60 alternately repeats a dot formation operation of ejecting ink from the head 41 while moving the carriage CR so as to form dots on a paper, and a carrying operation of causing the paper carry mechanism 20 to carry the paper, thereby printing an image on the paper.

The drive signal generation circuit 70 generates drive signals COM. The drive signal generation circuit 70, depending on the embodiments described later, generates one type of drive signal COM or generates two types of drive signals COM (first drive signal COM_A, second drive signal COM_B).

Configuration of the Head 41

Figure 4:
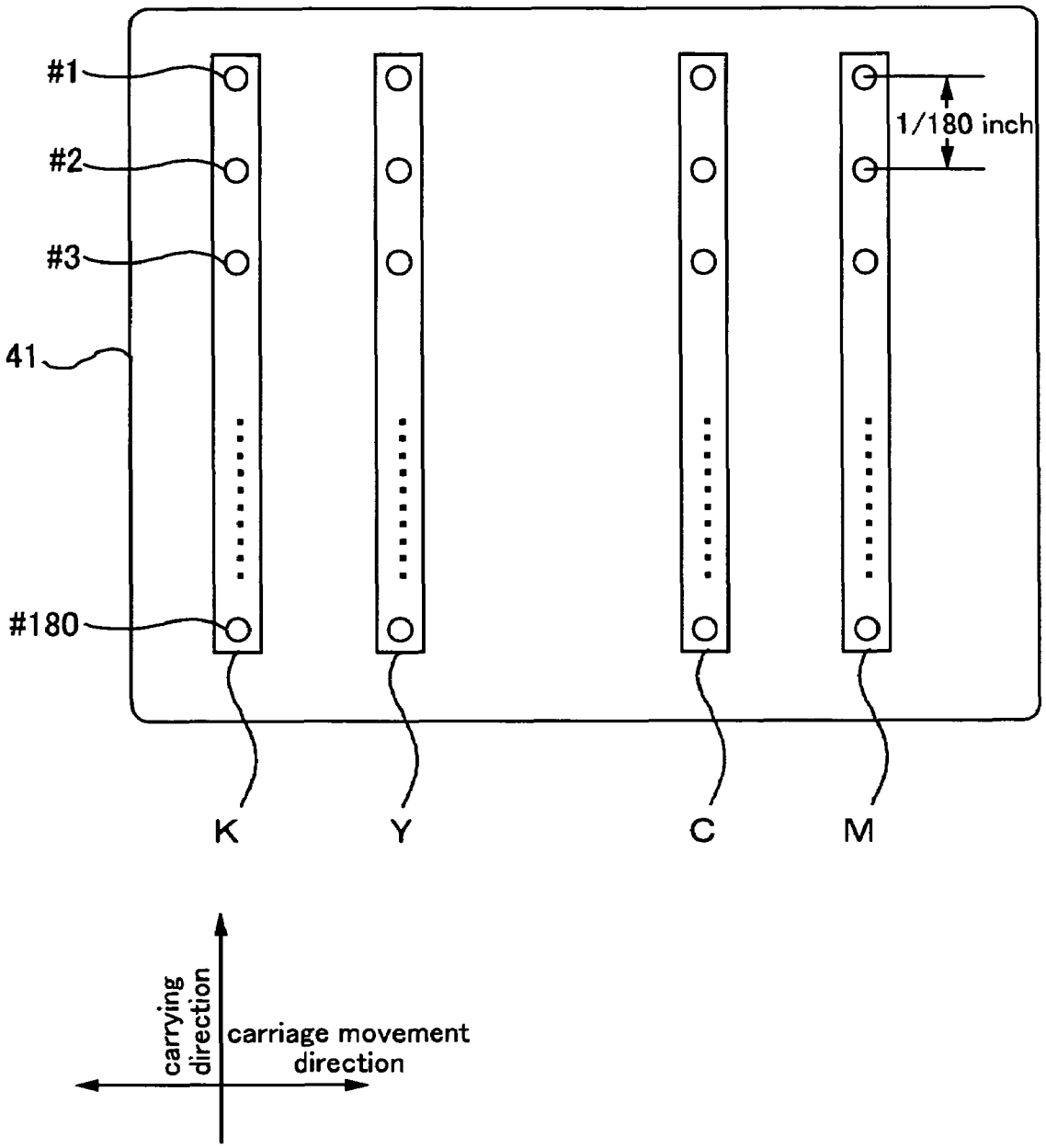
FIG. 4 is an explanatory diagram of the nozzles provided in the head 41.

FIG. 4 is an explanatory diagram of the nozzles provided in the head 41. A black ink nozzle group K, a yellow ink nozzle group Y, a cyan ink nozzle group C, and a magenta ink nozzle group M are formed in the lower surface of the head 41. Each nozzle group is provided with 180 nozzles that are ejection openings for ejecting ink of that color. Each nozzle is provided with an ink chamber (not shown) and a piezo element. Driving the piezo element causes the ink chamber to expand and contract, thereby ejecting an ink droplet from the nozzle. From the various nozzles it is possible to eject a plurality of types of ink in differing amounts. Thus, dots of different sizes can be formed on the paper.

Figure 5:
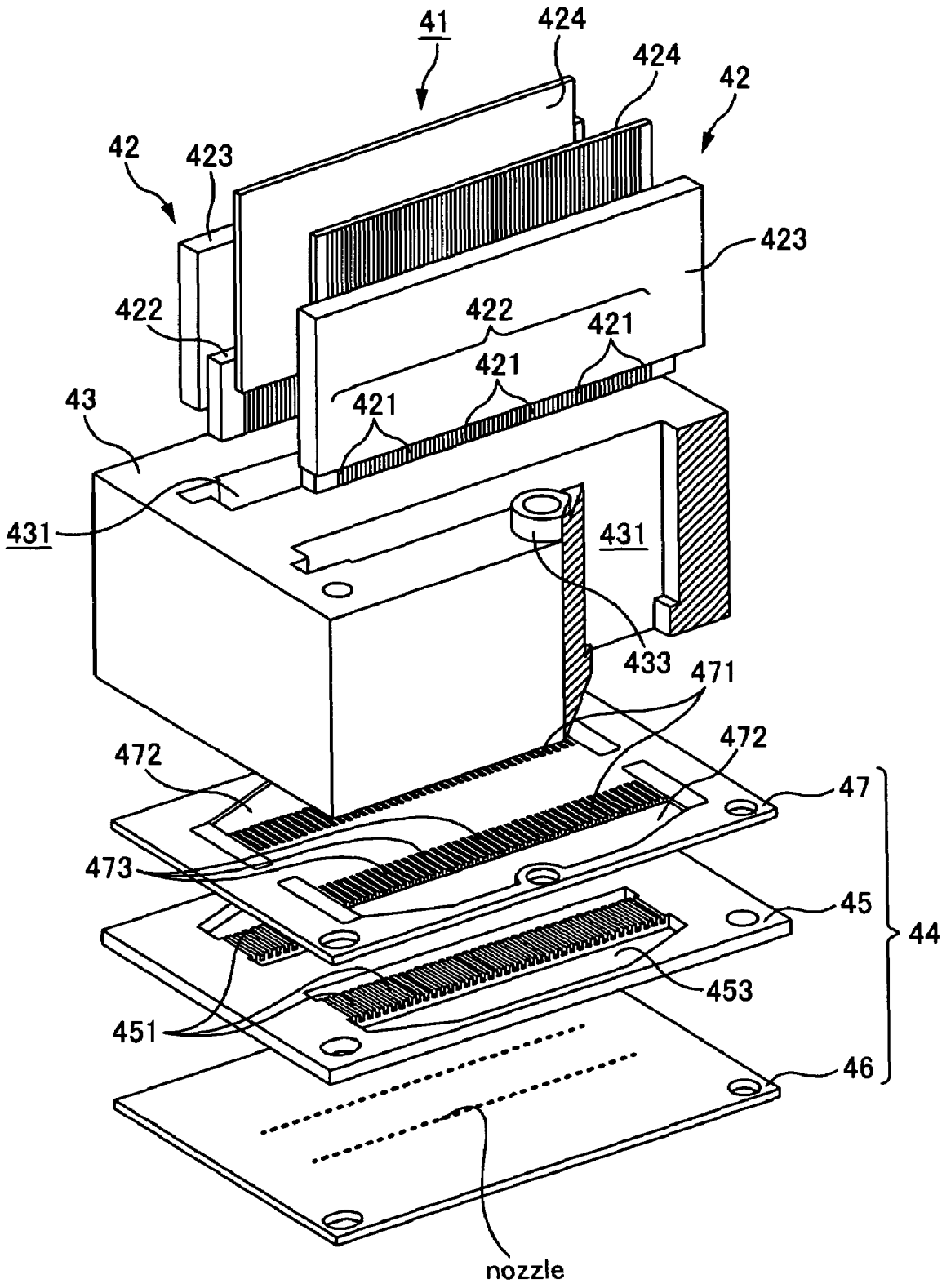
FIG. 5 is an explanatory diagram of the configuration surrounding the black ink nozzle group K and the cyan ink nozzle group C.
Figure 6:
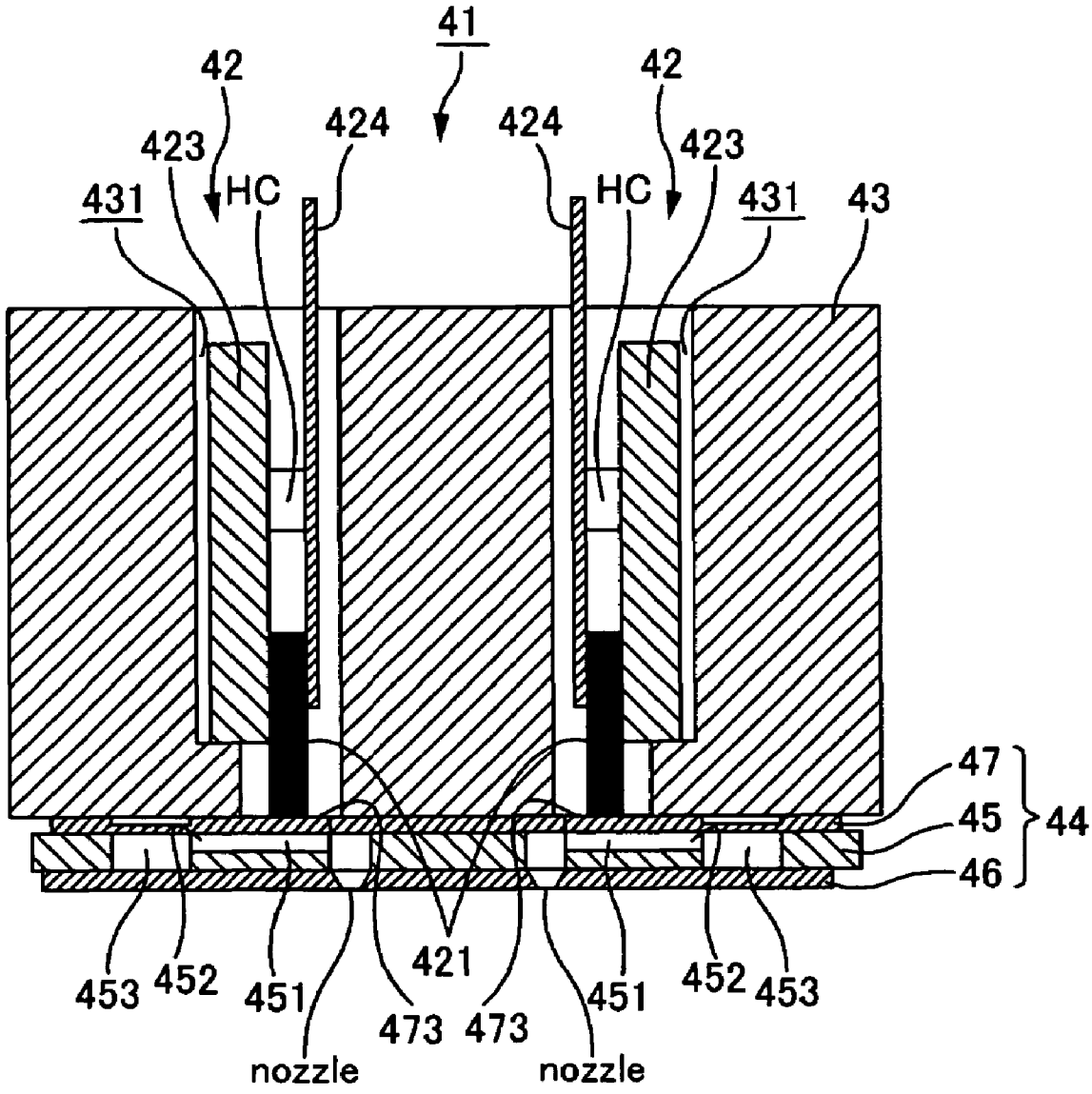
FIG. 6 is a cross-sectional diagram of the surroundings of the two nozzle groups.

FIG. 5 is an explanatory diagram of the configuration of the area around the black ink nozzle group K and the yellow ink nozzle group C. FIG. 6 is a cross-sectional diagram of the area around the two nozzle groups.

In the vicinity of the nozzle groups, there are provided drive units 42, a case 43 for storing the drive units 42, and a channel unit 44 in which the case is mounted.

Each drive unit 42 is constituted by a piezo element group 422 made of a plurality of piezo elements 421, a fixing plate 423 onto which the piezo element group 422 is fixed, and a flexible cable 424 for supplying power to each piezo element 421. Each piezo element 421 is attached to the fixing plate 423 in a so-called cantilever fashion. The fixing plate 423 is a plate-shaped member that possesses sufficient rigidity to stop the reaction force from the piezo elements 421. The flexible cable 424 is a sheet-shaped circuit board that is flexible and that is electrically connected to the piezo elements 421 on a lateral face of the fixing end portion that is on the side opposite the fixing plate 423. Ahead controller HC, which is a control IC for controlling the driving of the piezo elements 421, for example, is mounted on the surface of the flexible cable 424. As shown in the drawings, a head controller HC is provided for each nozzle group, that is, for each color. The head controller HC will be described in greater detail later.

The case 43 has a rectangular block-shaped exterior shape that has storage spaces 431 each of which can store a drive unit 42. The channel unit 44 is joined to the forward end of the case 43. Each storage space 431 is large enough that the drive unit 42 just fits therein. An ink supply tube 433 for introducing ink from an ink cartridge to the channel unit 44 is also formed in the case 43.

The channel unit 44 has a channel forming substrate 45, a nozzle plate 46, and an elastic plate 47, which are stacked on one another and form a single unit in such a manner that the channel forming substrate 45 is sandwiched by the nozzle plate 46 and the elastic plate 47. The nozzle plate 46 is a thin stainless steel plate on which nozzle rows such as those shown in FIG. 4 are formed.

A plurality of pressure chambers 451 and spaces that become ink supply openings 452 are formed, each corresponding to a nozzle, in the channel forming substrate 45. A reservoir 453 is a liquid storage compartment for supplying the ink stored in the ink cartridge to each pressure chamber 451, and it is in communication with the other end of the corresponding pressure chamber 451 via the ink supply port 452. The ink from the ink cartridge is introduced to the reservoir 453 through an ink supply tube 433. The elastic plate 47 is provided with a diaphragm section 471. The elastic plate 47 is also provided with a compliance section 472 that seals one of the open surfaces of the empty space that becomes the reservoir 453. With the elastic plate 47, a support plate is etched away to leave island portions 473. The forward end of the free end portion of the piezo elements 421 is adhered to these island portions 473.

The drive unit 42 is inserted to the storage space 431 with the free end portion of the piezo elements 421 facing the channel unit 44, and the front end surface of the free end portions are adhered to the corresponding island section 473. The rear surface of the fixing plate, which is on the side opposite the piezo element group binding surface, is adhered to the interior wall surface of the case 43, which defines the storage spaces 431. When, in this accommodated state, a drive signal is supplied to a piezo element 421 via the flexible cable 424, the piezo element 421 expands and contracts, increasing and decreasing the volume of its pressure chamber 451. This change in the volume of the pressure chamber 451 alters the pressure of the ink in the pressure chamber 451. In this way, the change in ink pressure can be utilized to cause an ink droplet to be ejected from the nozzle.

To facilitate understanding of the embodiments, first the embodiments are explained with the help of reference examples, and then the embodiments will be described.

First Reference Example (4 Gradation Printing)

Regarding the Drive Signal COM

Figure 7:
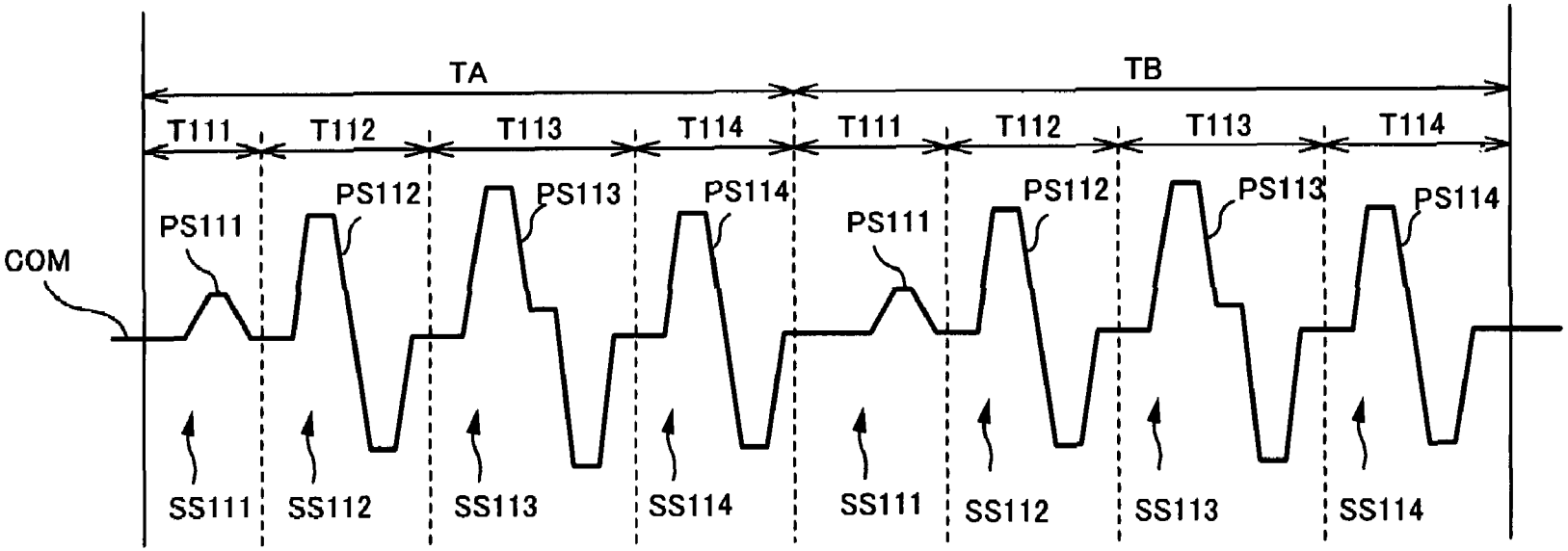
FIG. 7 is an explanatory diagram of the drive signal COM in the first reference example.

FIG. 7 is an explanatory diagram of the drive signal COM in the first reference example.

The drive signal COM is repeatedly generated each repeating period T. The repeating period T is time required for the carriage CR to move a predetermined distance. The drawing shows two consecutive repeating periods T (TA and TB). The drive signal has the same waveform in the early repeating period TA and in the latter repeating period TB. Thus, each time that the carriage CR moves a predetermined distance, a drive signal with a fixed waveform is repeatedly generated by the drive signal generation circuit 70.

Each repeating period T can be divided into four intervals T111 to T114. A first interval signal SS111 that includes a drive pulse PS111 is generated in the first interval T111, a second interval signal SS112 that includes a drive pulse PS112 is generated in the second interval T112, a third interval signal SS113 that includes a drive pulse PS113 is generated in the third interval T113, and a fourth interval signal SS114 that includes a drive pulse PS114 is generated in the fourth interval T114. It should be noted that the waveforms of the drive pulses PS111 to PS114 are determined based on the operation that the piezo element 421 is to perform.

The drive signal COM that is generated in the drive signal generation circuit 70 is input to the head controller HC along with other signals via the cable.

Head Controller HC

Figure 8:
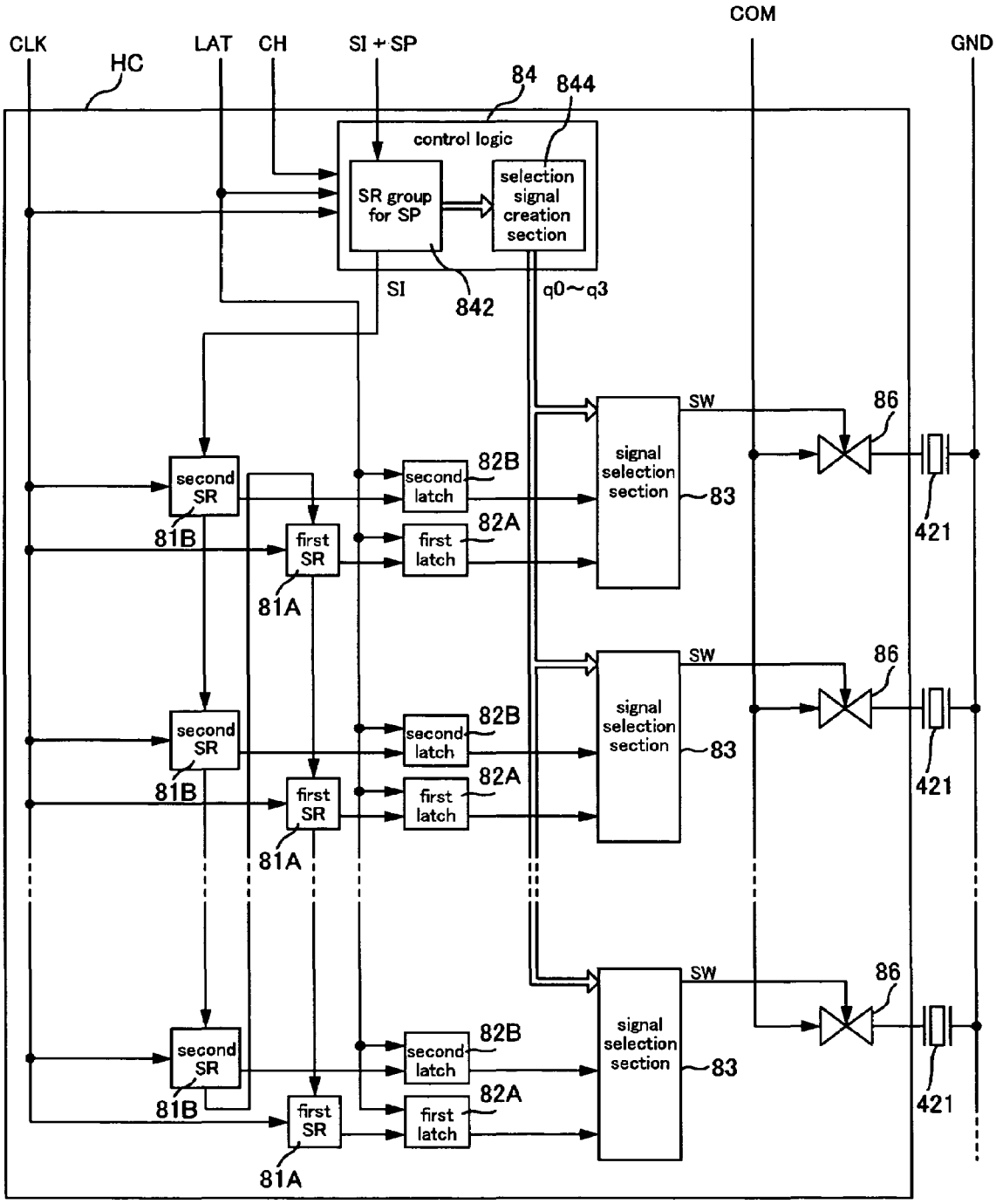
FIG. 8 is a block diagram of the head controller HC of the first reference example.

FIG. 8 is a block diagram of the head controller HC of the first reference example.

The head controller HC is provided with a first shift register 81A, a second shift register 81B, a first latch circuit 82A, a second latch circuit 82B, a signal selection section 83, a control logic 84, and a switch 86. Each one of the sections aside from the control logic 84 (that is, the first shift register 81A, the second shift register 81B, the first latch circuit 82A, the second latch circuit 82B, the signal selection section 83, and the switch 86) is provided for each piezo element 421. The control logic 84 has a shift register group 842 for storing setting data SP, and a selection signal creation section 844 that creates selection signals q0 to q3 based on the selection data SP.

A clock CLK, a latch signal LAT, a change signal CH, and a drive signal COM are input from the printer-side controller 60 to the head controller HC via the cable. A transfer signal TR that includes transfer data TRD configured from pixel data SI and setting data SP also is input to the head controller HC from the printer-side controller 60 via the cable.

Figure 9:
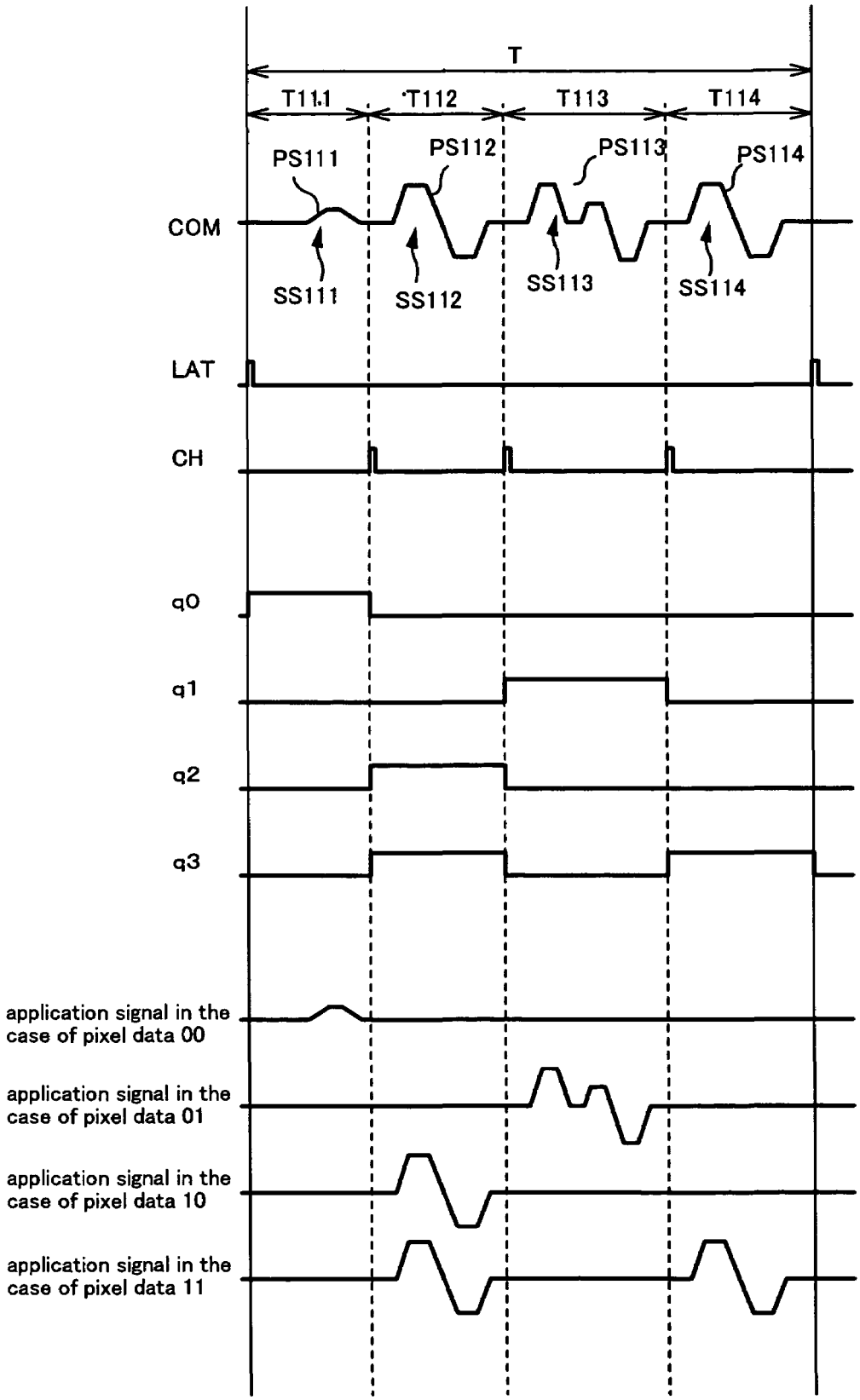
FIG. 9 is an explanatory diagram of the various signals of the first reference example.
Figure 10A:
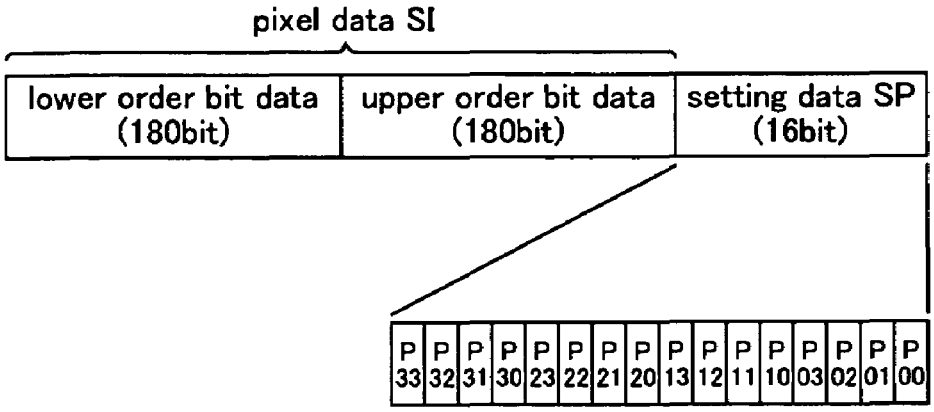
FIG. 10A is an explanatory diagram of transfer data TRD.
Figure 10B:
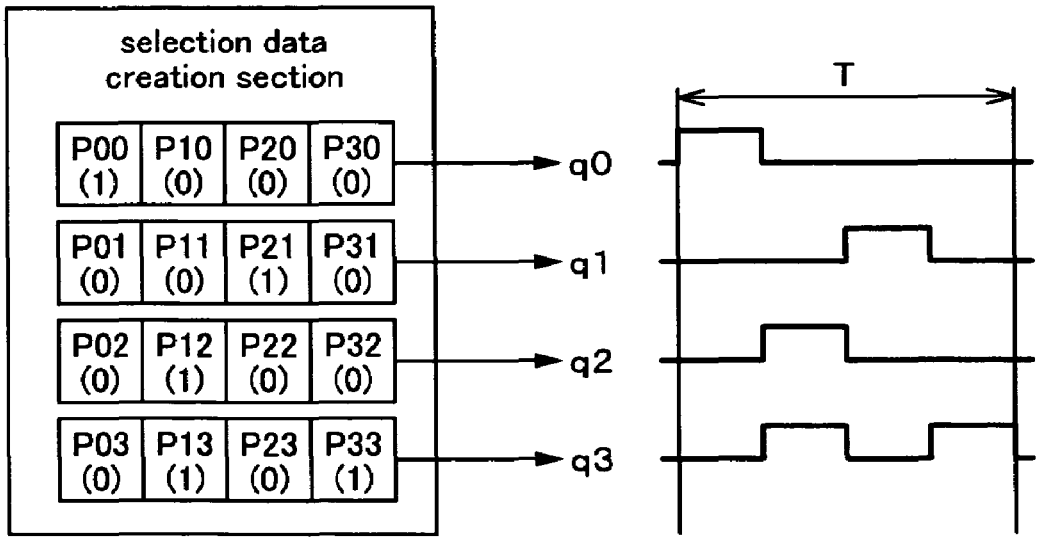
FIG. 10B is an explanatory diagram of the function of the selection signal creation section 844.

FIG. 9 is an explanatory diagram of the various signals of the first reference example. FIG. 10A is an explanatory diagram of the transfer data TRD. FIG. 10B is an explanatory diagram of the function of the selection signal creation section 844.

When the transfer signal TR is input to the head controller HC in synchronization with the clock CLK, the lower order bit data in the transfer data TRD included in the transfer signal are set to the first shift registers 81A, the upper order bit data are set to the second shift registers 81B, and the setting data SP are set to the shift register group 842 of the control logic 84. It should be noted that the lower order bit of the two bits of pixel data corresponding to the nozzle is set to the first shift registers 81A, and the upper order bit of the two bits of pixel data is set to the second shift registers 81B.

In correspondence with the pulse of the latch signal LAT, the lower order bit data are latched in the first latch circuits 82A, the upper order bit data are latched in the second latch circuits 82B, and the setting data SP are latched in the selection signal creation section 844. It should be noted that the lower order bit of the two bits of pixel data that correspond to the nozzle is latched by the first latch circuit 82A, and the upper order bit of the two bits of pixel data is latched by the second latch circuit 82B.

The setting data SP of the first reference example is made of 16 bits of data (see FIG. 10A). The selection signal creation section 844 creates the selection signal q0 based on predetermined four bits of data (data P00, data P10, data P20, data P30) of the 16-bit setting data SP and the change signal CH. Likewise, the selection signal creation section 844 creates the selection signals q1 to q3 based on predetermined four bits of data in the 16-bit setting data SP and the change signal CH.

In the first example, of the 16-bit setting data SP, the data P00, the data P12, the data P13, the data P21, and the data P33 are 1, and the other data are 0. Thus, the four bits of data (data P00, data P10, data P20, and data P30) for the selection signal q0 are 1000. As a result, the selection signal q0 is H level in the first interval T111, and is L level in the second interval T112 through the fourth interval T114. The selection signals q1 to q3 become the signals that are shown in the drawing.

The signal selection section 83 selects one selection signal q0 to q3 according to the 2-bit pixel data that has been latched by the first latch circuit 82A and the second latch circuit 82B. The selection signal q0 is selected if the pixel data are 00 (the lower order bit is 0 and the upper order bit is 0), the selection signal q1 is selected if the pixel data are 01, the selection signal q2 is selected if the pixel data are 10, and the selection signal q3 is selected if the pixel data are 11. The selection signal that is selected is output from the signal selection section 83 as the switch signal SW.

The drive signal COM and the switch signal SW are input to the switch 86. When the switch signal is H level, the switch 86 becomes on and the drive signal COM is input to the piezo element 421. When the switch signal is L level, the switch 86 becomes off and the drive signal COM is not input to the piezo element 421.

When the pixel data are 00, the switch 86 is switched on or off by the selection signal q0, and the first interval signal SS111 of the drive signal COM is input to the piezo element 421 and the piezo element 421 is driven by the drive pulse PS111. When the piezo element 421 is driven according to the drive pulse PS111, the ink is subjected to a change in pressure to a degree that does not result in the ejection of ink, and the ink meniscus (the free surface of the ink that is exposed at the nozzle portion) is finely vibrated.

When the pixel data are 01, the switch 86 is switched on or off by the selection signal q1, and the third interval signal SS113 of the drive signal COM is input to the piezo element 421 and the piezo element 421 is driven by the drive pulse PS113. When the piezo element 421 is driven according to the drive pulse PS113, a small quantity of ink is ejected and forms a small dot on the paper.

When the pixel data are 10, the switch 86 is switched on or off by the selection signal q2, and the second interval signal SS112 of the drive signal COM is input to the piezo element 421 and the piezo element 421 is driven by the drive pulse PS112. When the piezo element 421 is driven according to the drive pulse PS112, a medium quantity of ink is ejected and forms a medium dot on the paper.

When the pixel data are 11, the switch 86 is switched on or off by the selection signal q3, and the second interval signal SS112 and the fourth interval signal SS114 of the drive signal COM are input to the piezo element 421 and the piezo element 421 is driven by the drive pulse PS112 and the drive pulse PS114. When the piezo element 421 is driven according to the drive pulse PS112 and the drive pulse PS114, a large dot is formed on the paper.

It should be noted that during the time that the piezo element 421 is being driven in the repeating period TA of FIG. 7, a transfer signal TR (a signal including a transfer data TRD configured from pixel data SI and setting data SP) for driving the piezo element 421 in the next repeating period TB is input to the head controller HC. That is to say, during the repeating period TA, it is necessary to set the lower order bit data, the upper order bit data, and the setting data for the next repeating period TB in the various shift registers.

Second Reference Example (Eight Gradation Printing)

In the first reference example above, four shades (no dot, small dot, medium dot, large dot) can be formed for each pixel on the paper. In contrast, in the second reference example described below, it is possible to eject ink droplets in amounts of 0 pl (minute vibration with no ejection of ink), 1.5 pl (picoliter), 3 pl, 4.5 pl, 7 pl, 8.5 pl, 10 pl, and 14 pl, to form eight shades for each pixel on the paper.

Regarding the Head Controller HC

Figure 11:
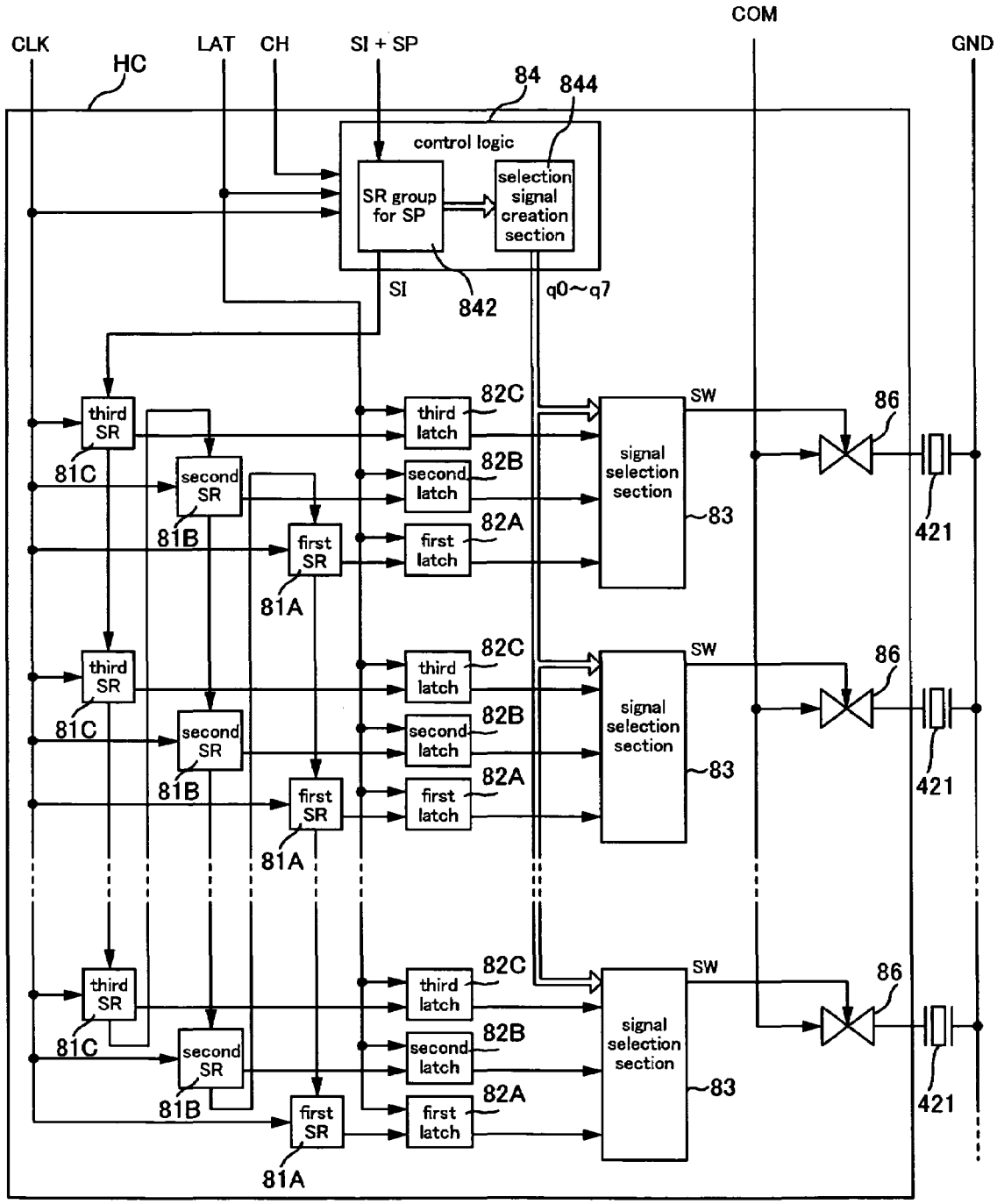
FIG. 11 is a block diagram of the head controller HC of the second reference example.

FIG. 11 is a block diagram of the head controller HC of the second reference example. Compared to that of the first reference example, the head controller HC of the second reference example is further provided with a third shift register 81C and a third latch circuit 82C. Also, the selection signal creation section 844 creates eight types of selection signals q0 to q7.

Figure 12:
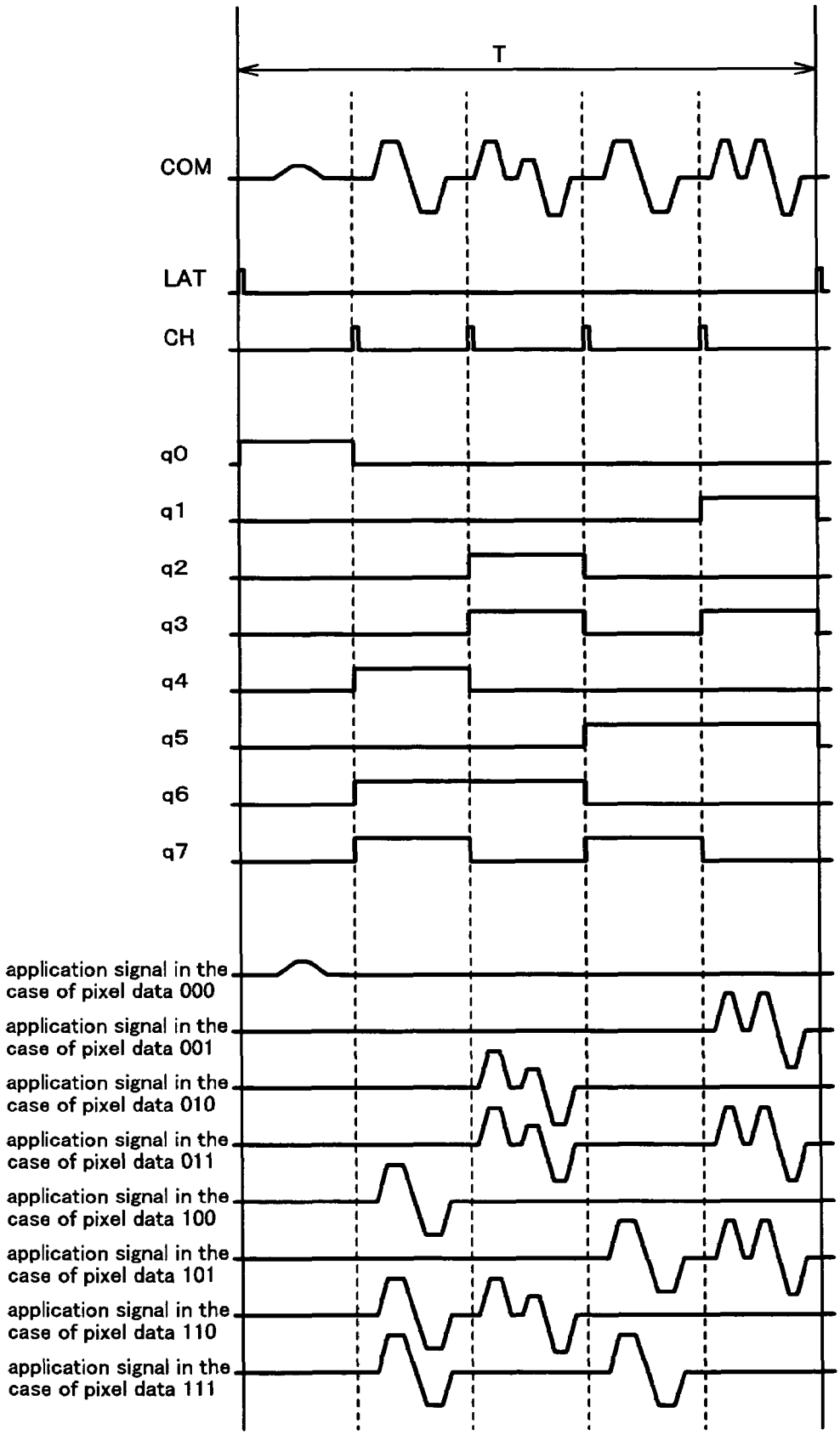
FIG. 12 is an explanatory diagram of the various signals of the second reference example.
Figure 13A:
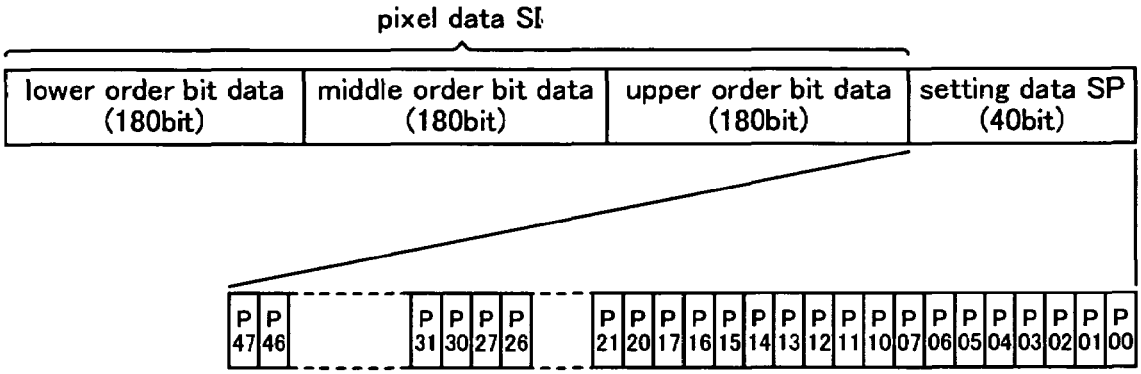
FIG. 13A is an explanatory diagram of the transfer data TRD.
Figure 13B:
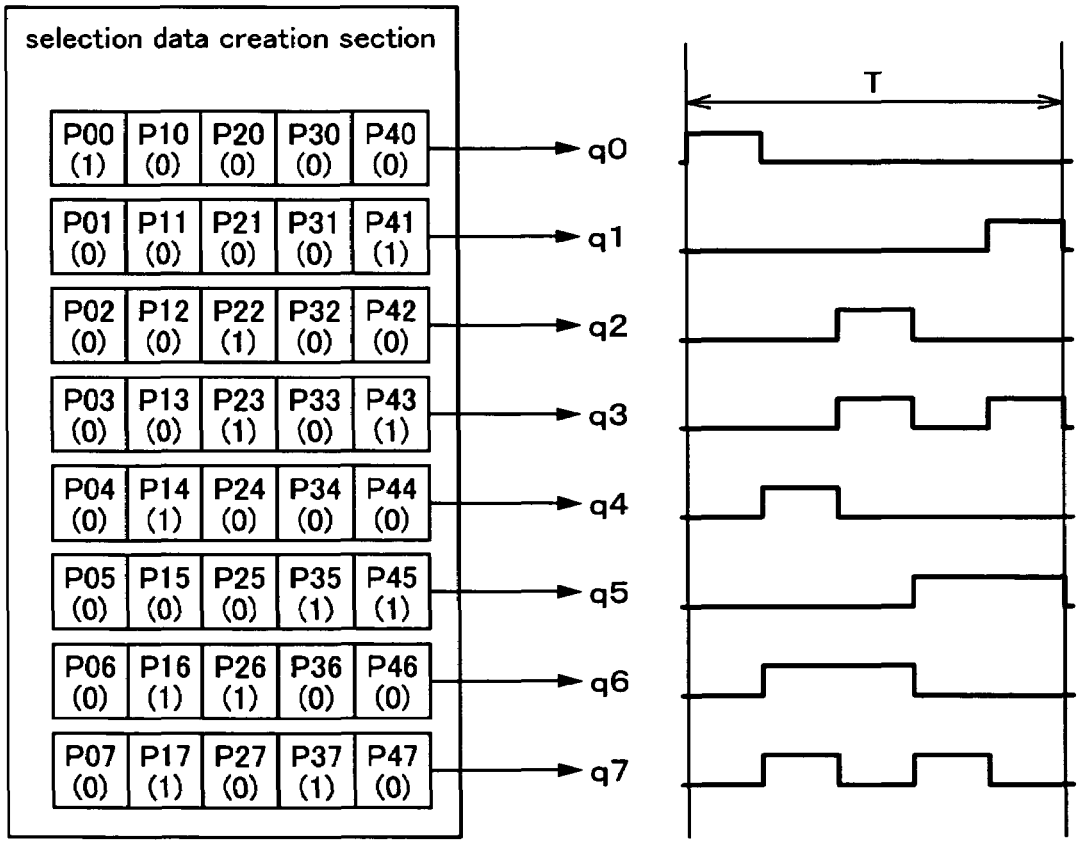
FIG. 13B is an explanatory diagram of the function of the selection signal creation section 844.

FIG. 12 is an explanatory diagram of the various signals of the second reference example. FIG. 13A is an explanatory diagram of the transfer data TRD. FIG. 13B is an explanatory diagram of the function of the selection signal creation section 844.

To express eight gradations in the second reference example, it is necessary to correspond three bits of pixel data with a single pixel (in the first example, two bits of pixel data are corresponded with a single pixel). For this reason, the pixel data SI are made of an upper order bit data, middle order bit data, and lower order bit data (see FIG. 13A).

Further, in the second reference example, the repeating period T is divided into five intervals (in the first reference example, the repeating period T is divided into four intervals). This is because to express eight gradations it is necessary to apply eight types of application signals to the piezo elements 421 (see FIG. 12), and thus it is necessary to increase the number of waveforms to be prepared for a repeating period T.

In the second reference example, the setting data SP are 40 bits of data (in the first reference example, the setting data was 16 bits). More specifically, in the second reference example, it is necessary for the selection signal creation section 844 to create eight types of selection signals q0 to q7 in order to create eight types of application signals from the drive signal COM, and it is necessary to determine whether each selection signal is L level or H level in the five intervals, and thus the setting data SP become a data amount of 8 (types)×5(intervals)=40 (bits).

Then, when the transfer signal TR is input to the head controller HC of the second reference example, the lower order bit data are set to the first shift registers 81A, the middle order bit data are set to the second shift registers 81B, and the upper order bit data are set to the third shift registers 81C, and the setting data SP are set to the shift register group 842 of the control logic 84. Then, in accordance with the pulse of the latch signal LAT, the lower order bit data are latched by the first latch circuits 82A, the middle order bit data are latched by the second latch circuits 82B, and the upper order bit data are latched by the third latch circuits 82C, and the setting data SP are latched by the selection signal creation section 844.

The selection signal creation section 844 creates the selection signals q0 to q7 based on predetermined four bits data of the 40 bits of setting data and the change signal CH. The signal selection section 83 selects one of the selection signals q0 to q7 according to the three bits of pixel data latched by the first latch circuit 82A through the third latch circuit 82C. The selection signal that has been selected is output from the signal selection section 83 as the switch signal SW.

Thus, the piezo elements 421 are driven according to 3-bit pixel data, and an ink droplet that corresponds to the 3-bit pixel data is ejected (or not ejected), forming a dot that corresponds to the 3-bit pixel data on the paper.

In the second example, there is an increase in the amount of data to be set in the shift registers for the next repeating period during a given repeating period T. Since the data are serially transferred, it takes time to set a larger amount of data. As a result, it is not possible to set a shorter repeating period T in the second reference example.

Mixed Printing of Two Gradation Types

Regarding Changing the Number of Gradations According to Printing Condition

Incidentally, there is a demand to change the number of gradations of each color according to the printing condition. For example, in the case of printing a photograph image of the sea or the blue sky, an image with blue as the primary color is to be printed, and thus it is preferable to print with the number of gradations of cyan and magenta as higher than that of the other colors (black and yellow). On the other hand, in the case of printing a photograph image of the sky at sunset, an image with red as the primary color is to be printed, and thus it is preferable to print with the number of gradations of yellow and magenta as higher than that of the other colors (black and cyan). Further, in the case of printing a photograph image in monochrome, it is preferable to print with the number of gradations of black as higher than that of the other colors (cyan, magenta, and yellow).

In the embodiment described below, the number of gradations of each color is changed according to the printing condition.

Regarding Different Number of Gradations According to Color

In the case of printing black and yellow with four gradations and printing yellow and magenta with eight gradations, by merely mixing four gradation printing and eight gradation printing, the following problem will arise.

Figure 14A:
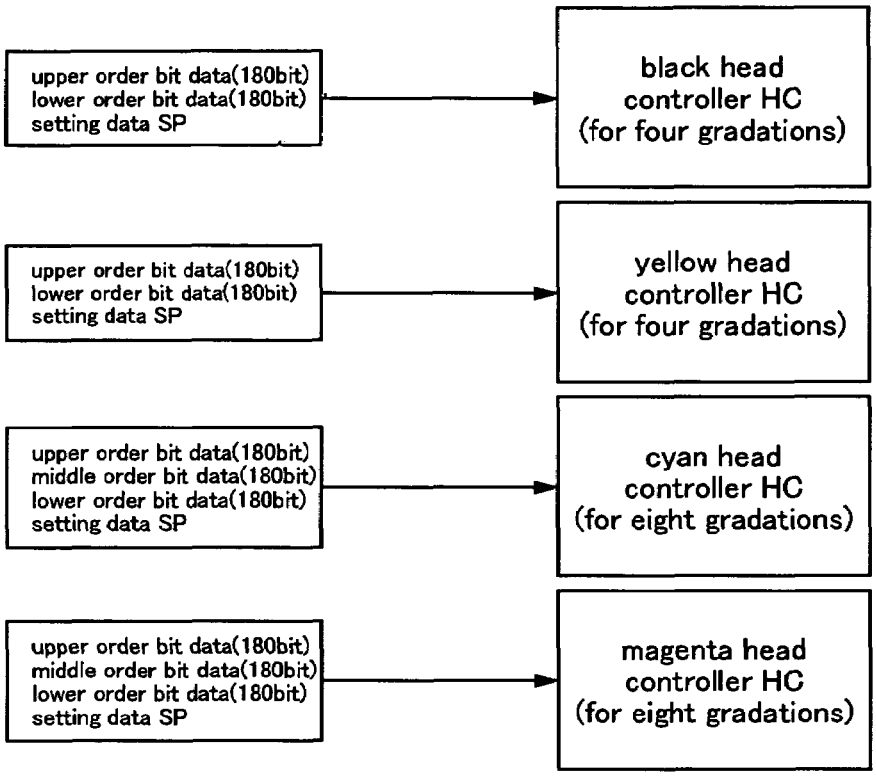
FIG. 14A is an explanatory diagram of a first comparative example.

FIG. 14A is an explanatory diagram of a first comparative example. In the first comparative example, the head controllers for black and yellow have the same configuration as the head controller HC of the first reference example (see FIG. 8), and the head controllers for cyan and magenta have the same configuration as the head controller HC of the second reference example (see FIG. 11).

To manufacture the head unit 40 of the first reference example, the number of gradations of black and yellow is fixed to four gradations, and thus there is the problem that the number of gradations cannot be made variable according to the printing condition.

Figure 14B:
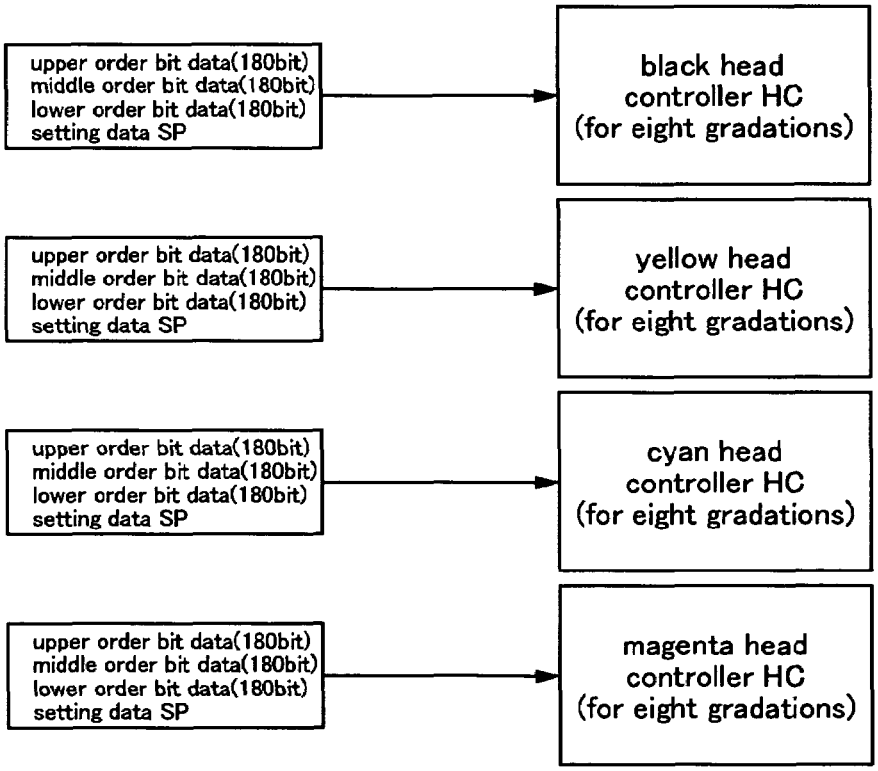
FIG. 14B is an explanatory diagram of a second comparative example.

FIG. 14B is an explanatory diagram of a second comparative example. In the second comparative example, the head controller for eight gradation printing of the second reference example (see FIG. 11) is used in common, and thus it is possible to make the number of gradations of black and yellow as eight gradations, and the number of gradations of cyan and magenta as four gradations.

However, since the head controller of the second reference example is simply used in common for each of the colors, it is necessary to send data for eight gradation printing also to head controllers that perform only four gradation printing, and thus there is the problem of an increased amount of data to be set and the fact that it takes time to set the data.

Figure 15:
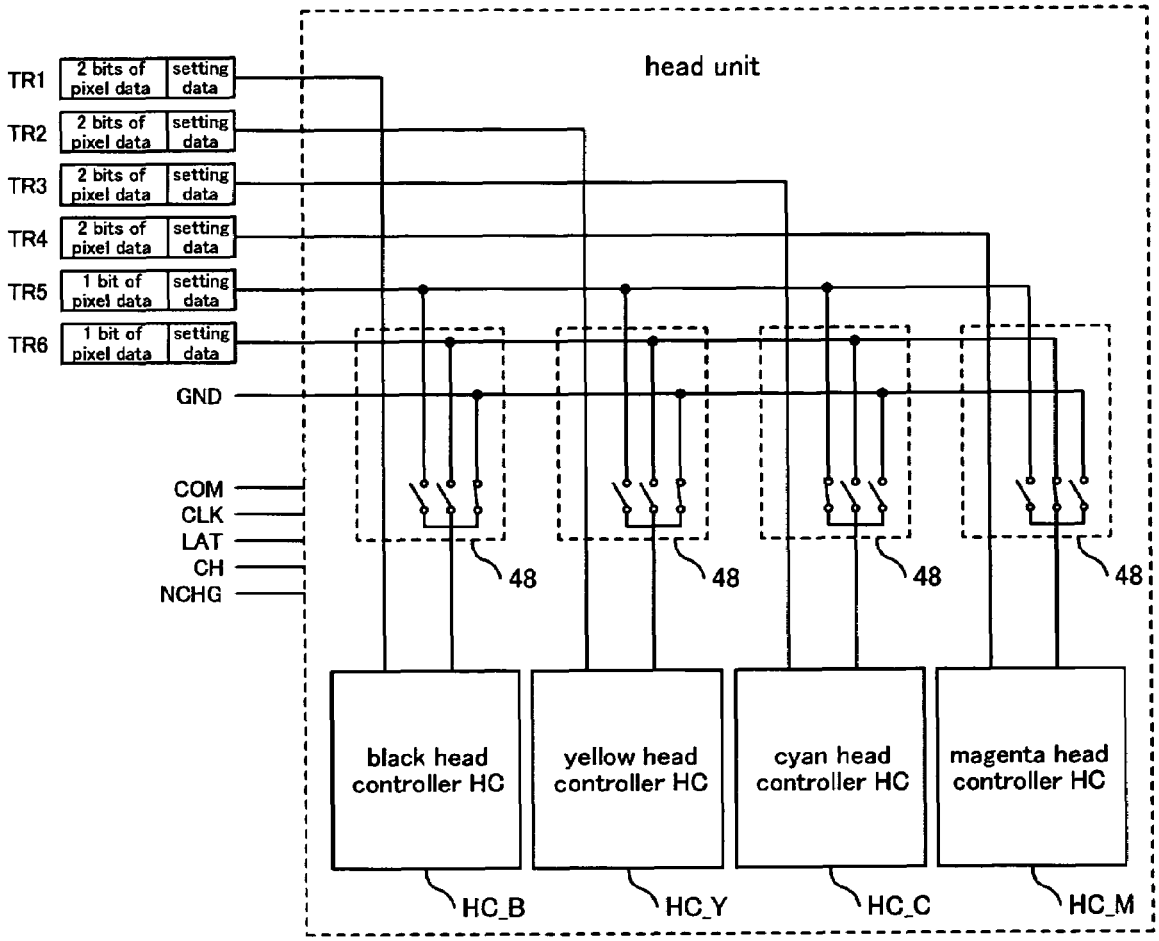
FIG. 15 is an explanatory diagram of a head unit 40 of the embodiment.

FIG. 15 is an explanatory diagram outlining the head unit 40 of this embodiment. The head unit 40 is input with, via a cable from the printer side controller 60, a drive signal COM, a clock CLK, a latch signal LAT, a change signal CH, and other signals (for example, NCHG signal) for controlling the head controller. Further, the head unit 40 is input with, via a cable from the printer side controller 60, a first transfer signal TR1 to a sixth transfer signal TR6.

The head controllers of the embodiments have a common structure for each of the colors. Further, the head controller of this embodiment differs from that of the second reference example, and has two input sections for receiving the transfer signal TR.

A first input section of each of the head controllers receives a transfer signal TR including a pixel data for 2 bits and a first setting data SP1. For example, a first input section of a black head controller receives a first transfer signal TR1, and a first input section of a cyan head controller receives a third transfer signal TR3.

On the other hand, a second input section of each of the head controllers receives a transfer signal TR for setting the one bit pixel data and a second setting data SP2, and the GND. For example, the GND is input to a second input section of the black head controller, and the fifth transfer signal is input to the second input section of the cyan head controller. In order to carry out the above process, each head controller is provided with a switching circuit 48.

The head controller that is input with the transfer signals in the two input sections then drives the piezo elements 421 based on the three bits of pixel data, the first setting data SP1, and the second setting data SP2, forming eight shades per pixel on the paper. On the other hand, the head controller that is input with the transfer signal in only one input section, drives the piezo elements 421 based on the two bits of pixel data and the first setting data SP1, forming four shades per pixel on the paper.

First Embodiment

Regarding Processes of the Printer Driver

Figure 16:
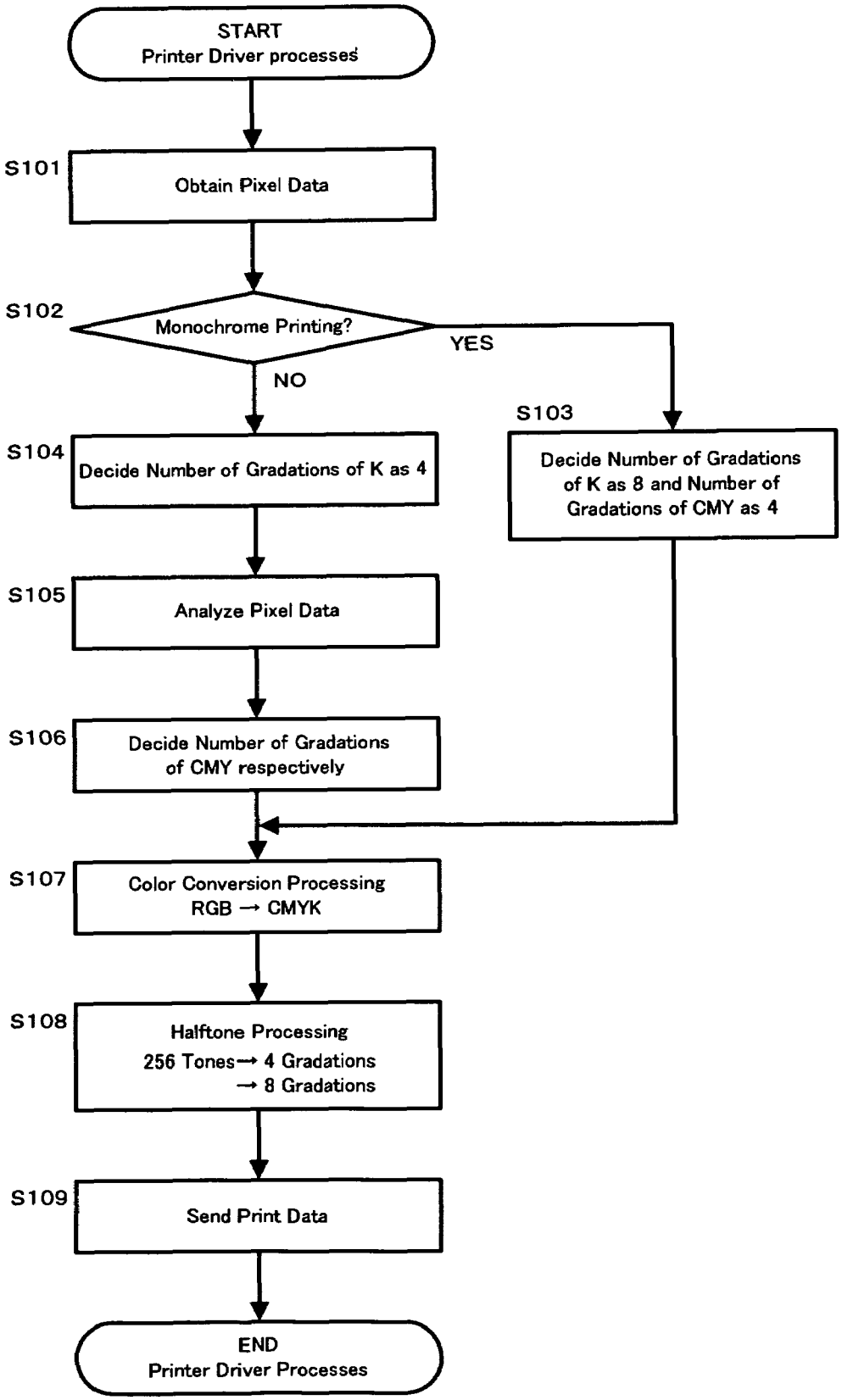
FIG. 16 is a flow chart of processes of a printer driver of this embodiment.

FIG. 16 is a flow chart of processes of a printer driver of this embodiment. A computer 110 that has installed the printer driver conducts each process, based on a program code of the printer driver.

First, when there is a print instruction from a user, the printer driver obtains data of an image to be printed (image data) (S101).

Next, the printer driver decides whether or not to perform monochrome printing (whether or not to perform color printing) (S102). The user sets a print mode of the printer driver at the time of printing, so that the printer driver decides whether or not to perform monochrome printing according to the content that has been set.

When it has been decided to perform monochrome printing (YES in S102), the printer driver determines the number of gradations of black to be 8, and the number of gradations of cyan, magenta, and yellow to be 4 (S103).

On the other hand, when it has been decided to perform color printing (NO in S102), the printer driver determines the number of gradations of black to be 4 (S104). Then, the number of gradations of any of the two colors of cyan, magenta, and yellow are determined to be 8, and the number of gradations of the remaining color is determined to be 4. Whether any of the colors will be decided to be eight gradations, will be determined based on the image data to be printed (S105 and S106).

The printer driver analyzes the image data to be color printed, and decides the primary color (S105). Specifically, the printer driver extracts an R component, a G component, and a B component of the image data. Next, the printer driver obtains an average value of the gradation values of all pixels of the image data of R components, and similarly obtains the average value of the number of gradations of all pixels of the image data of G components and B components, respectively. Then, the printer driver compares the three average values, and decides that the component with the largest value is the primary color.

Note that, the content of the analysis of the image data in S105 is not limited to contents based on the average value of the gradation values of all pixels of each RGB component. For example, the printer driver can work out a histogram of each RGB component of the image data, and can decide the primary color in the image data, according to a distribution state of the histogram.

Then, the printer driver decides the number of gradations of each color of cyan, magenta, and yellow, according to the analysis result (S106). For example, when it is analyzed that the B component is the primary color in S105, the printer driver determines that the number of gradations of cyan and magenta that are associated with blue is 8, and decides that the number of gradations of yellow is 4. Further, when it has been analyzed that the R component is the primary color in S105, the printer driver decides the number of gradations of magenta and yellow as 8, and decides the number of gradations of cyan as 4.

When the number of gradations of each color has been determined in S103 and S106, the printer driver performs a color conversion of an image data of the RGB components to an image data of CMYK components (S107). Note that in the color conversion process, the number of gradations showing the pixel data that configures each image data before and after the conversion, are 256 gradations respectively, and are not changed.

Then, the printer driver performs a halftone process, in respect to an image data of 256 gradations (S108). For example, in the case of monochrome printing, an image data of K component of 256 gradations is converted to an image data of K component of eight gradations, and an image data of CMY components of 256 gradations is converted to an image data of CMY components of four gradations. Further, when it is decided that blue is the primary color in the case of color printing, an image data of CM components of 256 gradations is converted to an image data of CM components of eight gradations, and an image data of YK components of 256 gradations is converted to an image data of YK components of four gradations.

In other words, the printer driver converts an image data configured by a pixel data of 8 bits into an image data configured by a pixel data of 3 bits or 2 bits. For example, in the case of monochrome printing, a pixel data of K components of 8 bits is converted to a pixel data of 3 bits of K components, and the pixel data of CMY components of 8 bits is converted to a pixel data of CMY components of 2 bits.

The pixel data after the halftone process, is data showing the gradations of shades of corresponding pixels, and is data of a dot to be formed at a position on a paper, that corresponds to the pixel. Then, the printer driver appropriately arranges the pixel data configuring the image data after the halftone process, generates print data by adding command data, and sends the print data to the printer (S109). Note that, the command data in the print data includes data showing the number of gradations of each color.

Regarding the Processes of the Printer

Figure 17:
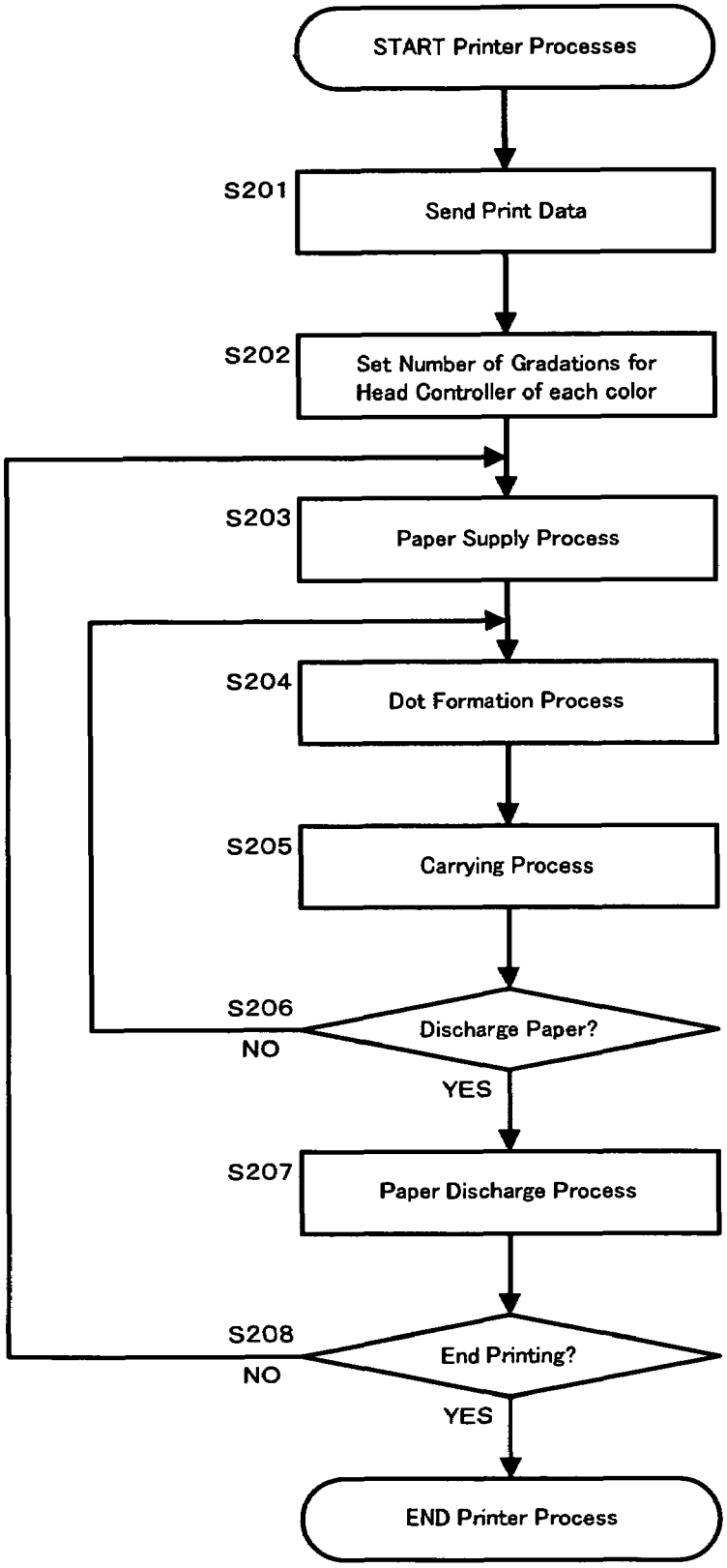
FIG. 17 is a flow chart of processes of the printer of this embodiment.

FIG. 17 is a flow chart of the processes of the printer of this embodiment. The printer side controller 60 controls each of the control subject portions based on the program stored in the memory 63, and performs each process.

The printer side controller 60 receives print data from the computer 110 (S201). Then, the printer side controller 60 analyzes the contents of the various commands included in the print data, and using each unit performs the following processes.

First the printer side controller 60 performs setting of gradations of a head controller of each color. The gradation setting is performed based on data showing the number of gradations of each color included in a command data. Note that, details of the gradation setting are described later.

Next, the printer side controller 60 supplies a paper to be printed into the printer, and positions the paper at a print start position (also referred to as indexing position) (S203). When the paper is positioned in the print start position, at least some of the nozzles of the head 41 are opposed to the paper.

Then, the printer side controller 60 alternately repeats a dot forming process and a carrying process (S204 to S206). The dot forming process is a process in which a head that moves along a movement direction is made to eject ink intermittently, to form a dot on the paper. The carrying process is a process to move the paper relatively with respect to the head along a carrying direction.

The printer side controller 60 performs a decision of discharge of the paper that is being printed (S206). If there remains data to be printed on the paper that is being printed, the paper is not discharged, and until there is no more data to be printed, the dot forming process and the carrying process are alternately repeated, and an image to be configured by dots is gradually printed onto the paper. When there is no more data to be printed on the paper that is being printed, the printer side controller 60 discharges the paper (S207). Note that, the decision of whether or not to perform discharge of the paper can be based on paper discharge command that is included in the print data.

Next, the printer side controller 60 performs a decision of whether or not to continue printing (S208). If printing is to be performed on the next paper, printing is continued, and a paper supply process of the next paper is started. If printing is not to be performed on the next paper, then the printing process is ended.

Regarding Setting of Number of Gradations (S202)

In the above-described setting of the number of gradations (S202), the printer side controller 60 performs setting according to the number of the gradations of each color, in respect to each switching circuit 48 (refer to FIG. 15).

Figure 18:
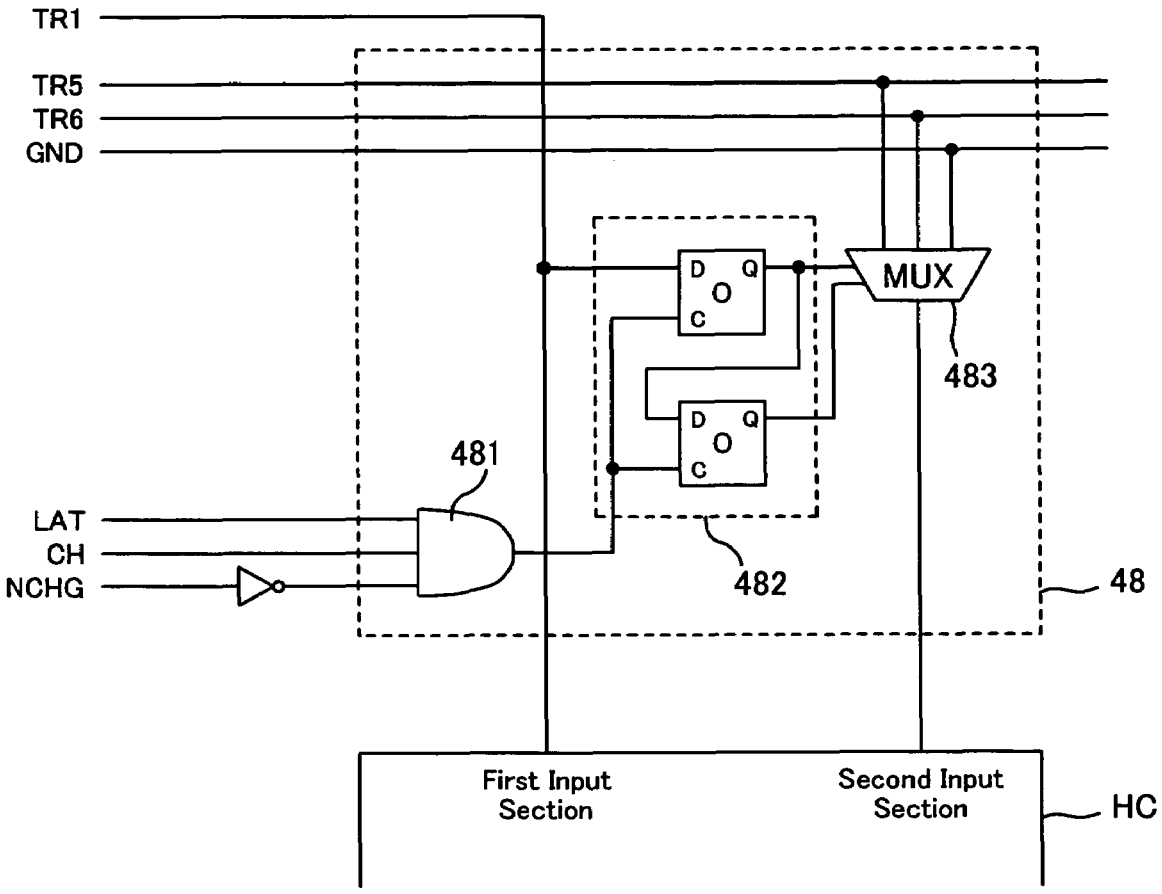
FIG. 18 is an explanatory diagram of a switching circuit 48.

FIG. 18 is an explanatory diagram of a switching circuit 48 provided to a black head controller HC. Here, the black switching circuit 48 is described, and switching circuits 48 for the other colors are substantially the same structure, except that the first transfer signal TR1 in the figure is different for each color.

The switching circuit 48 has an AND circuit 481, a control data storage section 482 having two flip-flops, and a multiplexer 483. The AND circuit 481 is input with a latch signal LAT, a change signal, and a signal for controlling other head controllers (for example, an NCHG signal). An output of the AND circuit 481 is input to C terminals of the two flip-flops of the control data storage section 482. The D terminals of the two flip-flops of the control data storage section 482 are connected to a line for transferring a first transfer signal TR1. Then, the control data storage section 482 can store data of 2 bits, and the 2 bit data can be output as a control signal to the multiplexer 483. The multiplexer 483 is input with a fifth transfer signal TR5, a sixth transfer signal TR6, and the GND. The multiplexer 483 outputs a signal selected according to a control signal of 2 bits from the control data storage section 482, to a second input section of the head controller HC. The multiplexer 483 selects the GND according to a control signal of [00], selects the fifth transfer signal TR5 according to a control signal [01], and selects the sixth transfer signal TR6 according to a selection signal [10].

At the time of the above described setting of the number of gradations (S202), the printer side controller 60 outputs a signal to each line to transmit a LAT signal, a change signal CH, and a NCHG signal, so that two clock signals are output from the AND circuit 481. Note that, it is configured so that other than at the time of the setting of the number of gradations, the output of the AND circuit 481 does not become H level. For example, at the time of the dot forming process, the output of the AND circuit 481 does not become H level.

In synchronization with a timing at which the two clock signals are output from the AND circuit 481, the printer side controller 60 outputs a 2 bit signal, to a line for transferring a first transfer signal TR1, based on data showing a number of gradations of each color included in the command data of the print data. Thus, in the control data storage section 482, a 2 bit signal according to a number of gradations of black is stored. As a result, a 2 bit control signal according to a number of gradations of black is input to the multiplexer 483, and any signal of the fifth transfer signal TR5, the sixth transfer signal, and the GND is output to the second input section of the head controller HC according to the control signal.

FIGS. 19A to 19C are explanatory diagrams of a relationship between control data stored in the control data storage section 482, and signals to be input to the head controllers. FIG. 19A is an explanatory diagram of when blue is decided as the primary color in the case of color printing. FIG. 19B is an explanatory diagram of when red is decided as the primary color in the case of color printing. FIG. 19C is an explanatory diagram in the case of monochrome printing.

Hereinbelow, when blue is decided as the primary color in the case of color printing is described.

A black control data storage section 482 is stored with control data of [00], at the time of setting the number of gradations described above (S202), based on data showing the number of gradations of each color in the command data. Thus, the black switching circuit 48 selects the GND, and inputs the GND in the second input section of the black head controller HC. Note that, the first input section of the black head controller HC is input with the first transfer signal TR1. In the case of yellow, as similar to the case of black, the switching circuit 48 inputs the GND to the second input section. However, in the case of yellow, the first input section is input with the second transfer signal TR2.

A cyan control data storage section 482 is stored with control data of [01], at the time of setting the number of gradations described above (S202), based on data showing the number of gradations of each color in the command data. Thus, the cyan transfer circuit 48 selects the fifth transfer signal TR5, and inputs the fifth transfer signal TR5 in the second input section of the cyan head controller HC. Note that, the first input section of the cyan head controller HC is input with the third transfer signal TR3.

A magenta control data storage section 482 is stored with control data of [10], at the time of setting the number of gradations described above (S202), based on data showing the number of gradations of each color in the command data. Thus, the magenta switching circuit 48 selects the sixth transfer signal TR6, and inputs the sixth transfer signal TR6 in the second input section of the magenta head controller HC. Note that, the first input section of the magenta head controller HC is input with the fourth transfer signal TR4.

Hereinbelow, when blue is decided to be the primary color in the case of color printing, that is, in the case where cyan and magenta are printed in eight gradations and black and yellow are printed in four gradations, is described.

Regarding the Dot Forming Process (S204)

In the above described dot forming process (S204), the printer side controller 60 makes the head that moves along a movement direction eject ink intermittently, and forms dots on the paper. The intermittent ejection of ink is realized by the head ejecting ink every time the head moves a predetermined distance.

Figure 20:
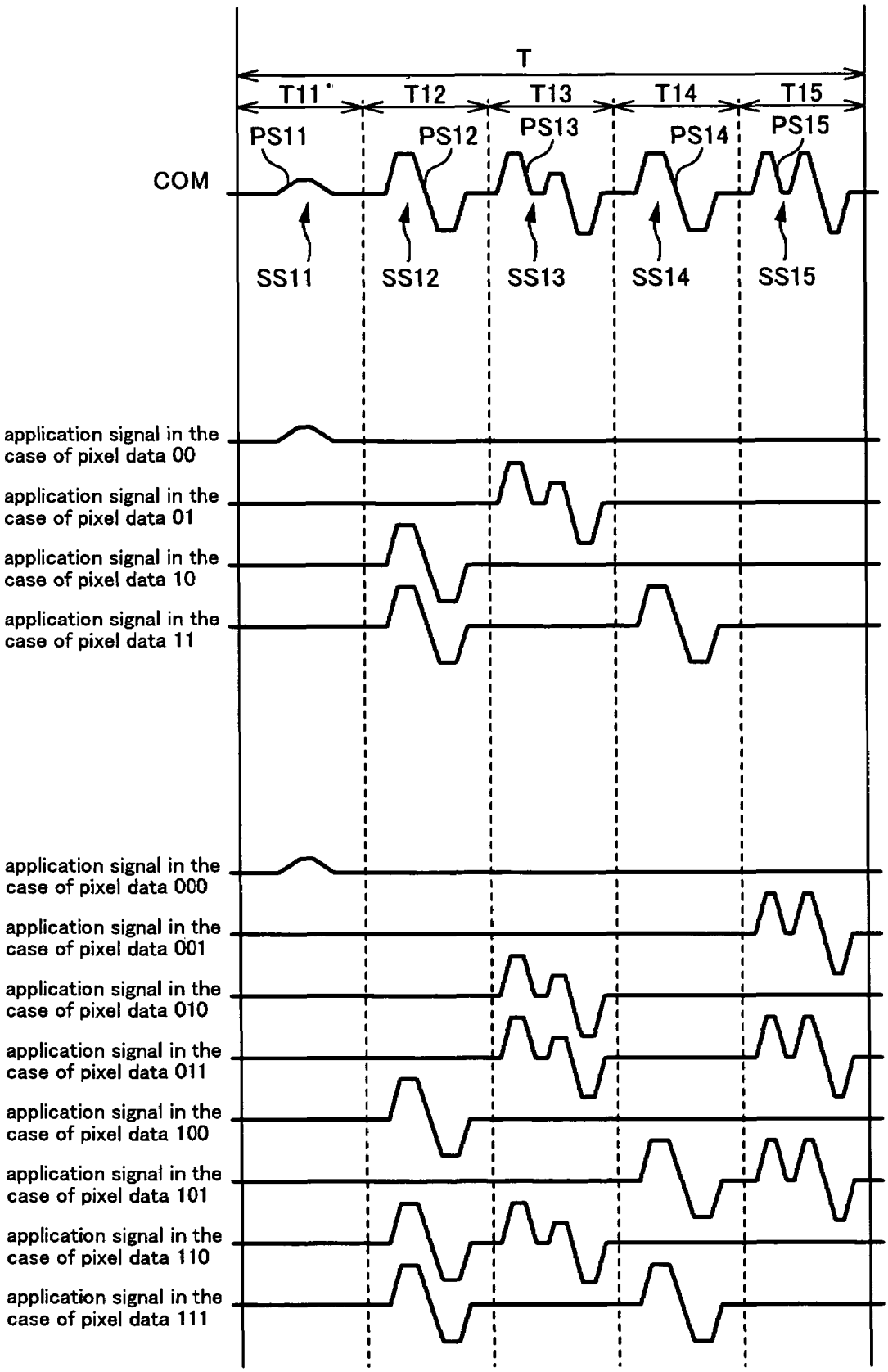
FIG. 20 is an explanatory diagram of the drive signal COM and the application signals that are applied to the piezo elements 421 of the first embodiment.

FIG. 20 is an explanatory diagram of the drive signal COM and the application signals that are applied to the piezo elements 421 in the first embodiment. FIG. 21A is a table for explaining the relationship between the pixel data and the ink droplet size at the time of four gradation printing. FIG. 21B is a table for explaining the relationship between the pixel data and the ink droplet size at the time of eight gradation printing.

The drive signal COM is repeatedly generated for each repeating period T. The repeating period T is time that is required for the carriage CR to move a predetermined distance. Each repeating period T can be divided into five intervals T11 to T15. A first interval signal SS11 that includes a drive pulse PS11 is created in the first interval T11, a second interval signal SS12 that includes a drive pulse PS12 is created in the second interval T12, a third interval signal SS13 that includes a drive pulse PS13 is created in the third interval T13, a fourth interval signal SS14 that includes a drive pulse PS14 is created in the fourth interval T14, and a fifth interval signal SS15 that includes a drive pulse PS15 is created in the fifth interval T15.

The waveforms of the drive pulses are determined based on the operation that the piezo element 421 is to perform. The waveform of the drive pulse PS11 is determined so that it causes the piezo element 421 to vibrate finely. The drive pulse PS12 and the drive pulse PS14 are determined so that they drive the piezo element 421 so as to eject a 7 pl (picoliter) ink droplet from the nozzle. The drive pulse PS13 is determined so that it drives the piezo element 421 so as to eject a 3 pl ink droplet from the nozzle. The drive pulse PS15 is determined so that it drives the piezo element 421 so as to eject a 1.5 pl ink droplet from the nozzle.

The pixel data of colors for which four gradation printing is performed are 2 bits of data per pixel. If the pixel data are 00, then the piezo element 421 is driven according to the drive pulse PS11 and the ink meniscus is finely vibrated. If the pixel data are 01, then the piezo element 421 is driven according to the drive pulse PS13 and a 3 pl ink droplet is ejected from the nozzle, forming a small dot. If the pixel data are 10, then the piezo element 421 is driven according to the drive pulse PS12 and a 7 pl ink droplet is ejected from the nozzle, forming a medium dot. If the pixel data are 11, then the piezo element 421 is driven according to the drive pulse PS12 and the drive pulse PS14 and a 14 pl ink droplet is ejected from the nozzle, forming a large dot.

The pixel data of colors for which eight gradation printing is performed are three bits of data per pixel. If the pixel data are 000, then the piezo element 421 is driven according to the drive pulse PS11 and the ink meniscus is finely vibrated. If the pixel data are 001 (the pixel data before decoding; described later), then the piezo element 421 is driven according to the drive pulse PS15 and a 1.5 pl ink droplet is ejected from the nozzle (forming a dot that corresponds to this ink amount). If the pixel data are 010, then the piezo element 421 is driven according to the drive pulse PS13 and a 3 pl ink droplet is ejected from the nozzle. If the pixel data are 011, then the piezo element 421 is driven according to the drive pulse PS3 and the drive pulse PS5, and a 4.5 pl ink droplet is ejected from the nozzle. If the pixel data are 100, then the piezo element 421 is driven according to the drive pulse PS2, and a 7 pl ink droplet is ejected from the nozzle. If the pixel data are 101, then the piezo element 421 is driven according to the drive pulse PS14 and the drive pulse PS15, and a 8.5 pl ink droplet is ejected from the nozzle. If the pixel data are 110, then the piezo element 421 is driven according to the drive pulse PS12 and the drive pulse PS13, and a 10 pl ink droplet is ejected from the nozzle. If the pixel data are 111, then the piezo element 421 is driven according to the drive pulse PS12 and the drive pulse PS14, and a 14 pl ink droplet is ejected from the nozzle.

Below, how the piezo elements 421 are driven in the above manner based on the pixel data included in the print data sent from the computer is explained.

Regarding the Decoding of the Pixel Data

The signal that is applied to a piezo element 421 when the pixel data are 00 in four gradation printing is the same as the signal that is applied to a piezo element 421 when the pixel data are 000 in eight gradation printing. Similarly, the pixel data 01 in four gradation printing and the pixel data 010 in eight gradation printing, the pixel data 10 in four gradation printing and the pixel data 100 in eight gradation printing, and the pixel data 11 in four gradation printing and the pixel data 111 in eight gradation printing, each share common signals that are applied to the piezo element 421.

Accordingly, in the first embodiment, decoding is performed so that the 3-bit pixel data for eight gradation printing, which shares an application signal with that for four gradation printing, matches the lower two digits of the pixel data for four gradation printing. Also, decoding is performed so that the upper order bit of 3-bit pixel data for eight gradation printing, which shares an application signal with that for four gradation printing, becomes 0.

FIG. 22 is an explanatory diagram regarding the decoding of the pixel data for eight gradation printing. The 3-bit pixel data of the pixel data that are included in the print data sent from the computer are decoded by a decoded prior to being input to the head controller HC of the embodiment, which is discussed later. The decoder is provided in the printer-side controller 60, but it is also possible for it to be provided on the head unit side.

For example, since the pixel data 01 for four gradation printing and the pixel data 010 for eight gradation printing share the signal that is applied to the piezo elements 421, the decoder decodes the pixel data 010 for eight gradation printing to the pixel data 001. Likewise, since the pixel data 10 for four gradation printing and the pixel data 100 for eight gradation printing share a signal that is applied to the piezo elements 421, the decoder decodes the pixel data 100 for eight gradation printing to 010. Likewise, since the pixel data 11 for four gradation printing and the pixel data 111 for eight gradation printing share a signal that is applied to the piezo elements 421, the decoder decodes the pixel data 111 for eight gradation printing to 011.

So that the values of the pixel data after decoding are not in duplicate, the decoder decodes the pixel data 001 to 100, decodes the pixel data 011 to 101, decodes the pixel data 101 to 110, and decodes the pixel data 110 to 111. It should be noted that the 3-bit pixel data for eight gradation printing that do not share an application signal with four gradation printing are decoded so that the upper order bit data becomes 1.

The values of the 3-bit pixel data before decoding are values in the shade order of the pixels on the paper. However, the result of the decoder decoding the 3-bit pixel data for eight gradation printing is that the values of the 3-bit pixel data after decoding are not in the shade order of the pixels on the paper.

By performing such decoding, the selection signals q0 to q3 at the time of eight gradation printing and the selection signals q0 to q3 at the time of four gradation printing can be made the same. As a result, it is possible to use common setting data for the selection signals q0 to q3 at the time of eight gradation printing and four gradation printing alike.

Regarding the Head Controller HC

Figure 23:
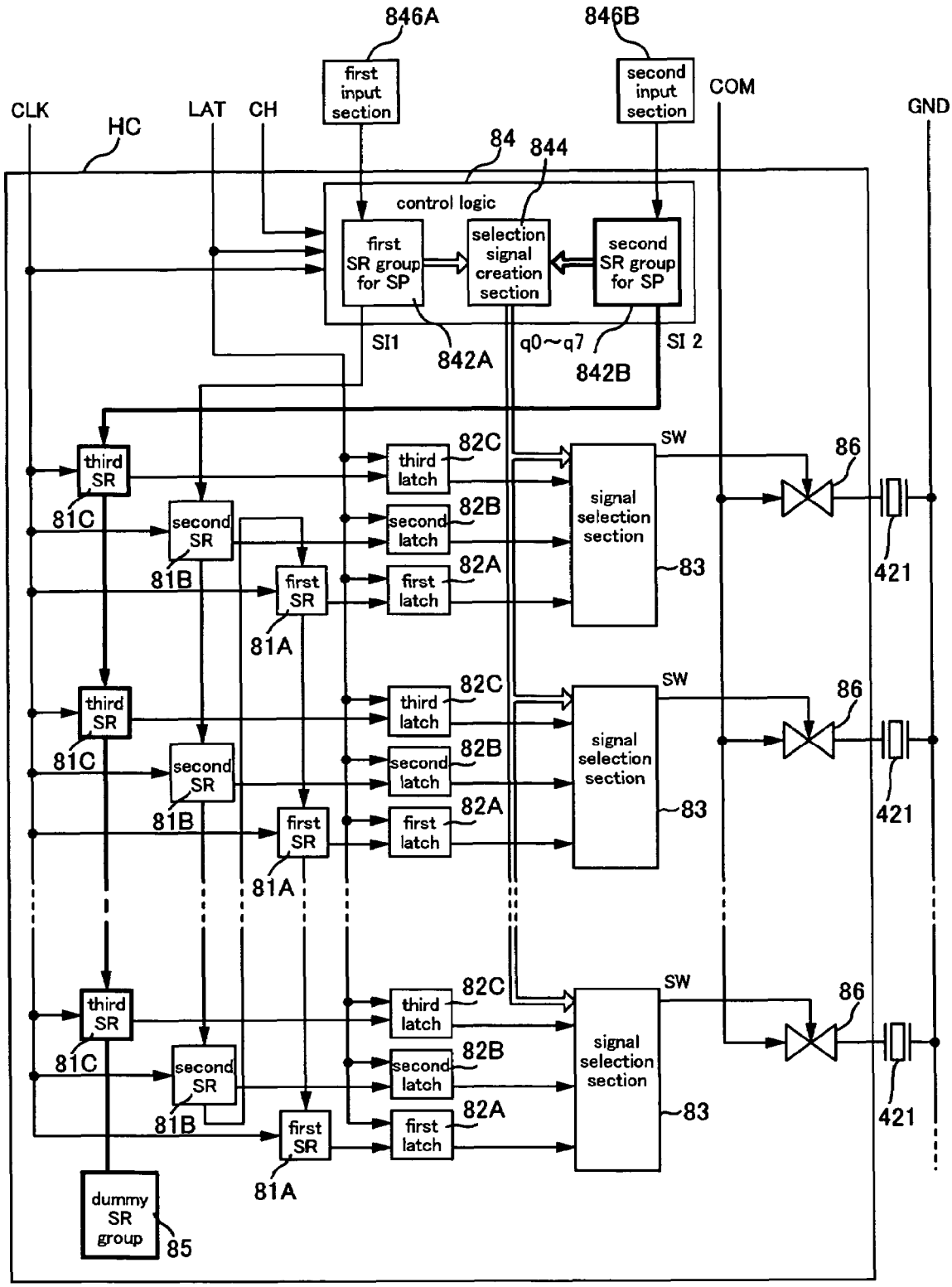
FIG. 23 is a block diagram of the head controller HC of the first embodiment.

FIG. 23 is a block diagram of the head controller HC of the first embodiment. Compared to the second reference example, the head controller HC of the first embodiment has two input sections for the transfer signals that are input to the control logic 84 (first input section 846A, second input section 846B). Also, the control logic 84 of this embodiment is provided with two shift register groups for storing the setting data SP (first shift register group 842A, second shift register group 842B). The head controller HC of the first embodiment is furnished with a shift register group 85 for dummy data. The connectivity of the first shift register 81A to the third shift register 81C is different in the first embodiment from that of the second reference example. Specifically, the first shift register 81A through the second shift register 81B are connected to the first shift register group 842A, and the third shift register 81C is connected to the second shift register group 842B and the shift register group 85 for dummy data.

In the first embodiment, the head controller HC is used in common for cyan and magenta, for which eight gradation printing is performed, and for black and yellow, for which four gradation printing is performed. Eight gradation printing and four gradation printing of the first embodiment are described below.

Eight Gradation Printing

The eight gradation printing of cyan is described. It should be noted that the eight gradation printing of magenta is substantially similar as in the case of cyan.

Figure 24A:
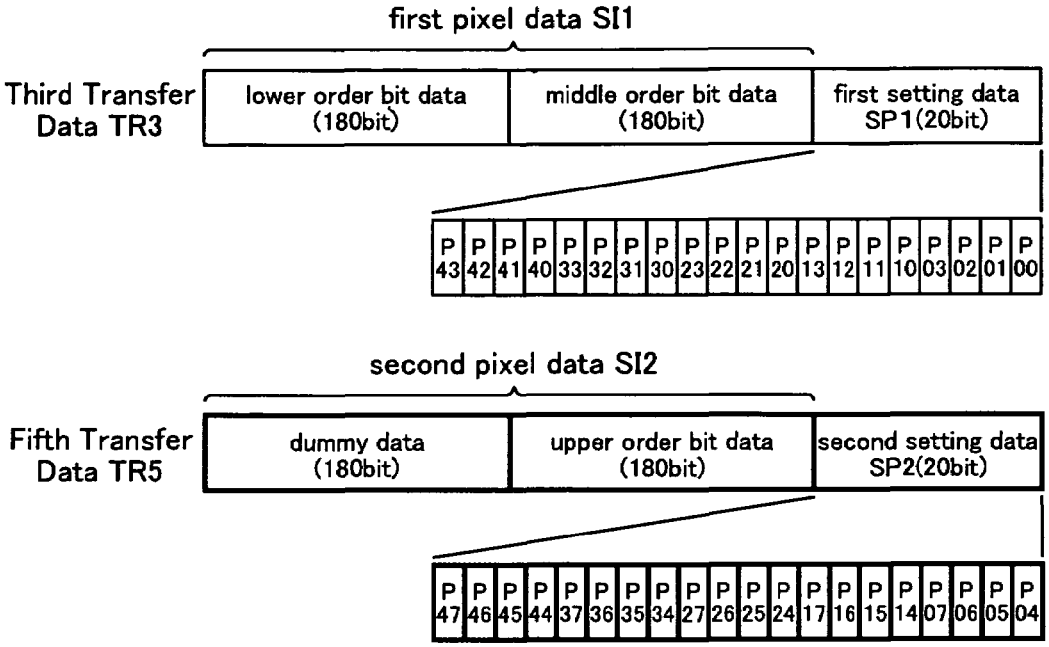
FIG. 24A is an explanatory diagram of a third transfer signal TR3 that is input to the first input section and a fifth transfer signal TR5 that is input to the second input section in the case of eight gradation printing.
Figure 24B:
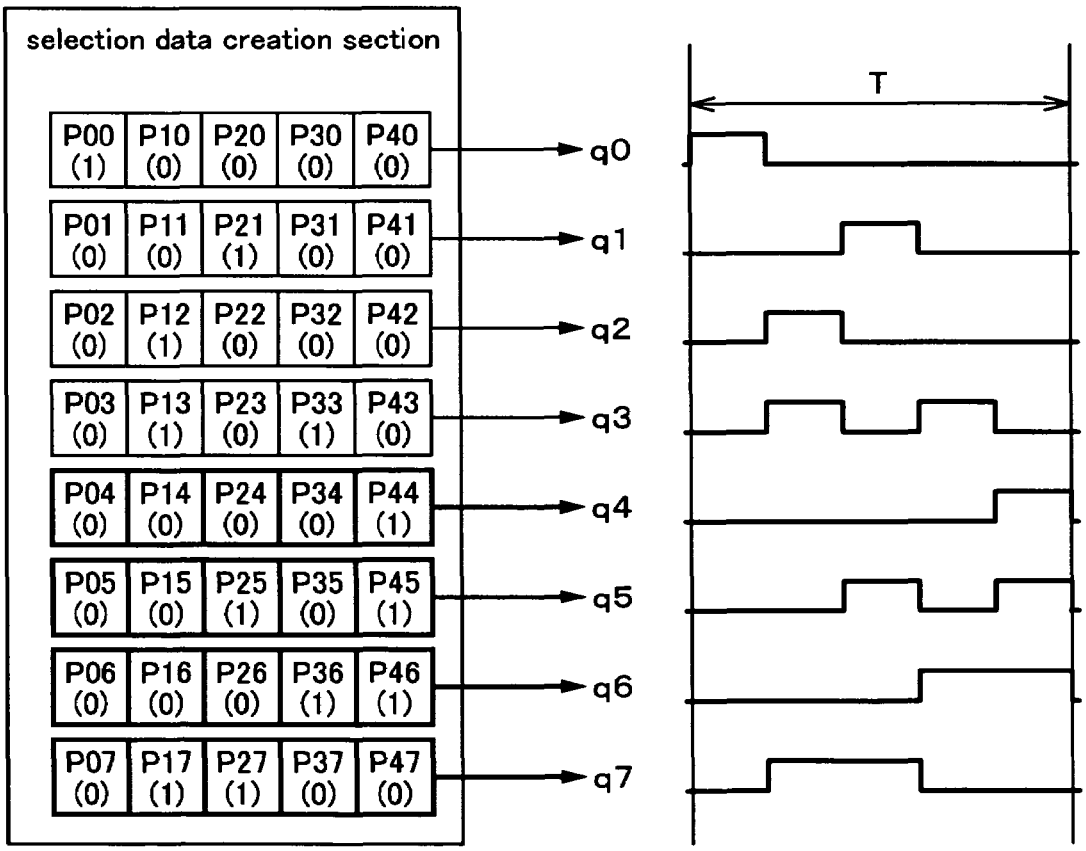
FIG. 24B is an explanatory diagram of the function of the selection signal creation section 844 in the case of eight gradation printing.

FIG. 24A is an explanatory diagram of the third transfer signal TR3 that is input to the first input section 846A and the fifth transfer signal TR5 that is input to the second input section 846B at the time of eight gradation printing. FIG. 24B is an explanatory diagram of the function of the selection signal creation section 844 at the time of eight gradation printing.

The third transfer signal TR3 includes first pixel data SI1 and first setting data SP1. The first pixel data have lower order bit data and middle order bit data. The lower order bit data are the data of the lower order bit of the 180 pixel data corresponding to the 180 nozzles, and are 180 bits of data. It should be noted that in the case of the pixel data 001, the lower order bit data is 1. The middle order bit data are the data of the middle order of bit the 180 pixel data corresponding to the 180 nozzles, and are 180 bits of data. It should be noted that in the case of the pixel data 010, the middle order bit data is 1. The first setting data SP1 are the data that are required for creating the selection signals q0 to q3. It is necessary to determine whether the four types of selection signals are L level or H level in its five intervals, and thus the first setting data SP1 are 20 bits of data.

The fifth transfer signal TR5 includes dummy data, the upper order bit data, and second setting data. The dummy data are data that are added so that the data length of the fifth transfer signal TR5 matches the data length of the third transfer signal TR3. The upper order bit data are the data of the upper order bit of the 180 pixel data corresponding to the 180 nozzles, and are 180 bits of data. It should be noted that in the case of the pixel data 100, the upper order bit data is 1. The second setting data SP2 are the data necessary for creating the selection signals q4 to q7. It is necessary to determine whether the four types of selection signals are L level or H level in the five intervals, and thus the second setting data SP1 are made of 20 bits of data.

When the third transfer signal TR3 is input to the first input section 846A, the lower order bit data are set to the first shift registers 81A, the middle order bit data are set to the second shift registers 81B, and the first setting data SP1 are set to the first shift register group 842A. When the third transfer signal TR3 is input to the first input section 846A, then, in synchronization with this, the fifth transfer signal TR5 is input to the second input section 846B. When the fifth transfer signal TR5 is input to the second input section 846B, the dummy data are set to the dummy shift register group 85, the upper order bit data are set to the third shift registers 81C, and the second setting data SP2 are set to the second shift register group 842B.

After the various data have been set to the first shift registers 81A through the third shift registers 81C, then, in accordance with the pulse of the latch signal LAT that is input to the head controller HC, the lower order bit data that have been set in the first shift registers 81A are latched by the first latch circuits 82A, the middle order bit data that have been set in the second shift registers 81B are latched by the second latch circuits 82B, and the upper order bit data that have been set in the third shift registers 81C are latched by the third latch circuits 82C. After the various setting data have been set in the first shift register group 842A and the second shift register group 842B, then, in accordance with the pulse of the latch signal LAT that is input to the head controller HC, the first setting data SP1 and the second setting data SP2 are latched by the selection signal creation section 844.

The selection signal creation section 844 creates the selection signals q0 to q7 based on the 40 bits of setting data that have been latched, and the change signal CH for dividing the repeating period T into five intervals. The selection signal creation section 844 creates the selection signals q0 to q3 based on the first setting data SP1 that have been latched from the first shift register group 842A, and creates the selection signals q4 to q7 based on the second setting data SP2 that have been latched from the second shift register group 842B.

For example, the selection signal creation section 844 creates the selection signal q0 based on predetermined five bits of data (data P00, data P10, data P20, data P30, data P40) included in the third transfer signal TR3. The selection signal creation section 844 creates the selection signal q1 based on five predetermined bits of data (data P01, data P11, data P21, data P31, data P41) included in the third transfer signal TR3. The selection signal creation section 844 creates the selection signal q2 based on five predetermined bits of data (data P02, data P12, data P22, data P32, data P42) included in the third transfer signal TR3. The selection signal creation section 844 creates the selection signal q3 based on five predetermined bits of data (data P03, data P13, data P23, data P33, data P43) included in the third transfer signal TR3.

Also, for example, the selection signal creation section 844 creates the selection signal q4 based on five predetermined bits of data (data P04, data P14, data P24, data P34, data P44) included in the fifth transfer signal TR5. The selection signal creation section 844 creates the selection signal q5 based on five predetermined bits of data (data P05, data P15, data P25, data P35, data P45) included in the fifth transfer signal TR5. The selection signal creation section 844 creates the selection signal q6 based on five predetermined bits of data (data P06, data P16, data P26, data P36, data P46) included in the fifth transfer signal TR5. The selection signal creation section 844 creates the selection signal q7 based on five predetermined bits of data (data P07, data P17, data P27, data P37, data P47) included in the fifth transfer signal TR5.

It should be noted that L level or H level is determined for the first interval T11 of the selection signal based on the value of the data P0* (where * is 0-7), L level or H level is determined for the second interval T12 of the selection signal based on the value of the data P1* (where * is 0-7), L level or H level is determined for the third interval T13 of the selection signal based on the value of the data P2* (where * is 0-7), L level or H level is determined for the fourth interval T14 of the selection signal based on the value of the data P3* (where * is 0-7), and L level or H level is determined for the fifth interval T15 of the selection signal based on the value of the data P4* (where * is 0-7). For example, the five bit data for the selection signal q0 (data P00, data P10, data P20, data P30, data P40) is 10000, and as a result, the selection signal q0 is H level in the first interval T11 and is L level in the second through fifth intervals T12 to T14. It should be noted that the case of the selection signal q0 applies for the selection signals q1 to q7 as well.

The signal selection section 83 selects one of the selection signals q0 to q7 according to the 3-bit pixel data latched by the first latch circuit 82A to the third latch circuit 82C. The selection signal q0 is selected if the pixel data are 000, the selection signal q1 is selected if the pixel data are 001, the selection signal q2 is selected if the pixel data are 010, the selection signal q3 is selected if the pixel data are 011, the selection signal q4 is selected if the pixel data are 100, the selection signal q5 is selected if the pixel data are 101, the selection signal q6 is selected if the pixel data are 110, and the selection signal q7 is selected if the pixel data are 111. It should be noted that if the upper order bit of the 3-bit pixel data (the pixel data after decoding) is 0, then one of the selection signals q0 to q3 is selected. Also, if the upper order bit of the 3-bit pixel data (the pixel data after decoding) is 1, then one of the selection signals q4 to q7 is selected. The selection signal that has been selected is then output from the signal selection section 83 as the switch signal SW.

The drive signal COM and the switch signal SW are input to the switch 86. When the switch signal is H level, the switch 86 becomes on and the drive signal COM is applied to the piezo element 421. When the switch signal SW is L level, the switch 86 becomes off and the drive signal COM is not applied to the piezo element 421.

If the pixel data before decoding are 000, then the signal selection section 83 selects the selection signal q0 based on the decoded pixel data of 000, and the first interval signal SS11 of the drive signal COM is applied to the piezo element 421 and the piezo element 421 is driven by the drive pulse PS11. When the piezo element 421 is driven according to the drive pulse PS11, the ink is subjected to a change in pressure of a degree that does not result in the ejection of ink, and the ink meniscus (the free surface of the ink that is exposed at the nozzle portion) is finely vibrated.

If the pixel data before decoding are 001, then the signal selection section 83 selects the selection signal q4 based on the decoded pixel data of 100, and the fifth interval signal SS15 of the drive signal COM is applied to the piezo element 421 and the piezo element 421 is driven by the drive pulse PS15. When the piezo element 421 is driven according to the drive pulse PS15, a 1.5 pl (picoliter) ink droplet is ejected (and forms a dot that corresponds to that amount of ink).

If the pixel data before decoding are 010, then the signal selection section 83 selects the selection signal q1 based on the decoded pixel data of 001, and the third interval signal SS13 of the drive signal COM is applied to the piezo element 421 and the piezo element 421 is driven by the drive pulse PS13. When the piezo element 421 is driven according to the drive pulse PS13, a 3 pl ink droplet is ejected.

If the pixel data before decoding are 011, then the signal selection section 83 selects the selection signal q5 based on the decoded pixel data of 101, and the third interval signal SS13 and the fifth interval signal SS15 of the drive signal COM are applied to the piezo element 421 and the piezo element 421 is driven by the drive pulse PS13 and the drive pulse PS15. When the piezo element 421 is driven according to the drive pulse PS13 and the drive pulse PS15, a 4.5 pl ink droplet is ejected.

If the pixel data before decoding are 100, then the signal selection section 83 selects the selection signal q2 based on the decoded pixel data of 010, and the second interval signal SS12 of the drive signal COM is applied to the piezo element 421 and the piezo element 421 is driven by the drive pulse PS12. When the piezo element 421 is driven according to the drive pulse PS12, a 7 pl ink droplet is ejected.

If the pixel data before decoding are 101, then the signal selection section 83 selects the selection signal q6 based on the decoded pixel data of 110, and the fourth interval signal SS14 and the fifth interval signal SS15 of the drive signal COM are applied to the piezo element 421 and the piezo element 421 is driven by the drive pulse PS14 and the drive pulse PS15. When the piezo element 421 is driven according to the drive pulse PS14 and the drive pulse PS15, a 8.5 pl ink droplet is ejected.

If the pixel data before decoding are 110, then the signal selection section 83 selects the selection signal q7 based on the decoded pixel data of 111, and the second interval signal SS12 and the third interval signal SS13 of the drive signal COM are applied to the piezo element 421 and the piezo element 421 is driven by the drive pulse PS12 and the drive pulse PS13. When the piezo element 421 is driven according to the drive pulse PS12 and the drive pulse PS13, a 10 pl ink droplet is ejected.

If the pixel data before decoding are 111, then the signal selection section 83 selects the selection signal q3 based on the decoded pixel data of 011, and the second interval signal SS12 and the fourth interval signal SS14 of the drive signal COM are applied to the piezo element 421 and the piezo element 421 is driven by the drive pulse PS12 and the drive pulse PS14. When the piezo element 421 is driven according to the drive pulse PS12 and the drive pulse PS14, a 14 pl ink droplet is ejected.

Four Gradation Printing

The four gradation printing of black is described. It should be noted that the four gradation printing of yellow is substantially the same as in the case of four gradation printing of black.

Figure 25A:
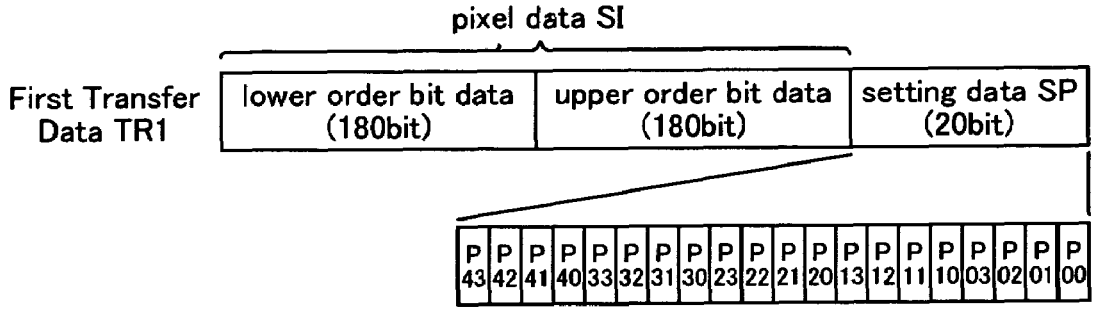
FIG. 25A is an explanatory diagram of a first transfer signal TR1 that is input to the first input section at the time of four gradation printing.
Figure 25B:
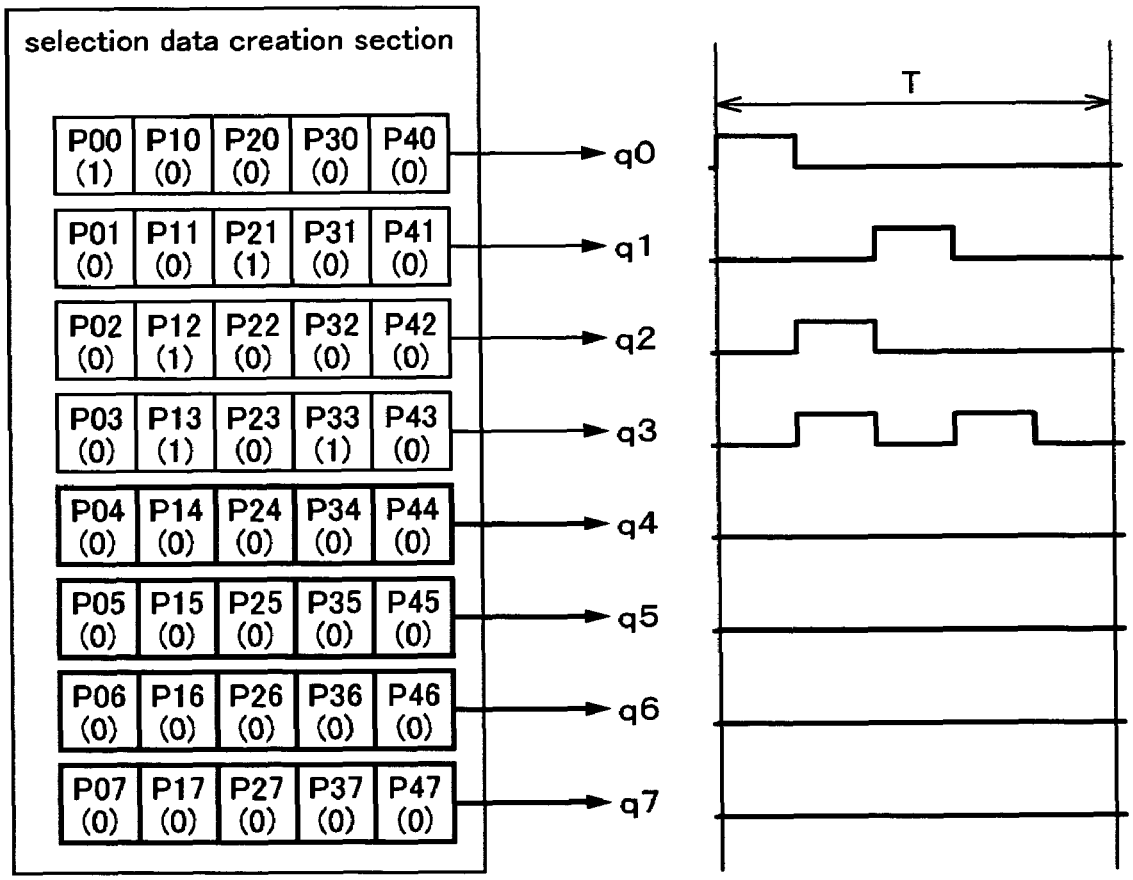
FIG. 25B is an explanatory diagram of the function of the selection signal creation section 844 at the time of four gradation printing.

FIG. 25A is an explanatory diagram of the first transfer signal TR1 that is input to the first input section 846A at the time of four gradation printing. FIG. 25B is an explanatory diagram of the function of the selection signal creation section 844 in the case of four gradation printing.

The second input section 846B of the color head controllers HC that perform four gradation printing is connected to the GND, and the potential of the second input section 846B is L level.

The first transfer signal TR1 includes pixel data SI and setting data SP. The pixel data have lower order bit data and upper order bit data. The lower order bit data are the data of the lower order bit of the 180 pixel data that correspond to the 180 nozzles, and are 180 bits of data. It should be noted that in the case of the pixel data 01, the data of the lower order bit is 1. The upper order bit data are data of the upper order bit of the 180 pixel data that correspond to the 180 nozzles, and are 180 bits of data. It should be noted that in the case of the pixel data 10, the upper order bit data is 1. The setting data SP are data required for creating the selection signals q0 to q3. It is necessary to determine whether four types of selection signals are L level or H level in the five intervals, and thus the setting data SP are 20 bits of data.

When the first transfer signal TR1 is input to the first input section 846A, the lower order bit data are set in the first shift registers 81A, the upper order bit data are set in a second shift registers 81B, and the setting data SP are set in the first shift register group 842A. When the first transfer signal TR1 is input to the first input section 846A, the second input section 846B is connected to the GND and is at the L level potential. Thus, a 0 (L level data) is set in the third shift registers 81C, and the data of the L level is set to the second shift register group 842B as well.

Once the various data have been set in the first shift registers 81A through the third shift register 81C, then, according to the pulse of the latch signal LAT that is input to the head controller HC, the lower order bit data that have been set in the first shift registers 81A are latched by the first latch circuits 82A, and the upper order bit data that have been set in the second shift registers 81B are latched by the second latch circuits 82B. At this time, the L level data that have been set in the third shift registers 81C are latched by the third latch circuits 82C. After the setting data SP have been set in the first shift register group 842A, then, according to the pulse of the latch signal LAT that is input to the head controller HC, the setting data SP are latched by the selection signal creation section 844. Also at this time, the L level data that have been set in the second shift register group 842B are latched by the selection signal creation section 844.

The selection signal creation section 844 creates the selection signals q0 to q3 based on the setting data SP latched from the first shift register group 842A. In this way, the selection signal creation section 844 creates the selection signals q0 to q3 in the same manner as in the case of eight gradation printing.

Also in the same manner as in the case of eight gradation printing, the selection signal creation section 844 creates the selection signals q4 to q7 based on the data latched from the second shift register group 842B. However, since the data that are latched from the second shift register group 842B are L level, the selection signals q4 to q7 become L level in all intervals from the first interval T11 through the fifth interval T15.

When the data that are latched by the first latch circuit 82A to the third latch circuit 82C are seen from the signal selection section 83, the 3-bit pixel data have an upper order bit data of 0. Then, in the same manner as in the case of eight gradation printing, the signal selection section 83 selects one of the selection signals q0 to q7 in accordance with the 3-bit pixel data latched by the first latch circuit 82A through the third latch circuit 82C. However, since the upper order bit data is 0 when seen from the signal selection section 83, the selection signals q4 to q7 are not selected by the signal selection section 83. Thus, in practical terms, the signal selection section 83 selects one of the selection signals q0 to q3.

If the pixel data are 00, then the signal selection section 83 selects the selection signal q0 based on the 3-bit data 000 latched by the first latch circuit 82A through the third latch circuit 82C, and the first interval signal SS11 of the drive signal COM is applied to the piezo element 421 and the piezo element 421 is driven by the drive pulse PS11. When the piezo element 421 is driven according to the drive pulse PS11, the ink is subjected to a change in pressure of a degree that does not result in the ejection of ink, and the ink meniscus (the free surface of the ink that is exposed at the nozzle portion) is finely vibrated.

If the pixel data are 01, then the signal selection section 83 selects the selection signal q1 based on the 3-bit data 001 latched by the first latch circuit 82A to the third latch circuit 82C, and the third interval signal SS13 of the drive signal COM is applied to the piezo element 421 and the piezo element 421 is driven by the drive pulse PS13. When the piezo element 421 is driven according to the drive pulse PS13, a 3 pl ink droplet is ejected.

If the pixel data are 10, then the signal selection section 83 selects the selection signal q2 based on the 3-bit data 010 latched by the first latch circuit 82A to the third latch circuit 82C, and the second interval signal SS12 of the drive signal COM is applied to the piezo element 421 and the piezo element 421 is driven by the drive pulse PS12. When the piezo element 421 is driven according to the drive pulse PS12, a 7 pl ink droplet is ejected.

If the pixel data are 11, then the signal selection section 83 selects the selection signal q3 based on the 3-bit data 011 latched by the first latch circuit 82A to the third latch circuit 82C, and the second interval signal SS12 and the fourth interval signal SS14 of the drive signal COM are applied to the piezo element 421 and the piezo element 421 is driven by the drive pulse PS12 and the drive pulse PS14. When the piezo element 421 is driven according to the drive pulse PS12 and the drive pulse PS14, a 14 pl ink droplet is ejected.

It should be noted that since the upper order bit data of the 3-bit pixel data is 0 when seen from the signal selection section 83, the selection signals q4 to q7, which are L level in all intervals, are not selected by the signal selection section 83.

According to the above First Embodiment, printing can be performed while changing the number of gradations of each color. For example, when performing printing shown in FIG. 19A, cyan and magenta are printed with eight gradations and black and yellow are printed with four gradations, but when performing printing shown in FIG. 19B, yellow and magenta are printed with eight gradations and black and cyan are printed with four gradations. In addition to the above, according to First Embodiment, the number of gradations is changed for each color according to the printing condition, thus image quality can be improved. For example, when blue has been decided as the primary color in color printing, cyan and magenta associated with blue can be printed with eight gradations, and a blue image can be printed with blue middle tones changing smoothly. Note that, as in the above-described second comparative example (refer to FIG. 14B), if the number of gradations of all the colors are made high, of course the image quality will improve. However, in this case, data amount will increase. On the other hand, as in the above-described embodiment, if only cyan and magenta that are associated with blue are to be eight gradations, and if yellow and black that are not highly associated with blue are to be four gradations, data amount can be decreased without deteriorating the image quality very much. That is, if the number of gradations of each color can be changed, it will have an effect on decreasing data amount.

Further, according to the above-described First Embodiment, the switching circuit 48 is provided for each head controller. Thus, the destination of the fifth transfer signal TR5 or the sixth transfer signal TR6 will can be changed, according to the number of gradations decided for each color. Assuming that the switching circuit 48 is not provided, it is necessary to provide a cable respectively for a signal line for inputting the transfer signal to the second input section of each color, and as similar to the signal lines for each color for transmitting the transfer signals to the first input sections, four signal lines will be necessary for inputting the transfer signal TR to the second input section of each color. On the other hand, in the above-described embodiment, a switching circuit 48 is provided, and there can be just two signal lines for inputting the transfer signal TR to the second input section of each color can be. Namely, by providing the switching circuit 48, the number of signal lines of cables for transmitting the transfer signal TR between the computer side controller 60 and the head unit 40 can be decreased.

It should be noted that, according to the first embodiment, the head controllers HC for black and yellow, for which four gradation printing is performed, can share a common structure with the head controllers for cyan and magenta, for which eight gradation printing is performed (thus, it is possible to print by changing the number of gradations for each color). Also, since the amount of data of the transfer signal TR that is serially transferred to the first input section 846A and the second input section 846B of the head controller HC is less than in the case of the second reference example, the setting of data is not time consuming.

Second Embodiment (Mixed Printing of Four Gradations and Six Gradations)

In the first embodiment described above, eight gradation printing is performed for cyan and magenta, but in the second embodiment described below, six gradation printing is performed for cyan and magenta. Also, in the first embodiment described above, the setting data for creating the selection signals q0 to q3 are input from only the first input section 846A, but in the second embodiment described below, some of the setting data for creating the selection signals q0 to q3 is input from the second input section 846B.

It should be noted that in the Second Embodiment, the operations of the printer driver and the operations of the switching circuits 48 and the like are similar to that of the First Embodiment described above, and thus explanations are omitted. In the explanations below, cyan and magenta perform six gradation printing, and black and yellow perform four gradation printing. But, for example, in the case that the print image has red as the primary color, yellow and magenta will perform six gradation printing, and black and cyan will perform four gradation printing.

Regarding Decoding the Pixel Data

The signal that is applied to the piezo element 421 when the pixel data are 00 in four gradation printing is the same as the signal that is applied to the piezo element 421 when the pixel data are 000 in six gradation printing. Similarly, the pixel data 01 in four gradation printing and the pixel data 010 in six gradation printing, the pixel data 10 in four gradation printing and the pixel data 011 in six gradation printing, and the pixel data 11 in four gradation printing and the pixel data 101 in six gradation printing, each share common signals that are applied to the piezo elements 421.

Accordingly, in the second embodiment as well, decoding is performed so that the 3-bit pixel data for six gradation printing, which shares an application-signal with that for four gradation printing, matches the lower two digits of the pixel data for four gradation printing. Also, decoding is performed so that the upper order bit of the 3-bit pixel data for six gradation printing, which shares the application signal with that for four gradation printing, becomes 0.

FIG. 26 is an explanatory diagram regarding the decoding of the pixel data for six gradation printing. The 3-bit pixel data of the pixel data that are included in the print data sent from the computer are decoded by a decoder prior to being input to the head controller HC of the embodiment, which is discussed later. The decoder is provided in the printer-side controller 60, but it is also possible for it to be provided on the head unit side.

The values of the 3-bit pixel data before decoding are values in the shade order of the pixels on the paper. However, the result of the decoder decoding the 3-bit pixel data for six gradation printing is that the values of the 3-bit pixel data after decoding are not in the shade order of the pixels on the paper.

In this embodiment as well, a common head controller HC is used for cyan and magenta, for which six gradation printing is performed, and for black and yellow, for which four gradation printing is performed. Below is a description of six gradation printing and four gradation printing in the second embodiment. It should be noted that the structure of the head controller HC of the second embodiment is substantially the same as the structure of the head controller HC of the first embodiment, and thus FIG. 23 will be referred to as necessary in the description.

Six Gradation Printing

Six gradation printing of cyan is described. It should be noted that six gradation printing of magenta is substantially the same as the six gradation printing of cyan.

Figure 27A:
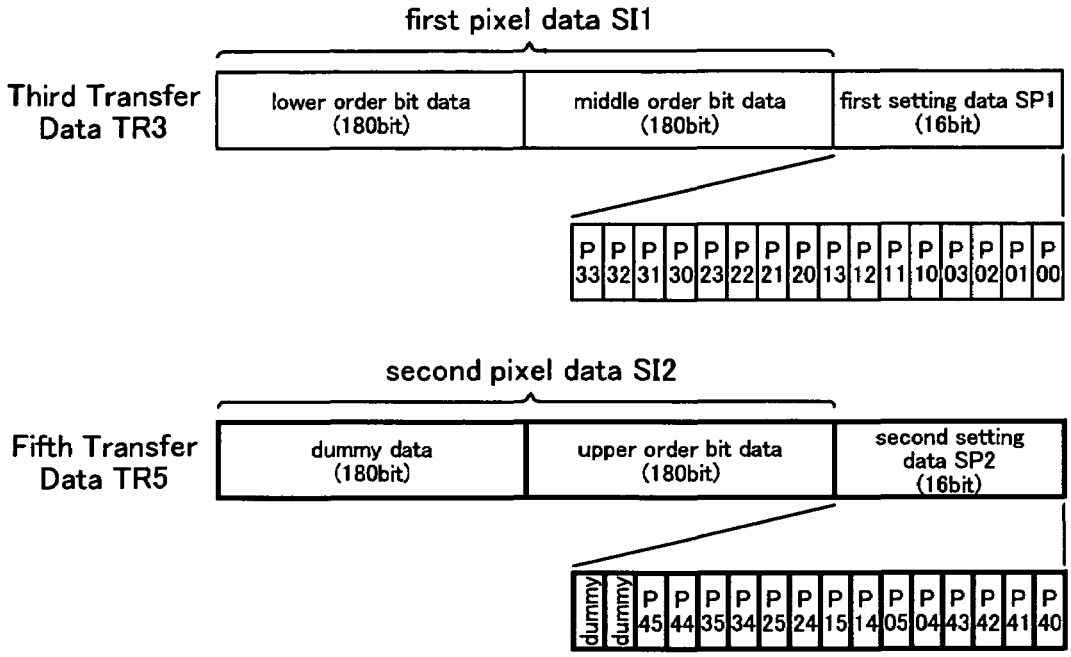
FIG. 27A is an explanatory diagram of the third transfer signal TR3 that is input to the first input section and the fifth transfer signal TR5 that is input to the second input section in the case of six gradation printing.
Figure 27B:
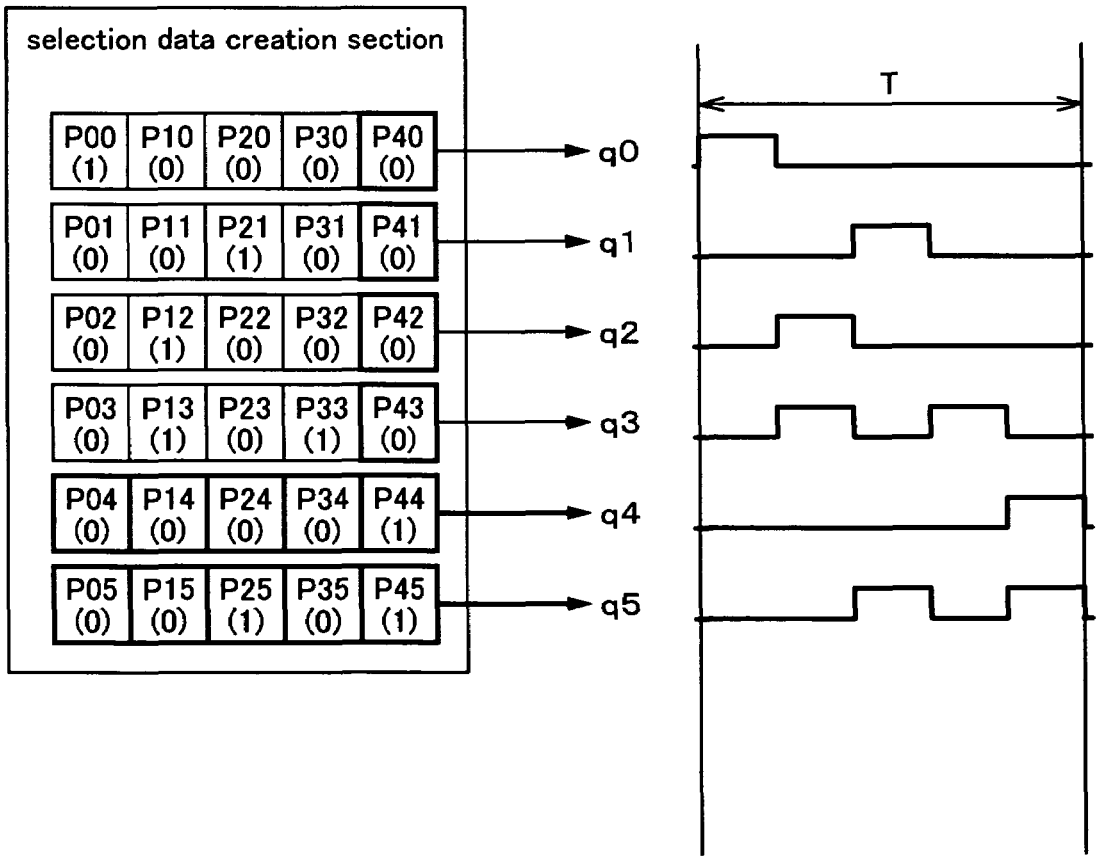
FIG. 27B is an explanatory diagram of the function of the selection signal creation section 844 in the case of six gradation printing.

FIG. 27A is an explanatory diagram of the third transfer signal TR3 that is input to the first input section 846A and the fifth transfer signal TR5 that is input to the second input signal 846B in the case of six gradation printing. FIG. 27B is an explanatory diagram of the function of the selection signal creation section 844 at the time of six gradation printing.

Like in the first embodiment, the third transfer signal TR3 includes first pixel data SI1 and first setting data SP1. However, the first setting data SP1 of the second embodiment are 16 bits of data, and are data for determining whether the selection signals q0 to q3 are L level or H level in the first interval T11 through the fourth interval T14.

The fifth transfer signal TR5, also like in the first embodiment, includes dummy data, upper order bit data, and second setting data. However, the second setting data SP2 of the second embodiment are 16 bits of data that include two bits of dummy data. The second setting data SP2 are made of data for determining whether the selection signals q0 to q3 are L level or H level in the fifth interval T15, and data for determining whether the selection signals q4 and q5 are L level of H level in the five intervals.

As in the first embodiment, in the second embodiment as well, the third transfer signal TR3 is input to the first input section 846A and the fifth transfer signal TR5 is input to the second input section 846B (see FIG. 23). Thus, like in the first embodiment, the various data are set in the shift registers and are latched according to the pulse of the latch signal LAT.

The selection signal creation section 844 creates selection signals q0 to q5 based on the 30 bits of latched setting data and the change signal CH for dividing the repeating period T into five intervals. In the first embodiment, the selection signals q0 to q3 are created based on only the first setting data SP1, but in the second embodiment, they are created based on the first setting data SP1 and the second setting data SP2.

For example, the selection signal creation section 844 creates the selection signal q0 based on data P00, data P10, data P20, data P30, and data P40. It should be noted that the data P00 to data P30 are data that are included in the third transfer signal TR3, but the data P40 are data that are included in the fifth transfer signal TR5. Similarly, the selection signal creation section 844 creates selection signals q1 to q3 based on the four bits of data included in the third transfer signal TR3 and the one bit of data included in the fifth transfer signal TR5.

It should be noted that as in the first embodiment, the selection signals q4 to q5 are created based on predetermined five bits of data that are included in the fifth transfer signal TR5.

The signal selection section 83, like in the first embodiment, selects one of the selection signals q0 to q5 according to the three bits of pixel data latched by the first latch circuit 82A through the third latch circuit 82C. The selection signal q0 is selected if the pixel data are 000, the selection signal q1 is selected if the pixel data are 001, the selection signal q2 is selected if the pixel data are 010, the selection signal q3 is selected if the pixel data are 011, the selection signal q4 is selected if the pixel data are 100, and the selection signal q5 is selected if the pixel data are 101. It should be noted that if the upper order bit data of the three bits of pixel data (the pixel data after decoding) is 0, then one of the selection signals q0 to q3 is selected. If the upper order bit of the three bits of pixel data (the pixel data after decoding) is 1, then either selection signal q4 to q5 is selected.

Thus, the ink meniscus is finely vibrated if the pixel data before decoding are 000, a 1.5 pl ink droplet is ejected if the pixel data before decoding are 001, a 3 pl ink droplet is ejected if the pixel data before decoding are 010, a 7 pl ink droplet is ejected if the pixel data before decoding are 011, a 10 plink droplet is ejected if the pixel data before decoding are 100, and a 14 pl ink droplet is ejected if the pixel data before decoding are 101.

Four Gradation Printing

Four gradation printing of black is described. It should be noted that four gradation printing of yellow is substantially the same as the four gradation printing of black.

Figure 28A:
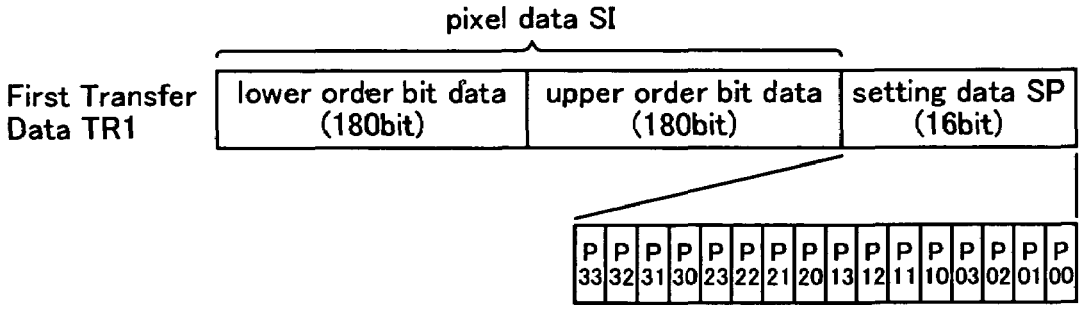
FIG. 28A is an explanatory diagram of the first transfer signal TR1 that is input to the first input section at the time of four gradation printing.
Figure 28B:
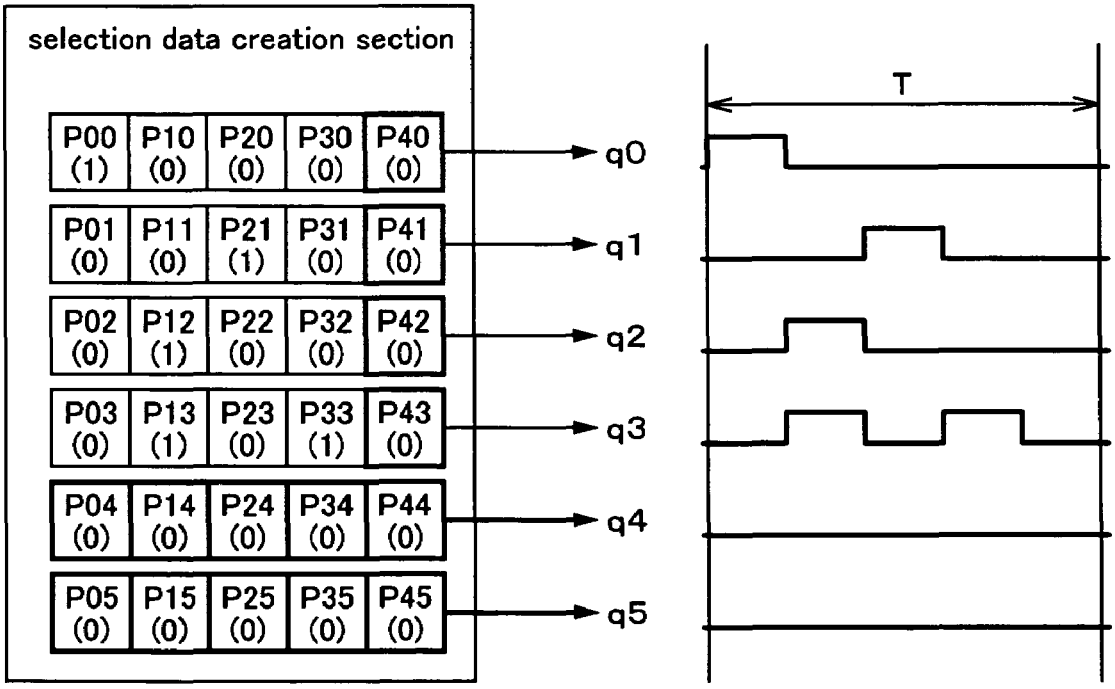
FIG. 28B is an explanatory diagram of the function of the selection signal creation section at the time of four gradation printing.

FIG. 28A is an explanatory diagram of the first transfer signal TR1 that is input to the first input section 846A at the time of four gradation printing. FIG. 28B is an explanatory diagram of the function of the selection signal creation section 844 in the case of four gradation printing.

In the second embodiment, like in the first embodiment, the second input section 846B of the color head controllers HC that perform four gradation printing is connected to the GND, and the potential of the second input section 846B is L level. Thus, when the first transfer signal TR1 is input to the first input section 846A, L level data are set in the third shift registers 81C and the second shift register group 842B. Then, in correspondence with the pulse of the latch signal LAT, the L level data set in the third shift registers 81C are latched by the third latch circuits 82C, and the L level data set in the second shift register group 842B are latched by the selection signal creation section 844.

The selection signal creation section 844, when it creates the selection signals q0 to q3, sets the first interval T11 through the fourth interval T14 to L level or H level according to the setting data. The selection signal creation section 844 sets the fifth interval T15 of the selection signals q0 to q3 to the L level according to the L level data from the second shift register group 842B. Thus, the selection signal creation section 844 creates the same selection signals q0 to q3 as in six gradation printing.

The selection signal creation section 844, like in the case of six gradation printing, creates selection signals q4 and q5 based on the data latched from the second shift register group 842B. However, since the data latched from the second shift register group 842B are L level, the selection signals q4 and q5 become L level in all intervals from the first interval T11 through the fifth interval T15.

When the data that are latched by the first latch circuit 82A through the third latch circuit 82C are seen from the signal selection section 83, the three bits of pixel data have upper order bit data of 0. Then, in the same manner as in the case of six gradation printing, the signal selection section 83 selects one of the selection signals q0 to q5 in accordance with the three bits of pixel data latched by the first latch circuit 82A through the third latch circuit 82C. However, since the upper order bit data is 0 when seen from the signal selection section 83, the selection signals q4 and q5 are not selected by the signal selection section 83. Thus, in practical terms, the signal selection section 83 selects one signal from the selection signals q0 to q3.

Thus, the ink meniscus is finely vibrated if the pixel data are 00, a 3 pl ink droplet is ejected if the pixel data are 01, a 7 pl ink droplet is ejected if the pixel data are 10, and a 14 pl ink droplet is ejected if the pixel data are 11.

With the second embodiment, the same effects as the above described Embodiment 1 will be realized.

It should be noted that, with the second embodiment, as in the first embodiment discussed above, it is possible to use a common head controller HC for four gradation printing and six gradation printing (thus, it is possible to print by changing the number of gradations for each color). Also, as in the first embodiment discussed above, the amount of data of the transfer signals TR serially transferred to the first input section 846A and the second input section 846B of the head controller HC is less than in the second reference example, and thus the setting of data is not time consuming.

Also, with the second embodiment, the selection signals q0 to q3 are determined to be L level or H level based on not only the setting data that are input to the first input section 846A but also the signal that is input to the second input section 846B. Thus, the amount of setting data to be input to the first input section 846A can be reduced, and thus, in the second embodiment, the time that is required for setting the data can be shortened over that in the first embodiment.

Third Embodiment (A Case of Using Two Types of Drive Signals COM)

In the first embodiment and the second embodiment discussed earlier, there was only a single type of drive signal COM, but in the third embodiment described below, there are two types of drive signals COM. Since it is possible to include two types of drive signal COM with drive pulses having different waveforms, in the third embodiment the repeating period T is shorter than the repeating periods of the first embodiment and the second embodiment.

It should be noted that in the third embodiment, as in the second embodiment, six gradation printing is performed for cyan and magenta and four gradation printing is performed for black and yellow. For this reason, the pixel data are decoded in the third embodiment in the same way as in the second embodiment (see FIG. 26).

Regarding the Relationship Between the Pixel Data and the Ink Droplet Size

Figure 29:
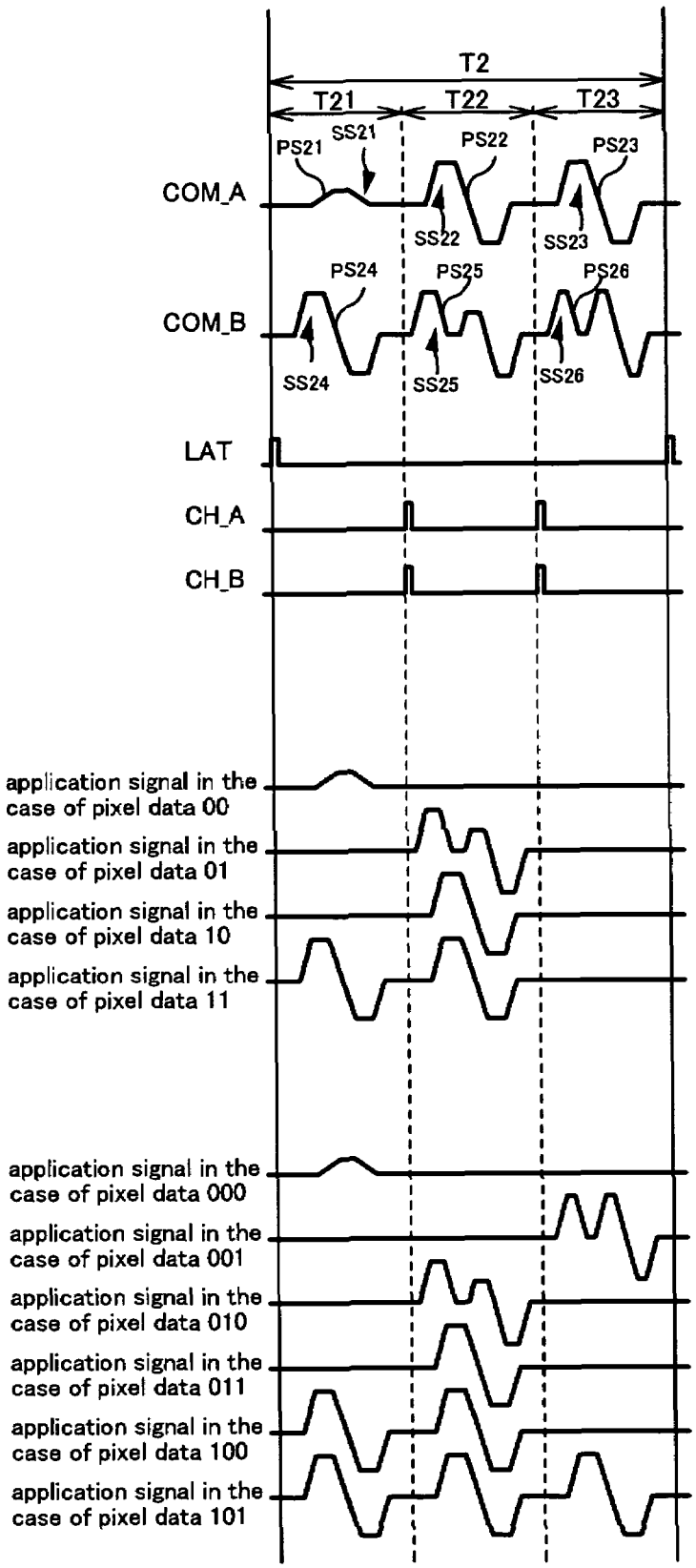
FIG. 29 is an explanatory diagram of the drive signal COM and the application signals that are applied to the piezo elements 421 of the third embodiment.

FIG. 29 is an explanatory diagram of the drive signal COM and the application signals that are applied to the piezo elements 421 in the third embodiment.

The first drive signal COM_A and the second drive signal COM_B are repeatedly generated for each repeating period T2. The repeating period T2 is the period that is required for the carriage CR to move a predetermined distance. Each repeating period T2 can be divided into three intervals T21 to T23.

With the first drive signal COM_A, a first interval signal SS21 that includes a drive pulse PS21 is created in the first interval T21, a second interval signal SS22 that includes a drive pulse PS22 is created in the second interval T22, and a third interval signal SS23 that includes a drive pulse PS23 is created in the third interval T23. With the second drive signal COM_B, a first interval signal SS24 that includes a drive pulse PS24 is created in the first interval T21, a second interval signal SS25 that includes a drive pulse PS25 is created in the second interval T22, and a third interval signal SS26 that includes a drive pulse PS26 is created in the third interval T23.

The waveforms of the drive pulses have been determined based on the operation that the piezo element 421 is to perform. The waveform of the drive pulse PS21 is determined so that it causes the piezo element 421 to vibrate finely. The drive pulse PS22, the drive pulse PS23, and the drive pulse PS24 are determined so that they drive the piezo element 421 so as to eject a 7 pl (picoliter) ink droplet from the nozzle. The drive pulse PS25 is determined so that it drives the piezo element 421 so as to eject a 3 pl ink droplet from the nozzle. The drive pulse PS26 is determined so that it drives the piezo element 421 so as to eject a 1.5 pl ink droplet from the nozzle.

The pixel data of colors for which four gradation printing is performed are two bits of data per pixel. If the pixel data are 00, then the piezo element 421 is driven according to the drive pulse PS21 and the ink meniscus is finely driven. If the pixel data are 01, then the piezo element 421 is driven according to the drive pulse PS25 and a 3 pl ink droplet is ejected from the nozzle, forming a small dot. If the pixel data are 10, then the piezo element 421 is driven according to the drive pulse PS22 and a 7 pl ink droplet is ejected from the nozzle, forming a medium dot. If the pixel data are 11, then the piezo element 421 is driven according to the drive pulse PS22 and the drive pulse PS24 and a 14 pl ink droplet is ejected from the nozzle, forming a large dot.

The pixel data of colors for which six gradation printing is performed are three bits of data per pixel. If the pixel data are 000, then the piezo element 421 is driven according to the drive pulse PS21 and the ink meniscus is finely vibrated. If the pixel data (the pixel data before decoding, described later) are 001, then the piezo element 421 is driven according to the drive pulse PS26 and a 1.5 pl ink droplet is ejected from the nozzle, forming a tiny dot. If the pixel data are 010, then the piezo element 421 is driven according to the drive pulse PS25 and a 3 pl ink droplet is ejected from the nozzle, forming a small dot. If the pixel data are 011, then the piezo element 421 is driven according to the drive pulse PS22, and a 7 pl ink droplet is ejected from the nozzle, forming a medium dot. If the pixel data are 100, then the piezo element 421 is driven according to the drive pulse PS22 and the drive pulse PS24, and a 14 pl ink droplet is ejected from the nozzle, forming a large dot. If the pixel data are 101, then the piezo element 421 is driven according to the drive pulse PS22, the drive pulse PS24, and the drive pulse PS23, and a 21 pl ink droplet is ejected from the nozzle, forming an extra large dot.

Below, how the piezo elements 421 are driven in the above manner based on the pixel data included in the print data sent from the computer is explained.

Regarding the Decoding of the Pixel Data

The signal that is applied to a piezo element 421 when the pixel data are 00 in four gradation printing is the same as the signal that is applied to a piezo element 421 when the pixel data are 000 in six gradation printing. Similarly, the pixel data 01 in four gradation printing and the pixel data 010 in six gradation printing, the pixel data 10 in four gradation printing and the pixel data 011 in six gradation printing, and the pixel data 11 in four gradation printing and the pixel data 100 in six gradation printing, each share common signals that are applied to the piezo element 421.

Accordingly, in the first embodiment, decoding is performed so that the three bits of pixel data for eight gradation printing, which shares an application signal with that for four gradation printing, match the lower two digits of the pixel data for four gradation printing. Decoding also is performed so that the upper order bit of three bits of pixel data for eight gradation printing, which shares the application signal with that for four gradation printing, becomes 0.

FIG. 30 is an explanatory diagram regarding the decoding of the pixel data for six gradation printing. The three bits of pixel data of the pixel data that are included in the print data sent from the computer are decoded by a decoder prior to being input to the head controller HC of the embodiment, which is discussed later. The decoder is provided in the printer-side controller 60, but it is also possible for it to be provided on the head unit side.

The values of the 3-bit pixel data before decoding are values in the shade order of the pixels on the paper. However, the result of the decoder decoding the 3-bit pixel data for six gradation printing is that the values of the 3-bit pixel data after decoding are not values in the shade order of the pixels on the paper.

Regarding the Head Controller HC

Figure 31:
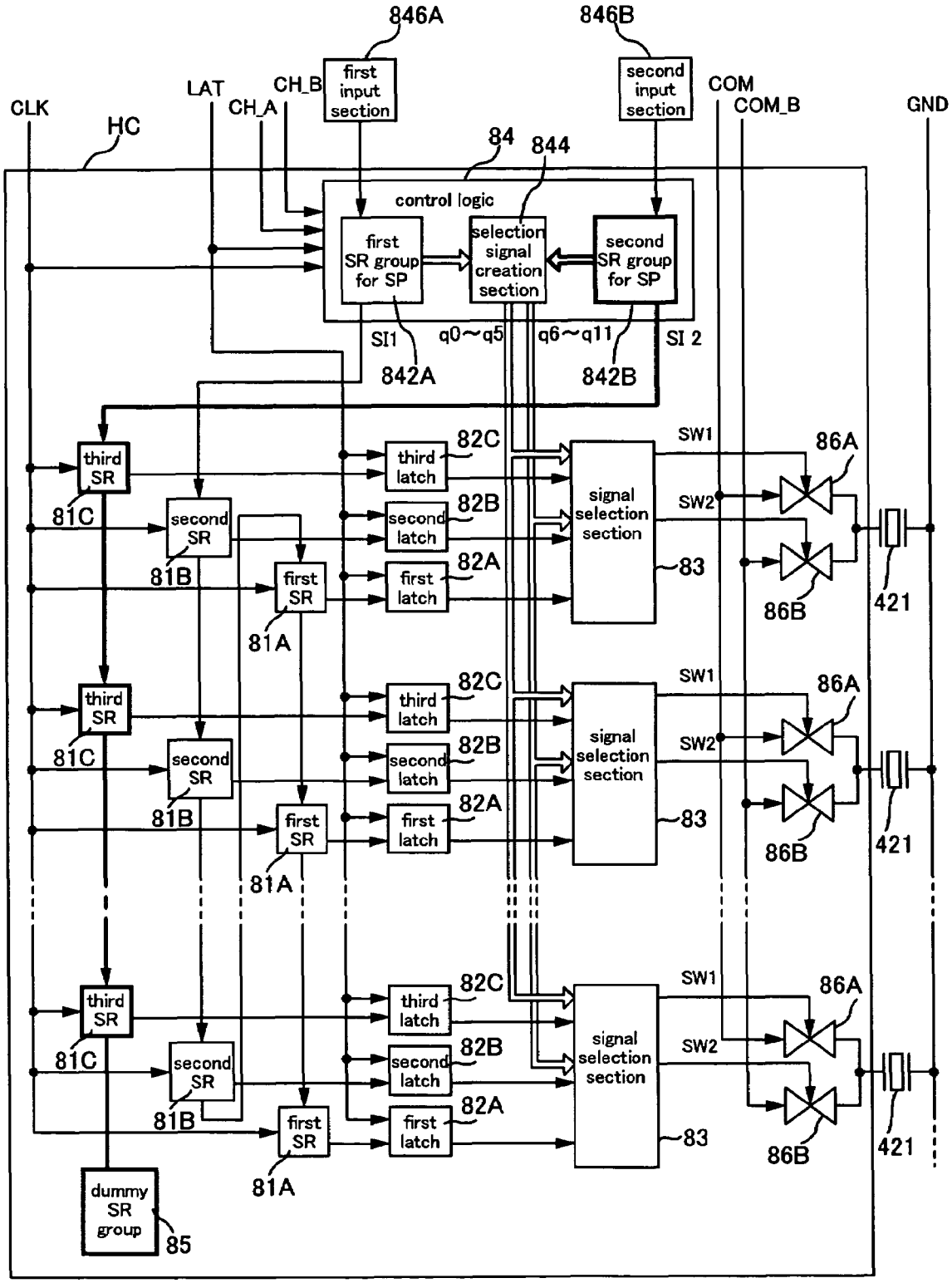
FIG. 31 is a block diagram of the head controller HC of the third embodiment.

FIG. 31 is a block diagram of the head controller HC of the third embodiment. In comparison to the first embodiment, in the third embodiment two types of change signals (first change signal CH_A and the second change signal CH_B) are input to the head controller HC (more specifically, to the control logic 84). Also in the third embodiment, two types of drive signals (first drive signal COM_A and second drive signal COM_B) are input to the head controller HC. Each piezo element 421 is provided with two switches (a first switch 86A and a second switch 86B), and the first drive signal COM_A is input to one switch and the second drive signal COM_B is input to the other switch. The signal selection sections output two switch signals (a first switch signal SW_A and a second switch signal SW_B), where one switch signal is input to the first switch 86A and the other switch signal is input to the second switch 86B.

In the third embodiment as well, a common head controller HC is used for cyan and magenta, for which six gradation printing is performed, and for black and yellow, for four gradation printing. Below, six gradation printing and four gradation printing in the third embodiment are described.

Six Gradation Printing

Six gradation printing of cyan is described. It should be noted that six gradation printing of magenta is substantially the same as in the case of the six gradation printing of cyan.

Figure 32A:
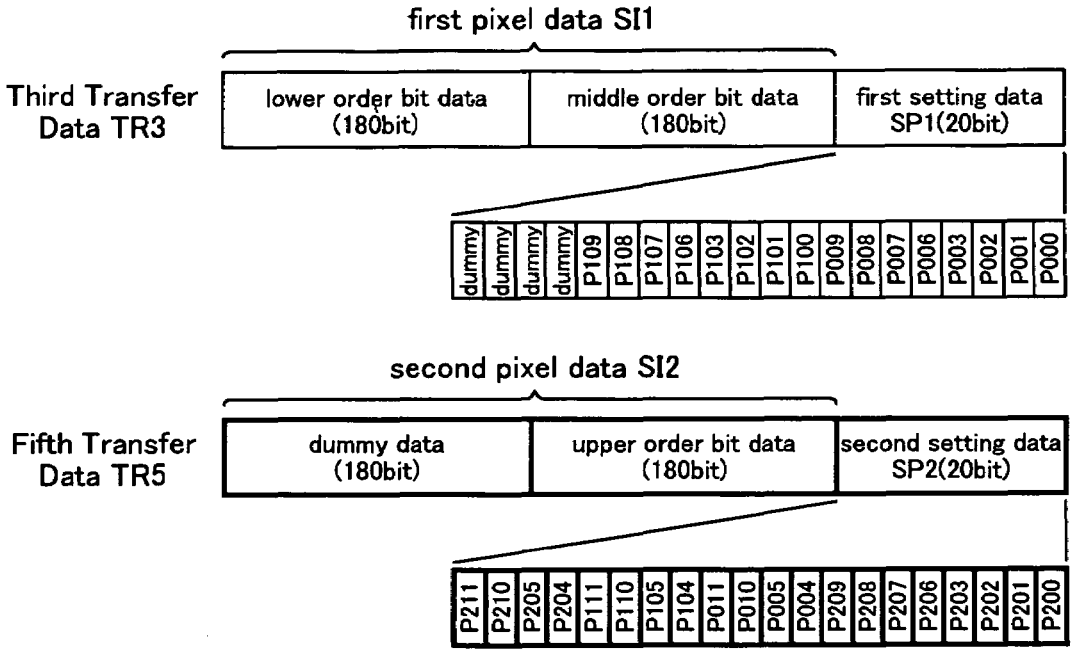
FIG. 32A is an explanatory diagram of the third transfer signal TR3 that is input to the first input section and the fifth transfer signal TR5 that is input to the second input section at the time of six gradation printing.
Figure 32B:
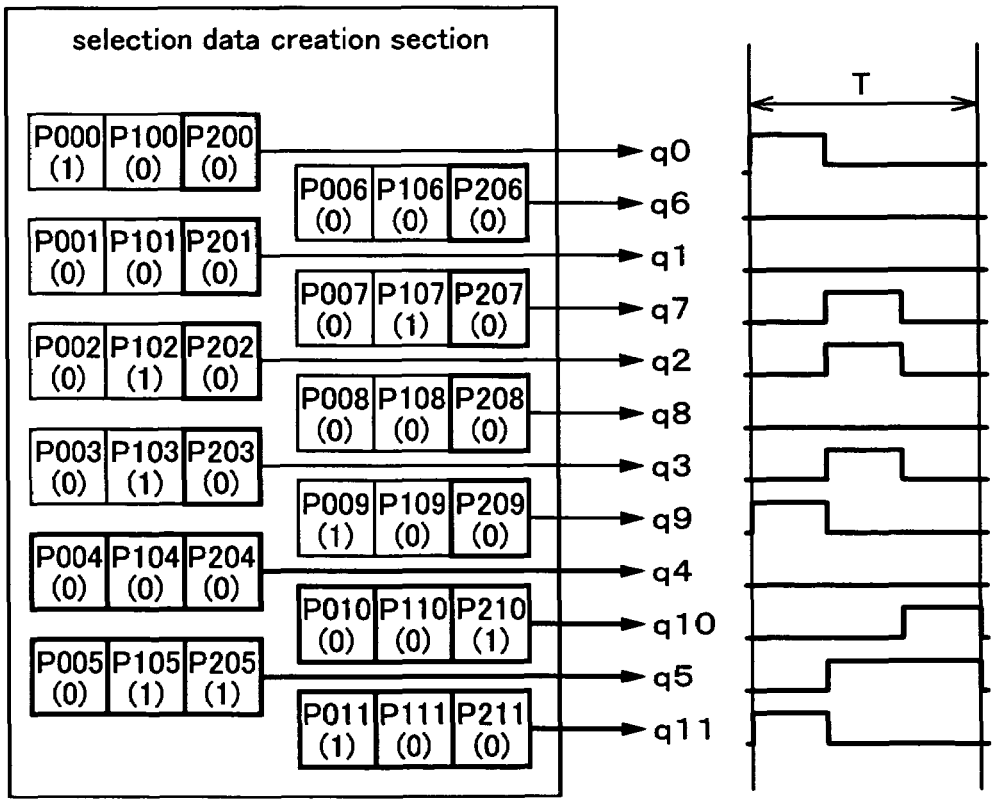
FIG. 32B is an explanatory diagram of the function of the selection signal creation section at the time of six gradation printing.

FIG. 32A is an explanatory diagram of the third transfer signal TR3 that is input to the first input section 846A and the fifth transfer signal TR5 that is input to the second input section 846B at the time of six gradation printing. FIG. 32B is an explanatory diagram of the function of the selection signal creation section 844 at the time of six gradation printing.

The third transfer signal TR3 includes first pixel data SI1 and first setting data SP1. The first setting data SP1 of the third embodiment are 20 bits of data, including four bits of dummy data. The first setting data SP1 are data for determining whether the selection signals q0 to q3 and the selection signals q6 to q9 are L level or H level in the first interval T21 and the second interval T22. It should be noted that the four bits of dummy data are for matching the data amount of the first setting data SP1 with the data amount of the second setting data SP2.

The fifth transfer signal TR5 includes second pixel data SI2 and second setting data SP2. The second setting data SP2 of the third embodiment is made of 20 bits of data. The second setting data SP2 are data for determining whether the selection signals q0 to q3 and the selection signals q6 to q9 are L level or H level in the third interval T23, and data for determining whether the selection signals q4, q5, q10, and q11 are L level or H level in the first interval T21 through the third interval T23.

In the third embodiment, like in the first embodiment and the second embodiment, the third transfer signal TR3 is input to the first input section 846A and the fifth transfer signal TR5 is input to the second input section 846B (see FIG. 31). Thus, the various data are set in the shift registers, and are latched according to the pulse of the latch signal LAT.

The selection signal creation section 844 creates the selection signals q0 to q5 based on the latched setting data and the first change signal CH_A for dividing the repeating period T into three intervals. The selection signal creation section 844 also creates the selection signals q6 to q11 based on the latched setting data and the second change signal CH_B for dividing the repeating period T into three intervals. It should be noted that here, for the sake of simplifying the description, the pulses of the first change signal CH_A and the second change signal CH_B have the same timing, but it is not absolutely necessary for their timings to match. The selection signals q0 to q3 and q6 to q9, like the selection signals q0 to q3 of the second embodiment, are created based on the first setting data SP1 and the second setting data SP2.

For example, the selection signal creation section 844 creates the selection signal q0 based on the data P000, the data P100, and the data P200. It should be noted that the data P000 and the data P100 are data included in the third transfer signal TR3, whereas the data P200 are data included in the fifth transfer signal TR5. Similarly, the selection signal creation section 844 creates the selection signals q1 to q3 and q6 to q9 based on two bits of data included in the third transfer signal TR3 and one bit of data included in the fifth transfer signal TR5.

It should be noted that the selection signals q4, q5, q10, and q11, like the selection signals q4 and q5 of the second embodiment, are created based on predetermined three bits of data included in the fifth transfer signal TR5. For example, the selection signal creation section 844 creates the selection signal q4 based on the data P004, the data P104, and the data P204.

FIG. 33 is a table on the relationship between the 3-bit pixel data and the selection signal that should be selected by the signal selection section.

The signal selection section 83 selects one of the selection signals q0 to q5 and one of the selection signals q6 to q11 in accordance with the three bits of pixel data latched in the first latch circuit 82A through the third latch circuit 82C. The selection signals q0 and q6 are selected if the pixel data are 000, the selection signals q1 and q7 are selected if the pixel data are 001, the selection signals q2 and q8 are selected if the pixel data are 010, the selection signals q3 and q9 are selected if the pixel data are 011, the selection signals q4 and q10 are selected if the pixel data are 100, and the selection signals q5 and q11 are selected if the pixel data are 101. It should be noted that if the upper order bit of the 3-bit pixel data (the pixel data after decoding) is 0, then one of the selection signals q0 to q3 is selected, and one of the selection signals q6 to q9 is selected. If the upper order bit of the 3-bit pixel data (the pixel data after decoding) is 1, then either the selection signal q4 or q5 is selected, and either the selection signal q10 to q11 is selected.

The selection signal that is selected from among the selection signals q0 to q5 is output from the signal selection section 83 as the first switch signal SW_A. The selection signal that is selected from among the selection signals q6 to q11 is output from the signal selection section 83 as the second switch signal SW_B.

The first drive signal COM_A and the first switch signal SW_A are input to the first switch 86A. When the first switch signal SW_A is H level, the first switch 86A becomes on, and the first drive signal COM_A is applied to the piezo element 421. When the first switch signal SW_A is L level, the first switch 86A becomes off and the first drive signal COM_A is not applied to the piezo element 421.

Similarly, the second drive signal COM_B and the second switch signal SW_B are input to the second switch 86B. When the second switch signal SW_B is H level, the second switch 86B becomes on and the second drive signal COM_B is applied to the piezo element 421. When the second switch signal SW_B is L level, the second switch 86B becomes off and the second drive signal COM_B is not applied to the piezo element 421.

If the pixel data before decoding are 000, then the signal selection section 83 selects the selection signals q0 and q6 based on the decoded pixel data of 000, and outputs the selection signal q0 as the first switch signal SW_A and outputs the selection signal q6 as the second switch signal SW_B. The first switch 86A, in accordance with the selection signal q0, which is the first switch signal SW_A, becomes on in the first interval T21 and becomes off in the second interval T22 and the third interval T23. The second switch 86B, in accordance with the selection signal q6, which is the second switch signal SW_B, becomes off in the first interval T21 through the third interval T23. As a result, in the repeating period T2, the first interval signal SS21 is applied to the piezo element 421 and the piezo element 421 is driven by the drive pulse PS21. When the piezo element 421 is driven according to the drive pulse PS21, the ink is subjected to a change in pressure to a degree that does not result in the ejection of ink, and the ink meniscus (the free surface of the ink that is exposed at the nozzle portion) is finely vibrated.

Similarly, if the pixel data before decoding are 001, then a 1.5 pl ink droplet is ejected and a tiny dot is formed, if the pixel data before decoding are 010, then a 3 pl ink droplet is ejected and a small dot is formed, if the pixel data before decoding are 011, then a 7 pl ink droplet is ejected and a medium dot is formed, if the pixel data before decoding are 100, then a 14 pl ink droplet is ejected and a large dot is formed, and if the pixel data before decoding are 101, then a 21 pl ink droplet is ejected and an extra large dot is formed.

Four Gradation Printing

Four gradation printing of black is described. It should be noted that four gradation printing of yellow is substantially the same as in the case of the four gradation printing of black.

Figure 34A:
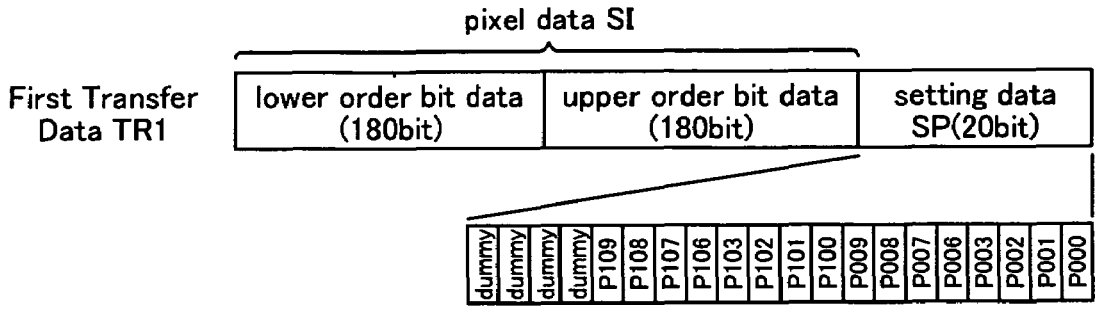
FIG. 34A is an explanatory diagram of the first transfer signal TR1 that is input to the first input section in the case of four gradation printing.
Figure 34B:
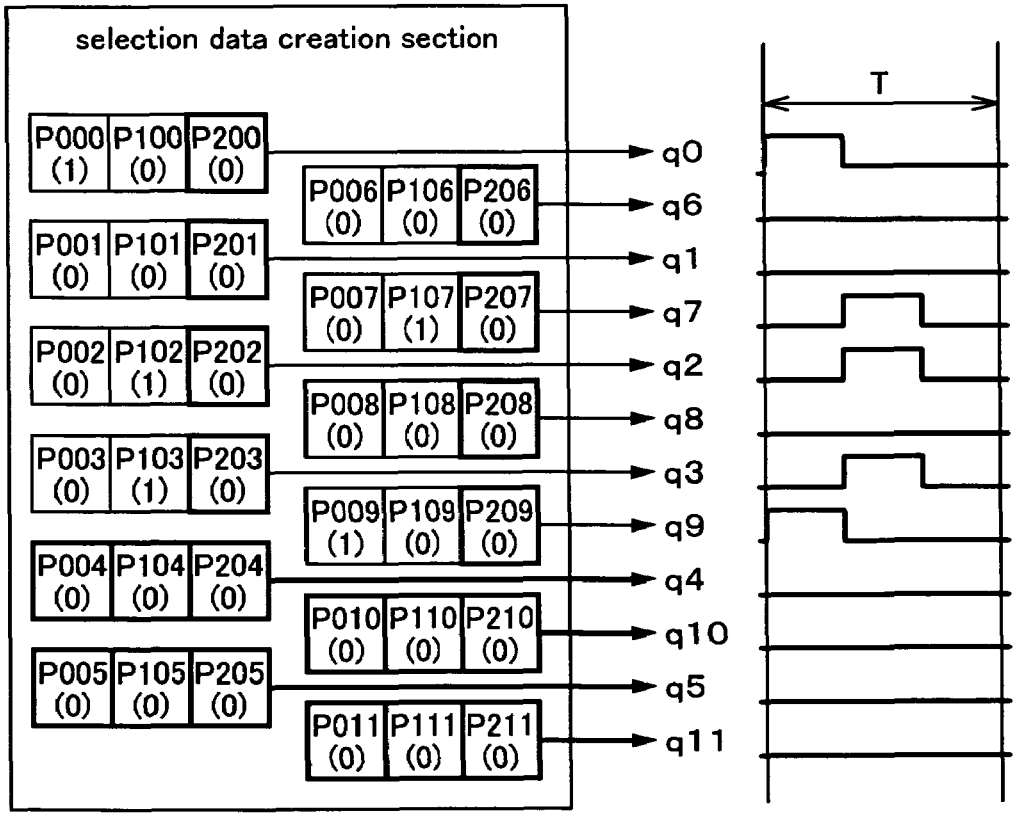
FIG. 34B is an explanatory diagram of the function of the selection signal creation section in the case of four gradation printing.

FIG. 34A is an explanatory diagram of the first transfer signal TR1 that is input to the first input section 846A at the time of four gradation printing. FIG. 34B is an explanatory diagram of the function of the selection signal creation section 844 in the case of four gradation printing.

In the third embodiment, like in the first embodiment and the second embodiment, the second input section 846B of the color head controllers HC that perform four gradation printing is connected to the GND, and the potential of the second input section 846B is L level. Thus, when the first transfer signal TR1 is input to the first input section 846A, L level data is set in the third shift register 81C and the second shift register group 842B. In accordance with the pulse of the latch signal LAT, the L level data that have been set in the third shift registers 81C are latched by the third latch circuits 82C, and the L level data set in the second shift register group 842B are latched by the selection signal creation section 844.

When the selection signal creation section 844 creates the selection signals q0 to q3 and the selection signals q6 to q9, the first interval T21 and the second interval T22 are set to the L level or H level according to the setting data. The selection signal creation section 844 sets the third interval T25 of the selection signals q0 to q3 to the L level in accordance with the L level data from the second shift register group 842B. Thus, the selection signal creation section 844 creates the same selection signals q0 to q3 and selection signals q6 to q9 as in six gradation printing.

The selection signal creation section 844, like in the case of six gradation printing, creates the selection signals q4, q5, q10, and q11 based on the data latched from the second shift register group 842B. However, since the data latched from the second shift register group 842B is L level, the selection signals q4, q5, q10, and q11 are L level in all intervals from the first interval T21 through the third interval T23.

Seen from the signal selection section 83, the data latched by the first latch circuit 82A through the third latch circuit 82C are 3-bit pixel data with upper order bit data of 0. The signal selection section 83 then, like in the case of six gradation printing, selects one of the selection signals q0 to q5, and selects one of the selection signals q6 to q11, according to the three bits of pixel data latched by the first latch circuit 82A through the third latch circuit 82C. However, since the upper order bit data is 0 when seen from the signal selection section 83, none of the selection signals q4, q5, q10, and q11 are selected by the signal selection section 83. Thus, in practical terms the signal selection section 83 selects one of the selection signals q0 to q3 and selects one of the selection signals q6 to q9.

Thus, the ink meniscus is finely vibrated when the pixel data are 00, a 3 pl ink droplet is ejected, forming a small dot, when the pixel data are 01, a 7 pl ink droplet is ejected, forming a medium dot, when the pixel data are 10, and a 14 pl ink droplet is ejected, forming a large dot, when the pixel data are 11.

In the above second embodiment, it is possible to realize the same effect as in the first embodiment described above.

It should be noted that with the third embodiment, like in the first embodiment and the second embodiment discussed above, it is possible to use a common head controller HC for four gradation printing and six gradation printing (thus, it is possible to print by changing the number of gradations for each color). Also, like in the first embodiment and the second embodiment discussed above, the amount of data of the transfer signal TR that are serially transferred to the first input section 846A and the second input section 846B of the head controller HC is less than in the second reference example, and thus the setting of data is not time consuming.

Further, when the piezo elements 421 are driven using two types of drive signals as in the third embodiment, the two drive signals can be divided into numerous different waveforms and input, and thus the repeating period T2 becomes shorter and the amount of setting data becomes larger because the amount of setting data increases. Regardless, during a given repeating period T2 it is necessary to set the pixel data and the setting data for the next repeating period T2. In the third embodiment, the time required for setting the data can be shortened, and thus during the short repeating period T2 it is possible to set the pixel data and the setting data for the next repeating period T2, and this is particularly effective.

Also, with the third embodiment, the selection signals q0 to q3 and the selection signals q6 to q9 are determined to be L level or H level based on not only the setting data that are input to the first input section 846A but also the signal that is input to the second input section 846B. Thus, the amount of setting data to be input to the first input section 846A can be reduced, and thus, in the third embodiment, the time that is required for setting the data can be shortened even more.

Other Embodiments

The foregoing embodiments are for the purpose of facilitating understanding of the present invention, and are not to be interpreted as limiting the present invention. The invention can of course be altered and improved without departing from the gist thereof and includes functional equivalents. In particular, embodiments mentioned below are also included in the present invention.

Regarding the Printer

In the above embodiments a printer was described, but there is no limitation to this. For example, technology similar to that of the present embodiments can also be adopted for various types of printing apparatuses that use inkjet technology, including color filter manufacturing devices, dyeing devices, fine processing devices, semiconductor manufacturing devices, surface processing devices, three-dimensional shape forming machines, liquid vaporizing devices, organic EL manufacturing devices (particularly macromolecular EL manufacturing devices), display manufacturing devices, film formation devices, and DNA chip manufacturing devices.

Regarding the Nozzles

In the foregoing embodiments, ink was ejected using piezoelectric elements. However, the method for ejecting liquid is not limited to this. For example, it is also possible to employ other methods, such as the method of using heaters as the drive elements for ejecting ink.

Regarding Transfer Signal TR

In the above described embodiment, there were two transfer signals to be input to each head controller. Namely, each head controller had two input sections for inputting the transfer signals TR. However, it is not limited thereto. For example, each head controller can be provided with a third input section other than the first input section and the second input section. Of course, more than three input sections can be provided to each head controller. Thus, transfer data that shows more gradations can be input to the head controller.

Regarding Drive Signal COM

In the above described Embodiment 3, there were two kinds of drive signals, but there may be three or more kinds.

In the above-described embodiment, image data to be printed is analyzed, the primary color is decided, and a number of gradations for each color is determined, however, the number of gradations of each color can be determined based on information supplementary to an image data to be printed. In such a case, for example, information showing a content of an image data, as information supplemental to the image data, is supplemental to an image data, and the printer driver obtains the image data and the information supplemental to the image data. The information supplemental to the image data is coded, and is, for example, content such as the sky at sunset, the blue sky, and the sea. The printer driver compares the information that has been coded, with a look-up table of a code that the printer driver has in advance and a number of gradations of each color. For example, in the case of the sea or the blue sky, the number of gradations of cyan and magenta are set higher than that for black or yellow, and in the case of the sky at sunset, the number of gradations of yellow and magenta are set higher than that of black or cyan.

As the information that is supplemental to the image data, there can also be information that designates the number of gradations of each color. The information that is supplemental to the image data can be, for example, information that becomes supplemental to the image data based on a user's operation or setting of an image-taking device at the time of taking an image of an image data with an image-taking device.

In the above-described embodiment, the number of gradations of each color is set in the printer driver that is installed in the computer 110, however, printing can be performed, by a function similar to a printer driver included in the printer 1, by obtaining image data to be printed or the like, setting a number of gradations of each color, and converting the image data to print data.

IN CONCLUSION (1) The above described printer 1 (one example of a printer device) has a piezo element (one example of a first drive element, hereinafter referred to as "cyan piezo element") that is driven to form a dot by ejecting cyan ink from a cyan ink nozzle group C (refer to FIG. 4), and a piezo element (one example of a second drive element, hereinafter referred to as "yellow piezo element") that is driven to form a dot by ejecting yellow ink from a yellow ink nozzle group C. The printer 1 discussed above is provided with a printer side controller 60, a cyan head controller HC (refer to FIG. 15), a yellow head controller HC, and the like, as controllers for controlling a cyan piezo element or a yellow piezo element.

The controllers of the printer 1 discussed above control the cyan piezo element to print in eight gradations (so that dots can be formed for each pixel with eight gradations), at a certain timing, as shown in for example FIG. 19A, and control the yellow piezo element to print with four gradations. For example, as shown in FIG. 19B, in a different timing, the above described controllers of the printer, control the cyan piezo element to print with four gradations.

In this way, the above described printer 1 can print by changing the number of gradations for each color. Thus, the number of gradations of each color can be changed arbitrarily according to the situation.

(2) The above described controllers of printers (the printer side controller 60, the cyan head controller HC (refer to FIG. 15), the yellow head controller HC, and the like) switch the number of gradations when controlling the driving of the cyan piezo element, according to the printing condition. For example, in the first embodiment, the cyan piezo element is controlled for four gradation printing in monochrome printing, and the cyan piezo element is controlled for eight gradation printing in color printing, and the number of gradations when controlling the driving of the cyan piezo element can be switched, according to monochrome printing/color printing. In monochrome printing it is not necessary to control the piezo elements that eject cyan ink based on a high number of gradations, however in color printing if the number of gradations of cyan is raised, the middle tones of blue or green can be printed so as to change smoothly. In this way, if the number of gradations when controlling the driving of the cyan piezo element is switched according to the printing condition (for example, monochrome printing/color printing), the image quality of the printed image can be increased.

(3) The above described controllers of the printer, switch the number of gradations when controlling the driving of the cyan piezo element, based on the image to be printed. For example, in the first embodiment, driving of the cyan piezo element is controlled, based on printing with eight gradations when blue is the primary color of the image to be printed, and based on printing with four gradations when red is the primary color. In order to smoothly print the middle tones of blue, it is necessary to print the cyan piezo elements at a high gradation, however for a red image, even if the cyan piezo element is printed at a high number of gradations it does not contribute substantially to the improvement of image quality.

(4) In the above-described embodiment, the image data of the RGB color space is analyzed and a primary color of RGB is specified, two colors of CMY regarding the specified color are printed with a high number of gradations, one remaining color of CMY is printed with a low number of gradations. For example, in the first embodiment described above, in the case that blue is specified as the primary color, only cyan and magenta that are associated with blue are printed with eight gradations, and yellow which has relatively low association with blue is printed with four gradations. In this way, when printing the two colors of CMY with a high number of gradations, any color of RGB may be specified.

However, the method to determine the two colors of CMY to be printed with a high number of gradations, is not limited to the above described embodiment. After the image data of RGB color space undergoes color conversion to an image data of CMY color space, the image data of CMY color space is analyzed, and the two primary colors may be decided.

(5) In the above-described embodiment, the controllers of the printer have a printer side controller 60 (first controller) on the printer main body and a head controller HC (includes a switching circuit 48) provided to the carriage to control the driving of the piezo element, and the like. Then, a cable for transmitting a signal is provided between the printer controller 60 and the head controller HC and the like.

This cable has a plurality of signal lines, and each signal line transmits for example, a latch signal LAT, a change signal CH, a clock CLK, GND, a drive signal COM, transfer signals TR1 to TR6 and the like.

In the above described embodiment, it is possible to change the number of gradations of each color, so that the amount of data to be transmitted into the cable can be decreased.

(6) In the above described embodiment, there is provided a switching circuit 48. This switching circuit switches the destination of the fifth transfer signal TR5 and the sixth transfer signal TR6, according to the number of gradations determined for each color. Thus, the number of signal lines of cables can be decreased.

Note that, the switching circuit 48 shown in FIG. 18 is one example, and can be a different circuit as long as it can perform the similar functions.

(7) By the way, even if the structures of all the head controllers are structured for printing with a high number of gradations as shown in FIG. 14B (refer to FIG. 11), it is possible to print by changing the number of gradations for each color. However, with this structure, it is necessary to send data for printing with a high number of gradations even to a head controller performing printing with a low number of gradations, thus the data amount to be transmitted becomes greater. On the other hand, with the structure shown in FIG. 14A, the number of gradations for each color becomes fixed, and the number of gradations cannot be changed.

In the above described embodiment, each head controller is a common structure having the first input section and the second input section. The first input section is to be input with signals necessary for printing with a low number of gradations. Thus, printing with a low number of gradations can be performed, even if signals are not input into the second input section.

It should be noted that, printing with a high number of gradations is printing that forms more types of dots than in printing with a low number of gradations. In the above described embodiment, signals for forming dots necessary in printing with a high number of gradations that are not necessary in printing with a low number of gradations, namely, signals for ejecting ink droplets necessary in printing with a high number of gradations but not necessary in printing with a low number of gradations, is referred to as the fifth transfer signal TR5 and the sixth transfer signal TR6. The lines that transfer the fifth transfer signal TR5 and the sixth transfer signal TR6 and the second input sections of each head controller HC are connected via the switching circuit 48.

Thus, by controlling the switching circuit 48, it is possible to control whether of not to input the fifth transfer signal TR5 and the sixth transfer signal TR6 to the second input sections, and as a result, the number of gradations of each color can be switched.

(8) In the above described embodiment, the switching circuit 48 has a control data storage section 482 for storing 2 bits of data. This control data storage section 482 is for storing data that is selected by the multiplexer 483, namely, it is for determining input of signals to the second input sections.

(9) For the setting of the control data storage sections 482 of the switching circuits 48 of each head controller HC, signal lines for inputting signals to the first input sections of each head controller HC are used. Specifically, for the setting of the control data storage section 482 of the switching circuit 48 for black, there is used the signal line for transmitting the first transfer signal TR1 to be input to the first input section of the black head controller HC. For the setting of the control data storage section 482 of the switching circuit 48 for yellow, there is used the signal line for transferring the second transfer signals TR2 to be input to the first input section of the yellow head controller HC. For the setting of the control data storage section 482 of the switching circuit 48 for cyan, there is used the signal line for transferring the third transfer signals TR3 to be input to the first input section of the cyan head controller HC. For the setting of the control data storage section 482 of the switching circuit 48 for magenta, there is used the signal line for transferring the fourth transfer signals TR4 to be input to the first input section of the magenta head controller HC.

Thus, it is not necessary to prepare a signal line for the setting of the control data storage section 482 of each switching circuit 48, and the signal lines of the cable can be decreased.

(10) In the above described embodiment, each head controller HC drives the piezo element based on printing with a high number of gradations, when the transfer signals TR are input to the first input section and the second input section. On the other hand, each head controller HC drives the piezo element based on the low number of gradations, when transfer signals TR are inputted to the first input section, and the GND is connected to the second input section.

It should be noted that in the above described embodiment, the GND is connected to the second input section when printing with a low number of gradations, but it is not limited thereto. It can be other signals at a constant potential, such as L level signals, or H level signals.

(11) In the above described Embodiment 1, in the case of printing with eight gradations, the transfer signal TR including 380 bits (180 bits of pixel data×2, 20 bits of setting data) of data is input in the first input section, and the transfer signal TR including 200 bits (180 bits of pixel data, 20 bits of setting data) of data is input to the second input section (refer to FIG. 24A). The piezo elements are controlled, based on printing with eight gradations according to data of 580 bits total that are input in the first input section and the second input section.

Further, in Embodiment 1 described above, in the case of printing with four gradations, the transfer signal TR including 380 bits of data are input in the first input section, and the transfer signal is not input in the second input section (refer to FIG. 25A). The piezo elements are controlled, based on printing with four gradations according to 380 bits of data input from the first input section.

By using such head controllers, it becomes unnecessary to input data to the second input section of the head controller performing printing with a low number of gradations, and thus the data amount can be decreased.

(12) By the way, printing with a high number of gradations is printing that forms more types of dots than in printing with a low number of gradations, so that the data amount of the pixel data of each pixel becomes more than when printing with a low number of gradations. 2 bits of pixel data (first pixel data) that are necessary in printing with a low number of gradations and in printing with a high number of gradations are included in the first transfer signal TR1 to the fourth transfer signal TR4 respectively, and 1 bit of pixel data (second pixel data) that is not necessary in printing with a low number of gradations but that is necessary in printing with a high number of gradations, are included in the fifth transfer signal TR5 or the sixth transfer signal TR6.

Each head controller HC drives the piezo element based on the first pixel data and the second pixel data, when the fifth transfer signal TR5 or the sixth transfer signal TR6 are input in the second input section. On the other hand, each head controller HC drives the piezo element based on the pixel data input from the first input section, when the fifth transfer signal TR5 and the sixth transfer signal TR6 are not input in the second input section. Thus, printing with a high number of gradations can be performed when the transfer signal TR is input in the second input section, and printing with a low number of gradations can be performed when the transfer signal TR is not input in the second input section.

(13) Each head controller HC described above has respectively a first latch circuit 82A and a second latch circuit 82B (one example of the first pixel data storage section) that store the pixel data input from the first input section, and a third latch circuit 82C (one example of the second pixel data storage section) that stores the pixel data to be input from the second input section. Then, the head controller HC controls the piezo element, based on the pixel data stored in the first latch circuit 82A through the third latch circuit 82C.

Here, when the second input section is connected to the GND and the fifth transfer signal TR5 and the sixth transfer signal TR6 are not input, the third latch circuit 82C is latched with L level data. Thus, even if the signal selection section 83 of the head controller HC performs the same operation regardless of the number of gradations, it is possible to switch printing with a high number of gradations with printing with a low number of gradations.

(14) By the way, when printing with a high number of gradations it is necessary to create more selection signals (signals performing control of the switch) than when printing with a low number of gradations, thus the data amount of setting data (data for setting control of the switch) for creating selection signals becomes larger than when printing with a low number of gradations. Setting data (first setting data) that is necessary for printing with a low number of gradations and printing with a high number of gradations are included in the first transfer signal TR1 to the fourth transfer signal TR4 respectively, and setting data (second setting data) that is not necessary for printing with a low number of gradations but that is necessary for printing with a high number of gradations are included in the fifth transfer signal TR5 and the sixth transfer signal TR6.

Each head controller HC controls the switch based on the first setting data and the second setting data, when the fifth transfer signal TR5 and the sixth transfer signal TR6 are input in the second input section. On the other hand, each head controller HC controls the switch based on setting data input from the first input section, when the fifth transfer signal TR5 and the sixth transfer signal TR6 are not input in the second input section. Thus, printing with a high number of gradations can be performed when the transfer signal TR is input in the second input section, and printing with a low number of gradations can be performed when the transfer signal TR is not input in the second input section.

(15) Each head controller HC described above has a first shift register group 842A (one example of a first setting data memory section) that stores the first setting data input from the first input section, and a second shift register group 842B (one example of a second setting data memory section) that stores the second setting data input from the second input section. The head controller HC controls the switch by creating the selection signals, based on the setting data stored in the first shift register group 842A and the second shift register group 842B.

Here, if the second input section is connected to the GND and the fifth transfer signal TR5 or the sixth transfer signal TR6 are not input, the second shift register group 842B is set with L level data. The selection signal creation signal 844 creates the selection signals based on setting data stored in the first shift register group 842A and the second shift register 842B regardless of the number of gradations, however the output of the head controller section is switched for printing with a high number of gradations and for printing with a low number of gradations.

(16) If all the structural components in the above embodiment are included, then all the effects can be achieved. However, in order to print by changing the number of gradations for each color, it is not necessary to include all the structural components.

(17) In the above described embodiment, there are disclosed not only an embodiment of a printer, but also an embodiment of a printing method. According to the above printing method, it is possible to print by changing the number of gradations for each color.

(18) In the above described embodiment, there are also disclosed an embodiment of a printing system structured from a computer and a printer. Then, according to the above printing system, printing can be performed by changing the number of gradations for each color.

(19) The above embodiment also discloses a printer driver. This printer driver is installed in the computer 110, and by sending print data to the printer 1, it is possible to make the printer print by changing the number of gradations of each color. It should be noted that the printer driver can be record on a computer readable recording medium such as a CD-ROM, or can be downloaded from a designated website on the Internet.

What is claimed is:

1. A printing method comprising:

at a certain timing, controlling a first drive element so that a dot can be formed for each pixel with a first number of gradations, and controlling a second drive element so that a dot can be formed for each pixel with a second number of gradations that is lower than the first number of gradations, the first drive element being driven to form a dot by ejecting an ink of a first color from a nozzle, and the second drive element being driven to form a dot by ejecting an ink of a second color that is different from the first color from a different nozzle; and at a different timing, controlling the first drive element so that a dot can be formed for each pixel with the second number of gradations.

2. A printing method according to claim 1, wherein a number of gradations when controlling the driving of the first drive element can be switched, according to a printing condition.

3. A printing method according to claim 2, wherein a number of gradations when controlling the driving of the first drive element can be switched, based on an image to be printed.

4. A printing method according to claim 3, wherein drive elements driven to eject an ink of a color of any two colors of CMY based on any color of RGB specified by an analysis of image data of RGB color space, are controlled with the first number of gradations, and wherein a drive element driven to eject ink of a color of the other one color of CMY is controlled with the second number of gradations.

5. A printing method according to claim 2, wherein a number of gradations when controlling the driving of the first drive element can be switched, based on information auxiliary to image data to be printed.

6. A printing method according to claim 1, wherein a first controller provided to a main body, and a second controller that is movable with the nozzle are provided, and wherein, in between the first controller and the second controller, a plurality of signal lines for transmitting a signal for driving the first drive element and the second drive element are provided.

7. A printing method according to claim 6, wherein the second controller has a switching section for switching a signal to be transmitted to at least one shared signal line of a plurality of the signal lines, to a signal for driving the first drive element or a signal for driving the second drive element.

8. A printing method according to claim 7, wherein the second controller has a first controller for controlling the driving of the first drive element, and a second controller for controlling the driving of the second drive element, wherein the first controller and the second controller have a first input section and a second input section respectively, wherein a signal for driving the first drive element is input to the first input section of the first controller, wherein a signal for driving the second drive element is input to the first input section of the second controller, and wherein a signal to be transmitted to the shared signal line is input to the second input section of the first controller and the second input section of the second controller, via the switching section.

9. A printing method according to claim 8, wherein the switching section has a storage section for storing data for determining input of a signal to the second input section.

10. A printing method according to claim 9, wherein, when storing data for determining input of a signal to the second input section of the first controller to the storage section, a signal line for inputting a signal to the first input section of the first controller is used, and wherein when storing data for determining input of a signal to the second input section of the second controller to the storage section, a signal line for inputting a signal to the first input section of the second controller is used.

11. A printing method according to claim 8, wherein the first controller and the second controller control a drive element based on the first number of gradations, when a signal for driving the drive element is input to the first input section and the second input section, and control the drive element based on the second number of gradations, when a signal for driving the drive element is input to the first input section and a signal of a constant potential is input to the second input section.

12. A printing method according to claim 8, wherein the first controller and the second controller control the drive element based on the first number of gradations according to i+j bit of data, when a signal including i bit of data is input to the first input section, and a signal including j bit of data is input to the second input section, and control the drive element based on the second number of gradations according to i bit of data, when i bit of data is input to the first input section and a signal including data is not input to the second input section.

13. A printing method according to claim 8, wherein a first pixel data is included in a signal to be input to the first input section of the first controller and the first input section of the second controller, wherein a second pixel data is included in a signal to be transmitted to the shared signal line, wherein the first controller and the second controller control the drive element based on the first pixel data and the second pixel data, when a signal to be transmitted to the shared signal line is input to the second input section, and control the drive element based on the first pixel data, when a signal to be transmitted to the shared signal line is not input to the second input section.

14. A printing method according to claim 13, wherein the first controller and the second controller have a first pixel data storage section for storing the first pixel data, and a second pixel data storage section for storing the second pixel data respectively, wherein, data of a specific value is stored in the second pixel data storage section, when a signal to be transmitted to the shared signal line is not input to the second input section, and wherein the first controller and the second controller control the drive element based on data that has been stored in the first pixel data storage section and the second pixel data storage section.

15. A printing method according to claim 8, wherein the first controller and the second controller have a switch that controls whether or not to apply a drive signal to a drive element, wherein signals to be input to the first input section of the first controller and the first input section of the second controller, include a first setting data for setting the control of the switch, wherein a signal to be transmitted to the shared signal line includes a second setting data for setting the control of the switch, and wherein the first controller and the second controller control the switch based on the first setting data and the second setting data, when a signal to be transmitted to the shared signal line is input to the second input section, and control the switch based on the first setting data, when a signal to be transmitted to the shared signal line is not input to the second input section.

16. A printing method according to claim 15, wherein the first controller and the second controller have a first setting data storage section for storing the first setting data, and a second setting data storage section for storing the second setting data, wherein, when a signal to be transmitted to the shared signal line is not input to the second input section, data of a specific value is stored in the second setting data storage section, and wherein the first controller and the second controller control the switch based on data stored in the first setting data storage section and the second setting data storage section.

17. A printing apparatus comprising:

a first drive element that is driven to form a dot by ejecting an ink of a first color from a nozzle;

a second drive element that is driven to form a dot by ejecting an ink of a second color different from the first color from a different nozzle; and a controller that controls the first drive element so that a dot can be formed for each pixel with a first number of gradations, and controls the second drive element so that a dot can be formed for each pixel with a second number of gradations that is lower than the first number of gradations, at a certain timing, the controller controlling the first drive element so that a dot can be formed for each pixel with the second number of gradations, at a different timing.

* * * * *